US006815152B2

(12) United States Patent
Takada et al.

(10) Patent No.: US 6,815,152 B2
(45) Date of Patent: Nov. 9, 2004

(54) SILVER HALIDE COLOR PHOTOGRAPHIC PHOTOSENSITIVE MATERIAL

(75) Inventors: Kiyohito Takada, Kanagawa (JP); Hidekazu Sakai, Kanagawa (JP); Terukazu Yanagi, Kanagawa (JP)

(73) Assignee: Fuji Photo Film. Co., Ltd., Kanagawa (JP)

( * ) Notice: Subject to any disclaimer, the term of this patent is extended or adjusted under 35 U.S.C. 154(b) by 0 days.

(21) Appl. No.: 10/255,101

(22) Filed: Sep. 26, 2002

(65) Prior Publication Data

US 2003/0203326 A1 Oct. 30, 2003

(30) Foreign Application Priority Data

Sep. 27, 2001 (JP) ..... 2001-297533

(51) Int. Cl.[7] ..... G03C 1/46

(52) U.S. Cl. ..... 430/505; 430/502; 430/503; 430/567; 430/599; 430/604; 430/605

(58) Field of Search ..... 430/502, 503, 430/505, 567, 599, 604, 605

(56) References Cited

U.S. PATENT DOCUMENTS 4,840,878 A 6/1989 Hirose et al.
5,462,843 A * 10/1995 Klotzer et al. ..... 430/567
6,348,302 B1 * 2/2002 Kosugi ..... 430/604
6,395,463 B1 * 5/2002 Edwards ..... 430/507

FOREIGN PATENT DOCUMENTS

| | | |
|---|---|---|
| JP | 62-99751 | 5/1987 |
| JP | 4-217242 | 8/1992 |
| JP | 4-275544 | 10/1992 |

* cited by examiner

*Primary Examiner*—Geraldine Letscher
(74) *Attorney, Agent, or Firm*—Sughrue Mion, PLLC

(57) ABSTRACT

A silver halide color photographic photosensitive material comprising: a transmitting support; at least three types of photosensitive hydrophilic colloid layers disposed on the support, each type including at least one of a yellow, a magenta and a cyan color forming coupler; silver halide emulsion particles, which have a color sensitivity different from the other types, wherein at least one of the color sensitivities comprises green-sensitivity; and an Fe content of no more than $2\times10^{-5}$ moles/$m^2$; each silver halide emulsion particle including a halogen composition, which comprises at least one of silver chlorobromide, silver chloroiodide, silver chloroiodide bromide and silver chloride having a silver chloride content ratio of 95% by mole or more, an average sphere-equivalent particle diameter of the green-sensitive silver halogen emulsion particles comprising no more than 0.25 $\mu$m and at least one type of the green-sensitive silver halogen emulsion particles being doped with Ir.

24 Claims, No Drawings

SILVER HALIDE COLOR PHOTOGRAPHIC PHOTOSENSITIVE MATERIAL

BACKGROUND OF THE INVENTION

1. Field of the Invention

The present invention relates to a silver halide color photographic photosensitive material, and particularly to a silver halide color photographic photosensitive material that is preferably used as a cinematographic color photographic photosensitive material, exhibits high image quality, and is excellent in storage stability and processing stability.

2. Description of the Related Art

Silver halide color photographic photosensitive materials used for viewing, recording and storing dye images have been always desired to have high image quality, and numerous studies therefor have been conducted.

Motion picture, which is one application of silver halide photography, is a method for obtaining a moving picture by projecting sequentially 24 precise, still pictures per second and has overwhelmingly high image quality in comparison to other methods for obtaining the moving picture. However, the recent rapid progress in electronic and information processing techniques has provided in such a simple reproduction technique for moving picture that has high image quality approaching the motion picture, for example, a projector using a DMD device produced by Texas Instruments, Inc., and an ILA projector produced by Hughes JVC Technology Corp. Therefore, the current situation is that motion picture is further demanded to have higher image quality, ease of handling and a quickened developing (time saving).

It is necessary that photosensitive materials, particularly those used for projection (color positive films for motion picture), have high image quality since they are directly viewed by the users through movie-projectors, and are produced with the quickened developing and an even performance, wherein the high image quality and the quickened development processing are stable, since it is necessary to produce the material in large amounts for viewing in movie theaters around the world.

In order to quicken developing process, shortening of a developing time of the silver halide photographic photosensitive material has been considered an important problem, and various studies have been conducted for silver halide emulsions having a fast developing rate, a couplers having a high coupling activity, and processing agents able to develop quickly. In particular, as disclosed in U.S. Pat. No. 4,840,878, the use of a silver halide emulsion having a high silver chloride content is extremely effective for the rapid processing of color photographic photosensitive materials.

It is important that the photosensitive material have a high image quality, and exhibit a good reproducibility of scenes upon being projected on screens in theaters. The motion picture is enlarged upon projection, therefore, the photosensitive material used is required to have a fine granularity. To improve the granularity, techniques for using silver halide particles having a relatively small size are disclosed in JP-A No. 62-99751, No. 4-217242 and No. 4-275544. These publications disclose techniques for further improving in granularity by using silver halide particles in a tabular particle form, and techniques for improving gradation and color reproducibility, as well as granularity and sharpness, by modifying the layer structure of the photosensitive material and combining diffusible DIR compounds. However, there has been no technique that can overcome the problem of storage stability of a photosensitive material noted later, and particularly the problem of degradation of storage stability (desensitization over time) when using a high silver chloride emulsion having a relatively small particle size, which has been made clear by the invention.

SUMMARY OF THE INVENTION

The present invention has been developed to solve the problems associated with the conventional techniques and to attain the following objects.

An object of the invention is to provide a silver halide color photographic photosensitive material that has high image quality, is excellent in storage stability, and in finishing uniformity and processing stability when processed in laboratories, and exhibits less fluctuation in magenta density, and in particular, to provide a silver halide color photographic photosensitive material that can be suitably used as a cinematographic color positive photosensitive material.

As a result of earnest investigations made by the inventors with respect to these problems, it has been found that in order to realize high image quality, particularly improvement of the magenta granularity of high luminosity, and processing stability, particularly uniform photographic property when rapid processing, which are demanded by a silver halide color photographic photosensitive material, particularly a cinematographic color photographic photosensitive material, it is preferable that the halogen composition of all of the silver halide emulsion particles be controlled, and the average sphere-equivalent particle diameter of the green-sensitive emulsion particles be set at 0.25 $\mu$m or less.

However, when the foregoing photosensitive material is produced and evaluated, it has been confirmed that the finished magenta density suffers considerably large fluctuation while the material is sufficient in granularity and processing stability, particularly in uniform photographic property when rapid processing. This is a critical problem from the standpoint of always maintaining stable quality.

The inventors have then made further earnest investigations on the problem, and as a result, it has been found that the fluctuation in magenta density is a problem caused by the storage stability of the photosensitive material (desensitization of the magenta sensitivity of the photosensitive material over time), and the phenomenon specifically occurs in the case where the halogen composition is high silver chloride emulsion particles having a silver chloride content of 95% by mole or more, and the average sphere-equivalent particle diameter of the green-sensitive silver halide emulsion particles is set at 0.25 $\mu$m or less. In view of the findings, they have found that it is effective to dope the green-sensitive silver halide emulsion particles with iridium, and the amount of Fe in the photosensitive material is controlled. Moreover, they have found that restorability can be more improved to achieve this invention by using a flourine-based surface active agent to be contained in the photosensitive material, which has a specific structure. whereby the invention has been completed.

Therefore, the foregoing and other objects of the invention can be attained by the following embodiments.

A first embodiment of the invention is a silver halide color photographic photosensitive material comprising: a transmitting support; at least three types of photosensitive hydrophilic colloid layers disposed on the transmitting support, each type including at least one of a yellow color forming coupler, a magenta color forming coupler and a cyan color forming coupler; silver halide emulsion particles, which have a color sensitivity different from the other types, wherein at least one of the color sensitivities comprises green-sensitivity; and an Fe content of no more than $2\times10^{-5}$ moles/$m^2$; each silver halide emulsion particle including a halogen composition, which comprises at least one of silver chlorobromide, silver chloroiodide, silver chloroiodide bromide and silver chloride having a silver chloride content ratio of 95% by mole or more, an average sphere-equivalent particle diameter of the green-sensitive silver halogen emulsion particles comprising no more than 0.25 $\mu$m and at least one type of the green-sensitive silver halogen emulsion particles being doped with Ir.

A second embodiment of the invention is the silver halide color photographic photosensitive material according to the first embodiment, further comprising at least one compound, in the silver halide color photographic photosensitive material, which is represented by the following general formula (FS):

General formula (FS)

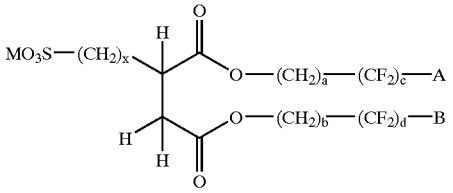

wherein, A and B each independently represents one of a fluorine atom and a hydrogen atom; a and b each independently represents an integer of 1 to 6; c and d each independently represents an integer of 4 to 8; x represents one of 0 and 1, and M represents a cation.

A third embodiment of the invention is the silver halide color photographic photosensitive material according to the first embodiment, each the silver halide emulsion particle including a halogen composition comprises one of silver chlorobromide, silver chloroiodide, silver chloroiodobromide and silver chloride having a silver chloride content ratio of 98% by mole or more.

A fourth embodiment of the invention is the silver halide color photographic photosensitive material according to the first embodiment, wherein at least one type of the green-sensitive silver halide emulsion particles contains an iridium compound, which comprises a hexa-coordinated iridium complex containing Ir as a central metal and at least one selected from Cl, Br and I as a ligand.

A fifth embodiment of the invention is the silver halide color photographic photosensitive material according to the fourth embodiment, wherein the iridium compound comprises a hexa-coordinated iridium complex containing Ir as a central metal and at least one selected from $H_2O$, OH, O, OCN, thiazole and a substituted thiazole as a ligand.

A sixth embodiment of the invention is the silver halide color photographic photosensitive material according to the fourth embodiment, wherein the iridium compound contains at least one kind of hexa-coordinated iridium complex selected from the group consisting of $[IrCl_6]^{2-}$, $[IrCl_6]^{3-}$, $[IrBr_6]^{2-}$, $[IrBr_6]^{3-}$ and $[IrI_6]^{3-}$, and at least one kind of hexa-coordinated iridium complex selected from the group consisting of $[Ir(H_2O)Cl_5]^{2-}$, $[Ir(H_2O)_2Cl_4]^-$, $[Ir(H_2O)Br_5]^{2-}$, $[Ir(H_2O)_2Br_4]$—, $[Ir(OH)Cl_5]^{3-}$, $[Ir(OH)_2Cl_4]^{3-}$, $[Ir(OH)Br_5]^{3-}$, $[Ir(OH)_2Br_4]^{3-}$, $[Ir(O)Cl_5]^{4-}$, $[Ir(O)_2Cl_4]^{5-}$, $[Ir(O)Br_5]^{4-}$, $[Ir(O)_2Br_4]^{5-}$, $[Ir(OCN)Cl_5]^{3-}$, $[Ir(OCN)Br_5]^{3-}$, $[Ir(thiazole)Cl_5]^{2-}$, $[Ir(thiazole)_2Cl_4]^-$, $[Ir(thiazole)Br_5]^{2-}$, $[Ir(thiazole)_2Br_4]^-$, $[Ir(5\text{-methylthiazole})Cl_5]^{2-}$, $[Ir(5\text{-methylthiazole})_2Cl_4]^-$, $[Ir(5\text{-methylthiazole})Br_5]^{2-}$ and $[Ir(5\text{-methylthiazole})_2Br_4]^-$.

A seventh embodiment of the invention is the silver halide color photographic photosensitive material according to the fourth embodiment, wherein an amount of the iridium compound is in a range of from $1\times10^{-10}$ to $1\times10^{-3}$ mole per mole of silver contained in the green-sensitive silver halide emulsion particles.

An eighth embodiment of the invention is the silver halide color photographic photosensitive material according to the first embodiment, wherein at least one type of the green-sensitive silver halide emulsion particles is doped with at least one of a transition metallic ion selected from the group consisting of iron, ruthenium, osmium, lead, cadmium and zinc.

A ninth embodiment of the invention is the silver halide color photographic photosensitive material according to the first embodiment, wherein the silver halide color photographic photosensitive material has an amount of Fe of $8\times10^{-6}$ mol/$m^2$ or less.

A tenth embodiment of the invention is the silver halide color photographic photosensitive material according to the first embodiment, wherein the silver halide color photographic photosensitive material has an amount of Fe in a range of from $1\times10^{-8}$ to $3\times10^{-6}$ mol/$m^2$.

An eleventh embodiment of the invention is the silver halide color photographic photosensitive material according to the first embodiment, wherein the green-sensitive silver halide emulsion particles comprise the average sphere-equivalent particle diameter of 0.20 $\mu$m or less.

An twelfth embodiment of the invention is the silver halide color photographic photosensitive material according to the first embodiment, wherein the green-sensitive silver halide emulsion particles comprise the average sphere-equivalent particle diameter in a range of from 0.05 to 0.18 $\mu$m.

A thirteenth embodiment of the invention is the silver halide color photographic photosensitive material according to the first embodiment, wherein all the silver halide emulsion particles have a variation coefficient (s/d) of particle diameter of 0.3 or less.

A fourteenth embodiment of the invention is the silver halide color photographic photosensitive material according to the first embodiment, wherein the photosensitive hydrophilic colloid layers comprise a 1-aryl-5-mercaptotetrazole compound in an amount of from $1.0\times10^{-5}$ to $5.0\times10^{-2}$ mole per mole of the silver halide.

A fifteenth embodiment of the invention is the silver halide color photographic photosensitive material according to the first embodiment, the silver halide color photographic photosensitive material further comprising a dye represented by the following general formula (I):

$$D—(X)_y \quad (I)$$

wherein D represents a residual group of a compound having a chromophoric group; X represents one of a dissociative hydrogen atom and a group having a dissociative hydrogen atom that is connected to D one of directly and through a divalent linking group; and y represents an integer of from 1 to 7.

A sixteenth embodiment of the invention is the silver halide color photographic photosensitive material according to the first embodiment, wherein the silver halide color photographic photosensitive material comprises a dye represented by the following general formula (A):

General formula (A)

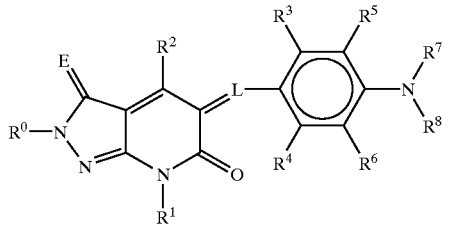

wherein L represents a nitrogen atom or a group formed by linking 1, 3, 5 or 7 methine group(s), which may be substituted, through a conjugated double bond; E represents O, S or N—$R^9$; $R^0$ and $R^9$ each independently represents one of a hydrogen atom, an alkyl group, an alkenyl group, an alkynyl group, an aryl group, a heterocyclic group, an amino group, a hydrazino group and a diazenyl group, which groups may be further substituted with another substituent; $R^1$ represents one of a hydrogen atom, an allyl group, an aryl group, an alkenyl group, an alkynyl group and a heterocyclic group, which groups may be further substituted with another substituent; $R^2$ represents one of a hydrogen atom, a halogen atom, a cyano group, a nitro group, a hydroxyl group, a carboxyl group, an alkyl group, an aryl group, an alkenyl group, a heterocyclic group, an alkoxy group, an aryloxy group, an alkoxycarbonyl group, an aryloxycarbonyl group, an amino group, an acyloxy group, a carbamoyl group, a sulfamoyl group, an alkylthio group, an arylthio group, an alkylsulfonyl group, an arylsulfonyl group and an alkynyl group, wherein the alkyl group, the aryl group, the alkenyl group, the heterocyclic group, the alkoxy group, the aryloxy group, the alkoxycarbonyl group, the aryloxycarbonyl group, the amino group, the acyloxy group, the carbamoyl group, the sulfamoyl group, the alkylthio group, the arylthio group, the alkylsulfonyl group, the arylsulfonyl group and the alkynyl group may be further substituted with another substituent, provided that $R^0$ and $R^9$ may be connected to form a ring; $R^3$ and $R^4$ each independently represents one of a hydrogen atom, a halogen atom, an alkoxy group, an alkyl group, an alkenyl group, an aryl group and an aryl group; $R^5$ and $R^6$ each independently represents one of a hydrogen atom and a substituent; and $R^7$ and $R^8$ each independently represents one of an alkyl group, an aryl group, a vinyl group, an acyl group, an alkyl group and an arylsulfonyl group, provided that $R^3$ and $R^5$, $R^4$ and $R^6$, $R^7$ and $R^8$, $R^5$ and $R^7$, and $R^6$ and $R^8$ each may be connected to form a ring.

A seventeenth embodiment of the invention is the silver halide color photographic photosensitive material according to the fifteenth embodiment, further comprising a solid fine particle dispersion, which includes the dye represented by the general formula (I) and a dispersion assistant.

An eighteenth embodiment of the invention is the silver halide color photographic photosensitive material according to the sixteenth embodiment, further comprising a solid fine particle dispersion, which includes the dye represented by the general formula (A) and a dispersion assistant.

A nineteenth embodiment of the invention is the silver halide color photographic photosensitive material according to the seventeenth embodiment, wherein the dispersion assistant comprises at least one of polyalkylene oxide compounds represented by the following general formulae (V-a) and (V-b):

General formula (V-a)

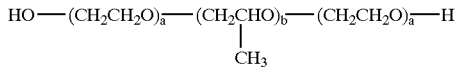

General formula (V-b)

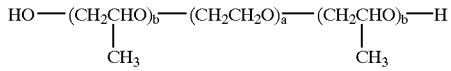

wherein a and b each independently represents a value of from 5 to 500.

A twentieth embodiment of the invention is the silver halide color photographic photosensitive material according to the nineteenth embodiment, wherein the polyalkylene oxide represented by the general formulae (V-a) and (V-b) comprises a weight ratio of a polyethylene oxide part of from 0.3 to 0.9, and the polyethylene oxide part comprises an average molecular weight of from 1,000 to 30,000 and an HLB (hydrophilicity-lipophilicity balance) value of from 7 to 30.

DESCRIPTION OF THE PREFERRED EMBODIMENTS

The silver halide color photographic photosensitive material of the present invention will be described in detail below.

The silver halide color photographic photosensitive material of the invention contains a transmitting support having thereon at least three kinds of photosensitive hydrophilic colloid layers containing at least one of a yellow dye forming coupler, a magenta dye forming coupler and a cyan dye forming coupler, and silver halide emulsion particles having sensitivities different from each other, in which all the silver halide emulsion particles have a halogen composition of silver chlorobromide, silver chloroiodide, silver chloroiodobromide or silver chloride having a silver chloride content of 95% by mole or more, at least one kind of green-sensitive silver halide emulsion particles is doped with iridium, the green-sensitive silver halide emulsion particles have an average sphere-equivalent particle diameter of 0.25 $\mu$m or less, and the silver halide color photographic photosensitive material has an Fe content of $2\times10^{-5}$ mol/$m^2$ or less.

The Fe content in the silver halide color photographic photosensitive material is preferably $8\times10^{-6}$ mol/$m^2$ or less, and the average sphere-equivalent particle diameter of the green-sensitive silver halide emulsion particles is preferably 0.20 $\mu$m or less.

The silver halide emulsion used in the silver halide photographic photosensitive material of the invention will be described.

In the invention, the silver chloride content of the entire silver halide emulsion particles contained in the photosensitive material is 95% by mole or more. Silver chloride, silver chlorobromide, silver chloroiodide and silver chloroiodobromide having a silver chloride content of 95% by mole or more are preferable from the standpoint of quickness of the coloration phenomenon. Among these, a silver halide having a silver chloride content of 98% by mole or more is more preferable. A silver bromide local phase may be present on the surface of the silver chloride particles. The silver halide composition of the local phase preferably has a silver bromide content of at least 10% by mole, and a silver bromide content more preferably exceeds 20% by mole. Tabular particles having a (111) plane or a (100) plane as the major plane may be used. Tabular high silver chloride emulsion particles having a (111) plane or a (100) plane as the major plane can be prepared by methods disclosed in JP-A No. 6-138619, U.S. Pat. Nos. 4,399,215, 5,061,617, 5,320,938, 5,264,337, 5,292,632, 5,314,798, and 5,413,904 and WO94/22051.

Various kinds of polyvalent metallic ion impurities may be introduced into the silver halide emulsion used in the invention during the process of forming the emulsion particles or the process of physical aging.

In the invention, an iridium compound (sometimes referred to as an "iridium ion-containing compound") is contained in at least one kind of green-sensitive silver halide emulsion particles.

The term "doped" herein means that a material is intentionally added in a small amount, whereby the characteristics are greatly changed or suppressed.

It is preferable that in silver halide emulsion layers, which are different in sensitivity, the silver halide emulsion layers each contain the iridium compound in the silver halide particles contained in at least one kind of the silver halide emulsions. In the case where the iridium compound is contained, it is known that the reciprocity law characteristics are improved, and it is found in the invention that the processing stability is particularly improved.

The specific silver halide particles in the silver halide emulsion of the invention preferably contain iridium. As the iridium compound, a hexa-coordinated complex having six ligands and iridium as a central metal is preferable because it is uniformly incorporated in the silver halide crystals. As a preferred embodiment of the iridium used in the invention, a hexa-coordinated complex having Ir as a central metal, where the ligands contain Cl, Br or I, is preferable, and a hexa-coordinated complex having Ir as a central metal, where all the six ligands are selected from Cl, Br and I, is more preferable. In this case, Cl, Br and I may be present as a mixture in the hexa-coordinated complex.

Examples of the hexa-coordinated complex having Ir as a central metal, where all the six ligands are selected from Cl, Br and I, will be shown below, but the iridium used in the invention is not limited thereto.

$[IrCl_6]^{2-}$
$[IrCl_6]^{3-}$
$[IrBr_6]^{2-}$
$[IrBr_6]^{3-}$
$[IrI_6]^{3-}$

As a preferred embodiment of the iridium used in the invention, a hexa-coordinated complex having Ir as a central metal and at least one ligand other than a halogen and cyan is preferable, a hexa-coordinated complex having Ir as a central metal and $H_2O$, OH, O, OCN, thiazole or a substituted thiazole as a ligand is more preferable, and a hexa-coordinated complex having Ir as a central metal and at least one of $H_2O$, OH, O, OCN, thiazole and a substituted thiazole as a ligand, with the other ligands being Cl, Br or I, is particularly preferable. Furthermore, a hexa-coordinated complex having Ir as a central metal and one or two 5-methylthiazole as ligands, with the other ligands being Cl, Br or I, is most preferable.

Examples of the hexa-coordinated complex having Ir as a central metal and at least one of $H_2O$, OH, O, OCN, thiazole and a substituted thiazole as a ligand, with the other ligands being Cl, Br or I, will be shown below, but the iridium used in the invention is not limited thereto.

$[Ir(H_2O)Cl_5]^{2-}$
$[Ir(H_2O)_2Cl_4]^{-}$
$[Ir(H_2O)Br_5]^{2-}$
$[Ir(H_2O)_2Br_4]$—
$[Ir(OH)Cl_5]^{3-}$
$[Ir(OH)_2Cl_4]^{3-}$
$[Ir(OH)Br_5]^{3-}$
$[Ir(OH)_2Br_4]^{3-}$
$[Ir(O)Cl_5]^{4-}$
$[Ir(O)_2Cl_4]^{5-}$
$[Ir(O)Br_5]^{4-}$
$[Ir(O)_2Br_4]^{5-}$
$[Ir(OCN)Cl_5]^{3-}$
$[Ir(OCN)Br_5]^{3-}$
$[Ir(\text{thiazole})Cl_5]^{2-}$
$[Ir(\text{thiazole})_2Cl_4]^{-}$
$[Ir(\text{thiazole})Br_5]^{2-}$
$[Ir(\text{thiazole})_2Br_4]^{-}$
$[Ir(\text{5-methylthiazole})Cl_5]^{2-}$
$[Ir(\text{5-methylthiazole})_2Cl_4]^{-}$
$[Ir(\text{5-methylthiazole})Br_5]^{2-}$
$[Ir(\text{5-methylthiazole})_2Br_4]^{-}$ The objects of the invention can be preferably attained by using only one of the hexa-coordinated complex having Ir as a central metal, where all of the six ligands are selected from Cl, Br and I, and the hexa-coordinated complex has Ir as a central metal and at least one ligand other than a halogen and cyan. However, in order to further enhance the effect of the invention, it is preferable to use, in combination, the hexa-coordinated complex having Ir as a central metal, where all of the six ligands are selected from Cl, Br and I, and the hexa-coordinated complex having Ir as a central metal and at least one ligand other than a halogen and cyan. Furthermore, as the hexa-coordinated complex having Ir as a central metal and at least one of $H_2O$, OH, O, OCN, thiazole and a substituted thiazole as a ligand, with the other ligands being Cl, Br or I, a complex having two kinds of ligands among these (i.e., one selected from $H_2O$, OH, O, OCN, thiazole and a substituted thiazole, and the other selected from Cl, Br and I) is preferably used.

The metallic complexes exemplified above are anions, and upon forming a salt with a cation, a cation that is easily soluble in water is preferable. Specifically, preferable examples of the cation include an alkali metallic ions, such as a sodium ion, a potassium ion, a rubidium ion, a cesium ion and a lithium ion, an ammonium ion, and an alkylammonium ion. The metallic complex may be used after dissolving in water or a mixed solvent of water and a suitable organic solvent that is miscible with water (for example, alcohols, ethers, glycols, ketones, esters and amides). The iridium complex is preferably added during the formation of the particles in an amount of from $1\times10^{-10}$ to $1\times10^{-3}$ mole per one mole of silver, and most preferably added in an amount of from $1\times10^{-8}$ to $1\times10^{-5}$ mole per one mole of silver.

It is preferable in the invention that the iridium complex be incorporated in the silver halide particles in such a manner that it is directly added to a reaction solution upon forming the silver halide particles, or in such a manner that it is added to a halide aqueous solution or other solutions for forming the silver halide particles, and the solution is then added to the reaction solution for forming the particles. It is also preferable that physical aging be carried out with fine particles having the iridium complex incorporated therein, so as to incorporate it into the silver halide particles. Moreover, the iridium complex can be contained in the silver halide particles by a combination of these methods.

Upon incorporating the complex into the silver halide particles, the complex may be uniformly present in the interior of the particles. It is preferable that the complex be present only in the surface layer of the particles as disclosed in JP-A Nos. 4-208986, 2-125245 and 3-188437, and it is also preferable that the complex be present only in the interior of the particles, and a layer containing no complex be added to the surface of the particles.

It is also preferable that physical aging be carried out with fine particles having the complex incorporated in the particles to modify the surface layer of the particles as disclosed in U.S. Pat. Nos. 5,252,451 and 5,256,530. These methods may be employed in combination, and multiple kinds of the complexes may be incorporated into one silver halide particle.

The halogen composition of the position, in which the complex is contained, is not particularly limited, and the hexa-coordinated complex having Ir as a central metal, where all of the six ligands are selected from Cl, Br and I, is preferably contained in the part, where the silver bromide concentration exhibits the maximum.

In the invention, metallic ions other than iridium may be doped in the interior and/or the surface of the silver halide particles. Preferable examples of the metallic ion include transition metallic ions, and particularly, iron, ruthenium, osmium, lead, cadmium and zinc are preferable. It is more preferable that the metallic ion be used as a hexa-coordinated octahedral complex along with ligands.

In the case where an inorganic compound is used as the ligand, it is preferable to use a cyanide ion, a halide ion, a thiocyanic ion, a hydroxide ion, a peroxide ion, an azide ion, a nitrite ion, water, ammonia, a nitrosyl ion or a thionitrosyl ion. It is preferable that the ligands be used by coordinating on the metallic ion selected from iron, ruthenium, osmium, lead, cadmium and zinc, and it is also preferable that multiple kinds of ligands be used in one complex molecule.

An organic compound may also be used as the ligand, and preferable examples of the organic compound include linear compounds having a carbon number on the main chain of 5 or less and/or 5-membered or 6-membered heterocyclic compounds. More preferable examples of the organic compound include compounds having a nitrogen atom, a phosphorus atom, an oxygen atom or a sulfur atom as a ligand atom to a metal inside the molecule. Particularly preferable examples thereof include furan, thiophene, oxazole, isooxazole, thiazole, isothiazole, imidazole, pyrazole, triazole, furazane, pyran, pyridine, pyridazine, pyrimidine and pyrazine, and a compound having these compounds as a basic skeleton with a substituent introduced thereto is also preferable.

Preferable examples of the combination of the metallic ion and the ligand include a combination of an iron ion or a ruthenium ion with a cyanide ion. In the invention, it is preferable to use the compounds with iridium in combination. In the compounds, it is preferable that the cyanide ion occupies the major part of the coordination number to iron or ruthenium as a central metal, and it is also preferable that the remaining coordination positions are occupied by a thiocyanic ion, ammonia, water, a nitrosyl ion, dimethylsulfoxide, pyridine, pyradine or 4,4'-bipyridine. It is most preferable that all the six coordination positions on the central metal are occupied by cyanide ions to form a hexacyano iron complex or a hexacyano ruthenium complex. The complex having a cyanide ion as a ligand is preferably added during formation of the particles in an amount of from $1\times10^{-8}$ to $1\times10^{-2}$ mole per one mole of silver, and most preferably added in an amount of from $1\times10^{-6}$ to $5\times10^{-4}$ mole per one mole of silver. In the case where ruthenium or osmium is used as a central atom, it is also preferable to use a nitrosyl ion, a thionitrosyl ion or water molecule and a chloride ion as a ligand in combination. It is more preferable to form a pentachloronitrosyl complex, a pentachlorothionitrosyl complex or a pentachloroaqua complex, and a hexachloro complex is also preferably formed. These complexes are preferably added during formation of the particles in an amount of from $1\times10^{-10}$ to $1\times10^{-6}$ mole per one mole of silver, and more preferably added in an amount of from $1\times10^{-9}$ to $1\times10^{-6}$ mole per one mole of silver.

Fe contained in the silver halide color photographic photosensitive material is introduced mainly by gelatin, by the Fe intentionally doped in the emulsion particles, and by the dye. The Fe content of the photosensitive material of the invention is required to be $2\times10^{-5}$ mol/m$^2$ or less (preferably from $1\times10^{-8}$ to $2\times10^{-5}$ mol/m$^2$), and preferably $8\times10^{-6}$ mol/m$^2$ or less (preferably from $1\times10^{-8}$ to $8\times10^{-6}$ mol/m$^2$), and most preferably $3\times10^{-6}$ mol/m$^2$ or less (preferably $1\times10^{-8}$ to $3\times10^{-6}$ mol/m$^2$).

It is important in the embodiments of the invention that the Fe content be defined (particularly from the standpoint of storage stability), and the effect with respect to the Fe content is first found in the embodiments of the invention.

The silver halide emulsion used in the invention is generally subjected to chemical sensitization. As the method of chemical sensitization, sulfur sensitization represented by addition of an unstable sulfur compound, noble metal sensitization represented by gold sensitization, and reduction sensitization can be used singly or in combination thereof. Preferable examples of the compounds used in the chemical sensitization include those disclosed in JP-A No. 62-215272, page 18, lower right column to page 22, upper right column.

The silver halide emulsion used in the invention is preferably subjected to the gold sensitization that is known in this field of art. The fluctuation in photographic performance upon scanning exposure with laser light can be further decreased by performing the gold sensitization. The gold sensitization can be carried out by using such a compound as aurichloric acid or a salt thereof, gold thiocyanate and gold thiosulfate. The amount of the compound added varies within a wide range depending on the case but is generally from $5\times10^{-7}$ to $5\times10^{-3}$ mole, and preferably from $1\times10^{-6}$ to $1\times10^{-4}$ mole, per one mole of silver halide.

In the invention, the gold sensitization may be used in combination with other sensitization methods, such as the sulfur sensitization, the selenium sensitization, the tellurium sensitization, the reduction sensitization and the noble metal sensitization using compounds other than the gold compound, and the combination use is more preferable in the invention.

In the silver halide emulsion used in the invention, various kinds of compounds may be contained to prevent fogging during the production process, storage and photographic processing of the emulsion and the photosensitive material, and to stabilize the photographic performance. That is, various kinds of compounds that are known as fogging preventing agents or stabilizers may be added thereto. Examples of these compounds include an azole compound, such as a benzotriazolium salt, a nitroimidazole compound, a nitrobenzimidazole compound, a chlorobenzimidazole compound, a bromobenzimidazole compound, a mercaptothazole compound, a mercaptobenzothiazole compound, a mercaptobenzimidazole compound, a mercaptothiadiazole compound, an aminotriazole compound, a benzotriazole compound, a nitrobenzotriazole compound, a mercaptotetrazole compound (particularly, 1-phenyl-5-mercaptotetrazole), a mercaptopyrimidine compound and a mercaptotriazine compound; a thioketo compound, such as oxadrinthion; an azaindene compound, such as a triazaindene compound, a tetraazaindene compound (particularly, 4-hydroxy-substituted (1,3,3a,7)tetraazaindene) and a pentaazaindene compound; benzenethiosulfonic acid, benzenesulfinic acid and benzenesulfonic amide. Among these, a mercaptotetrazole compounds are particularly preferable since they have a function that the high illuminance sensitivity is further improved, in addition to the effects of prevention of fogging and stabilization.

The sphere-equivalent diameter of the average particle diameter of the silver halide particles contained in the green-sensitive silver halide emulsion in the invention must be 0.25 μm or less (preferably from 0.05 to 0.25 μm), and is preferably 0.20 μm or less (preferably from 0.05 to 0.20 μm), and more preferably 0.18 μm or less (preferably from 0.05 to 0.18 μm).

A particle having a sphere-equivalent diameter of 0.40 μm corresponds to a cubic particle having an edge length of about 0.32 μm, a particle having a sphere-equivalent diameter of 0.3 μm corresponds to a cubic particle having an edge length of about 0.24 μm, and a particle having a sphere-equivalent diameter of 0.20 μm corresponds to a cubic particle having an edge length of about 0.16 μm.

The average particle diameter of the green-sensitive silver halide emulsion is one of important factors that determine the magenta granularity, which exhibits the highest luminosity, and reduction of the average particle diameter is an important factor for obtaining high image quality.

It is generally known that the developing rate is increased by decreasing the particle size, and it is preferable to decrease the average particle diameter from the standpoint of improving the processing stability.

In the case where the particle diameter is decreased, particularly in the case where high silver chloride particles having the diameter in the range of the invention are prepared, it has been found that there is difficulty in stable production of uniform particles. In other words, it has been found that when the high silver chloride particles have high solubility and the particle diameter in the range of the invention, it is important to always prevent the particles from dissolution in the respective process steps from formation of particles to coating.

The silver halide particles in the invention are preferably monodispersed in order to accelerate a progression of development, and the variation coefficient of the particle diameter of the respective silver halide particles is preferably 0.3 or less (preferably from 0.05 to 0.3), and more preferably 0.25 or less (preferably from 0.05 to 0.25). The term "variation coefficient" herein is expressed by the ratio (s/d) of the standard deviation (s) on statistics and the average particle diameter (d).

The silver halide photographic emulsion that can be used in the invention can be produced by the methods disclosed, for example, in Research Disclosure (hereinafter abbreviated as RD) No. 17643 (December, 1978), pp. 22 to 23 "I. Emulsion Preparation and Types", ditto, No. 18716 (November, 1979), p. 648, ditto, No. 307105 (November of 1989), pp. 863 to 865, P. Glafkides, "Chemie et Phisique Photographique", Paul Montel (1967), G. F. Duffin, "Photographic Emulsion Chemistry", Focal Press (1966), and V. L. Zelikman, et al., "Making and Coating Photographic Emulsion", Focal Press (1964).

Also, the mono-dispersed emulsions as disclosed in U.S. Pat. Nos. 3,574,628 and 3,655,394 and UK No. 1,413,748 are preferable.

Tabular particles having an aspect ratio of about 3 or more can also be used in the invention. The tabular particles can be easily prepared by the methods disclosed, for example, in Gutoff, "Photographic Science and Engineering", vol. 14, pp. 248 to 257 (1970), U.S. Pat. Nos. 4,434,226, 4,414,310, 4,433,048, and 4,439,520 and British Patent No. 2,112,157.

The crystalline structure may be either uniform or such a structure that the inner part and the outer part have different halogen compositions, and a layer structure may be used. Plural kinds of silver halide having different compositions may be jointed by epitaxial junction, and silver halide may be jointed to a compound other than silver halide, such as rhodan silver and lead oxide. Mixtures of particles of various kinds of crystal forms may also be used.

The emulsion may be a surface latent image type where a latent image is formed mainly on the surface, an inner latent image type where a latent image is formed inside the particles, or such a type in which the latent image is formed in both the surface and the interior, but the emulsion must be a negative emulsion. As the inner latent image type emulsion, the core/shell inner latent image type emulsion disclosed in JP-A No. 63-264740 may be used, and the preparation method thereof is disclosed in JP-A No. 59-133542. The thickness of the shell of the emulsion is preferably from 3 to 40 nm, and particularly preferably from 5 to 20 nm, while it varies depending on the development process.

The silver halide emulsion is generally subjected to physical aging, chemical aging and spectral sensitization before use. The additives used in these process steps are disclosed in RD No. 17643, ditto No. 18716 and ditto No. 307105, and the corresponding parts thereof will be summarized in Table 9 described later.

In the photosensitive material of the invention, two or more kinds of emulsions, which are different in at least one of properties of the photosensitive silver halide emulsion, i.e., the particle diameter, the particle diameter distribution, the halogen composition, the shape of particles and the sensitivity (particularly the sensitivity in the invention), may be used as a mixture in the same layer, and it is a preferable embodiment of the invention.

The silver halide particles having a fogged surface disclosed in U.S. Pat. No. 4,082,553, the silver halide particles having a fogged interior disclosed in U.S. Pat. No. 4,626,489 and JP-A No. 59-214852, and colloidal silver are preferably applied to the photosensitive silver halide emulsion layer and/or the substantially non-photosensitive hydrophilic colloid layer. The silver halide particles having an interior or a fogged surface of the particles denote silver halide particles that can be developed uniformly (non-imagewise) irrespective to an unexposed part and an exposed part of the photosensitive material, and the preparation process thereof is disclosed in U.S. Pat. No. 4,626,498 and JP-A No. 59-214852. The silver halide constituting an inner core of core/shell silver halide particles having a fogged interior may have a different halogen composition. Examples of the silver halide having a fogged interior or the fogged surface include silver chloride, silver chlorobromide, silver iodobromide and silver chloriodobromide.

The fogged silver halide particles preferably have an average particle diameter of from 0.01 to 0.75 μm, and particularly from 0.05 to 0.6 μm. The shape of the particles may be regular, and the emulsion may be a polydispersed emulsion but is preferably a monodispersed emulsion (in which particles having diameters within the range of ±40% of the average particle diameter comprise 95% or more of the total weight or number of the silver halide particles).

A 1-aryl-5-mercaptotetrazole compound is preferably added to one layer of the photographic constituting layers, which includes the photosensitive silver halide emulsion layers and the non-photosensitive hydrophilic colloid layers (e.g., an intermediate layer and a protective layer) provided on a support, and more preferably in the silver halide emulsion layers, in an amount of from $1.0\times10^{-5}$ to $5.0\times10^{-2}$ mole, and more preferably from $1.0\times10^{-4}$ to $1.0\times10^{-2}$ mole, per one mole of silver halide. Addition thereof in an amount within these ranges further suppresses contamination on the surface of processed color prints after continuous processing.

The 1-aryl-5-mercaptotetrazole compound is preferably a compound in which the aryl group at the 1-position is an unsubstituted or substituted phenyl group, and preferable examples of the substituent include an acylamino group (for example, acetylamino and —$NHCOC_5H_{11}$(n)), a ureido group (for example, methylureido), an alkoxy group (for example, methoxy), a carboxyl group, an amino group and sulfamoyl group. Multiple (for example, two or three) of the substituents may be bonded on the same phenyl group, and the position of the substituents is preferably the meta-position or a para-position.

Specific examples of the compound include 1-(m-methylureidophenyl)-5-mercaptotetrazole and 1-(m-acetylaminophenyl)-5-mercaptotetrazole.

A compound represented by general formula (FS) will be explained in detail below.

General formula (FS)

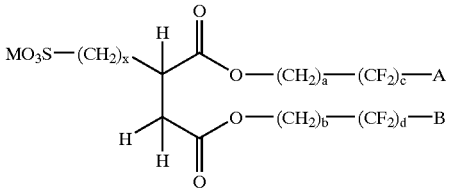

In general formula (FS), A and B each independently represents one of a fluorine atom and a hydrogen atom; a and b each independently represents an integer of 1 to 6; c and d each independently represents an integer of 4 to 8; x represents one of 0 and 1, and M represents a cation.

In general formula (FS), A and B each independently represents one of a fluorine atom and a hydrogen atom, and may be the same or different. Preferably both of A and B are fluorine atoms or hydrogen atoms, and more preferably both of A and B are fluorine atoms.

a and b each independently represents an integer of 1 to 6. So long as a and b are integers of 1 to 6, they may be the same or different independently. Preferably, a and b are integers of 1 to 6 and a is equal to b. More preferably, a and b are integers of 2 or 3 and a is equal to b. Even more preferably, both of a and b are 2.

c and d each independently represents an integer of 4 to 8. So long as c and d are integers of 4 to 8, they may be the same or different independently. Preferably, c and d are integers of 4 to 6 and c is equal to d. More preferably, c and d are integers of 4 or 6 and c is equal to d. Even more preferably, both of c and d are 4.

In general formula (FS), x represents one of 0 and 1, and either is preferable.

In general formula (FS), M represents a cation. The cation represented by M includes, for example, alkali metal ions such as lithium ions, sodium ions, potassium ions, and the like, alkali earth metal ions such as barium ions, calcium ions, and the like, and ammonium ions to be preferably used. Among these examples, lithium ions, sodium ions, potassium ions, and ammonium ions are particularly preferable.

Among general formulae (FS), general formula (FS-a) described below is more preferable.

General formula (FS-a)

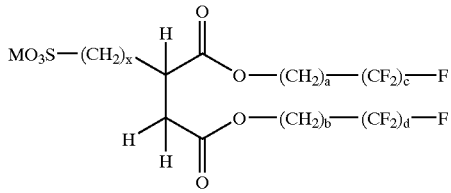

In general formula (FS-a), a, b, c, d, M, and x each has the same meanings as in general formula (FS). Moreover, preferable range of each is also the same.

Among general formulae (FS), general formula (FS-b) described below is more preferable.

General formula (FS-b)

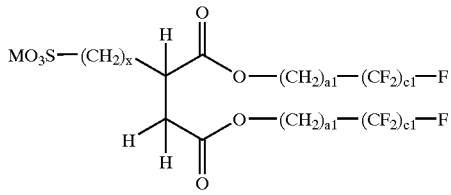

In general formula (FS-b), $a^1$ represents an integer of 2 to 3; $c^1$ represents an integer of 4 to 6; M represents a cation, and x represents one of 0 and 1.

In general formula (FS-b), $a^1$ is preferably 2 and $c^1$ is preferably 4. As x, either of 0 and 1 is preferable.

Specific examples of preferable surface active agents used in the present invention are shown below, however, the present invention is not limited to these examples.

FS-1

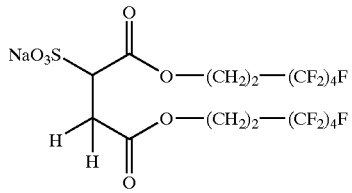

FS-2

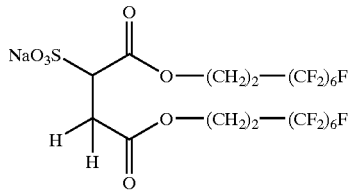

FS-3

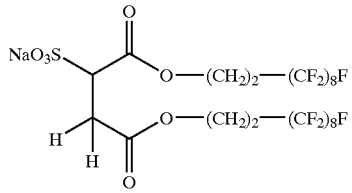

-continued
FS-4
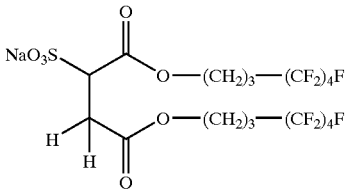
FS-5
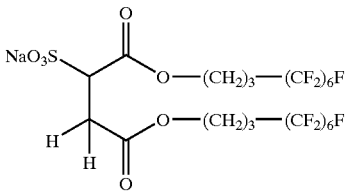
FS-6
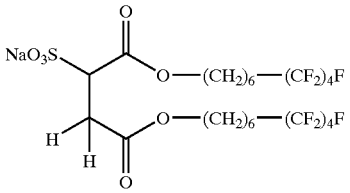
FS-7
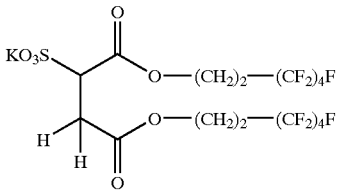
FS-8
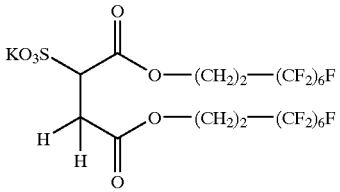
FS-9
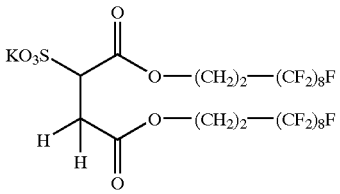
FS-10
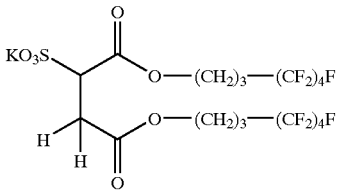
FS-11
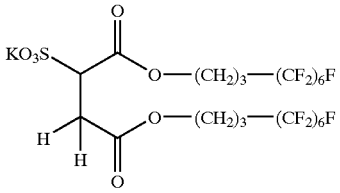
-continued
FS-12
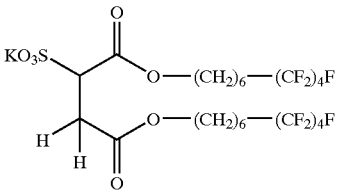
FS-13
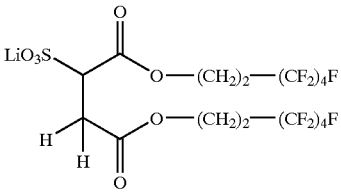
FS-14
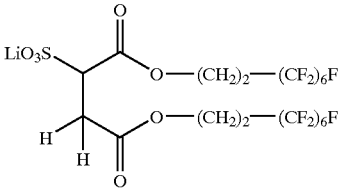
FS-15
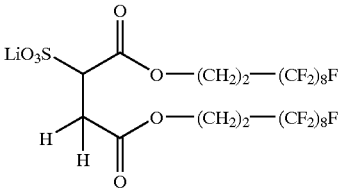
FS-16
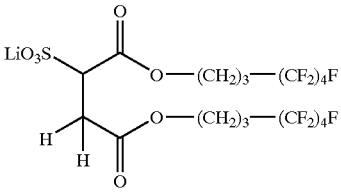
FS-17
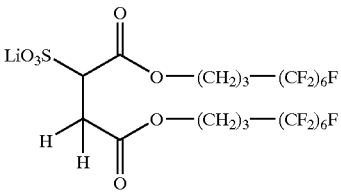
FS-18
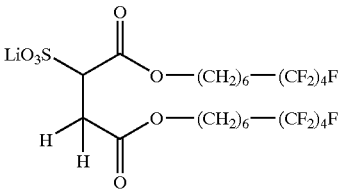
FS-19
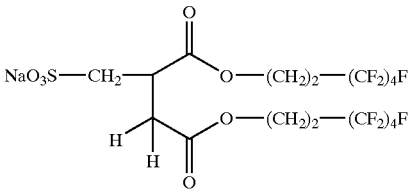

-continued

FS-20

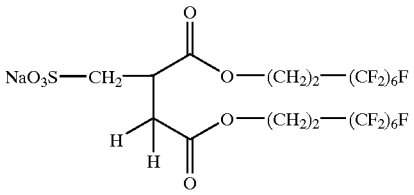

FS-21

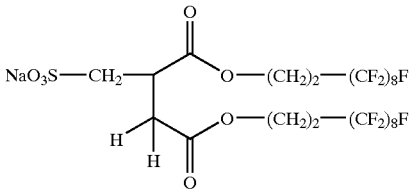

FS-22

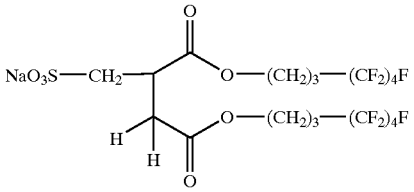

FS-23

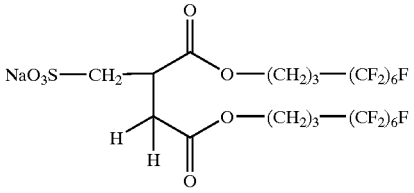

FS-24

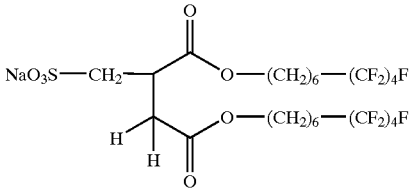

FS-25

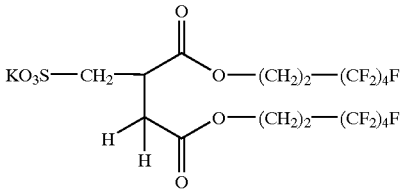

FS-26

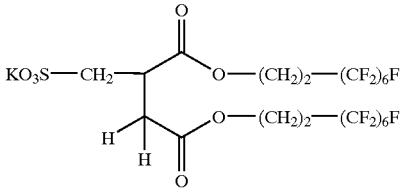

FS-27

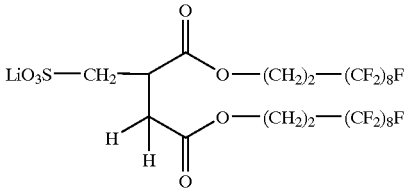

-continued

FS-28

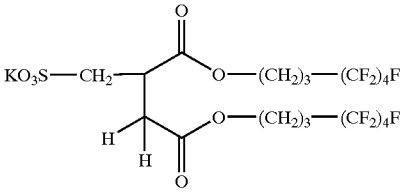

FS-29

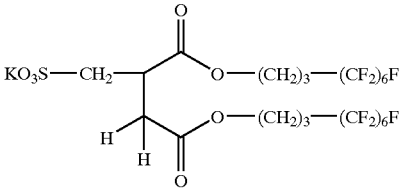

FS-30

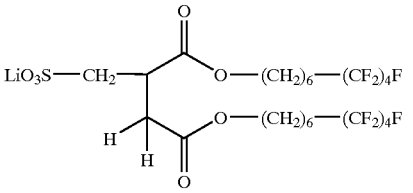

FS-31

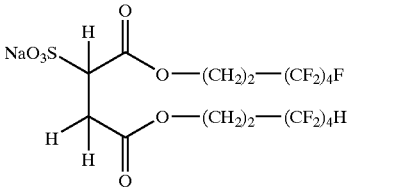

FS-32

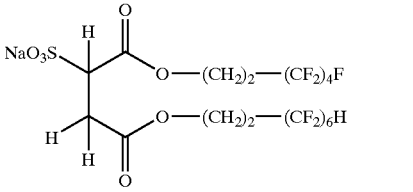

The surface active agent of the present invention, which is represented by general formulae (FS), (FS-a), and (FS-b), can be readily synthesized by combining a general esterification reaction and a general sulfonation reaction. Moreover, a counter cation conversion can be readily performed with an ion exchanged resin. Examples of representative synthesis methods are given below, however, the present invention is not limited to these specific examples.

Synthesis Example 1

Synthesis of Exemplary Compound FS-1

1-1) Synthesis of Di-(3,3,4,4,5,5,6,6,6-nonafluorohexyl) Maleate 9.8 g (0.10 moles) of maleic anhydride, 52.8 g (0.20 moles) of 3,3,4,4,5,5,6,6,6-nonafluorohexyl, and 0.5 g of p-toluenesulfonic acid monohydrate were heat and refluxed in 30 milliliters (hereinafter, milliliters will be referred as mL) of toluene for 24 hours, while distilling off water that was generated therein. Then, the mixture was cooled to room temperature, to this hexane and ethyl acetate were added, and an organic phase was washed with sodium hydroxide aqueous solution and saturated sodium chloride aqueous solution of 1 mole per liter (hereinafter, liter may be referred as L). After the organic phase was dried with sodium sulfate, the solvent was distilled off under a reduced pressure. The resulting mixture was purified by a silica gel column chromatography (hexane/ethyl acetate: 9/1 to 8/2, v/v) to obtain 53.2 g (88% yield) of the object matter as a white solid.

1–2) Synthesis of FS-1

42.8 g (69 millimoles) of di(3,3,4,4,5,5,6,6,6-nonafluorohexyl)maleate, 7.9 g (76 millimoles) of sodium hydrogensulfite, and 50 mL of water with ethanol (1/1:v/v) were heated and refluxed for 3 hours. This mixture was cooled to 0° C., deposited solid was filtrated, then recrystallized with acetonitrile. Resulting crystals were dried under reduced pressure at 60° C. to obtain 27.0 g (54% yield) of compound as white crystals.

$^1$H-NMR data for the obtained compound is as follows:

$^1$H-NMR (DMSO-d$^6$) δ2.49–2.62 (m, 4H), 2.85–2.99 (m, 2H), 3.68 (dd, 1H), 4.23–4.35 (m,4H).

Synthesis Example 2

Synthesis of Exemplary Compound FS-2 2–1) Synthesis of Di(3,3,4,4,5,5,6,6,7,7,8,8,8-tridecafluorooctyl)Maleate 4.61 g (47 millimoles) of maleic anhydride, 34.1 g (98 millimoles) of 3,3,4,4,5,5,6,6,7,7,8,8,8-tridecafluorooctyl alcohol, and 0.24 g of p-toluenesulfonic acid monohydrate were heated and refluxed in 140 mL of toluene for 10 hours, while distilling water which was generated therein. Then, the mixture was cooled to room temperature, to this ethyl acetate was added, and an organic phase was washed with a saturated sodium chloride aqueous solution and dried with magnesium sulfate. After distilling the solvent under reduced pressure, resulting mixture was purified by a silica gel column chromatography (hexane/ethyl acetate: 8/2, v/v) to obtain 19.7 g (52% yield) of the material as white solid.

2-2) Synthesis of FS-2

10.0 g (12.4 millimoles) of di(3,3,4,4,5,5,6,6,7,7,8,8,8-tridecafluorooctyl) maleate, 1.55 g (14.9 millimoles) of sodium hydrogensulfite, and 15 mL of water with ethanol (1/1:v/v) were heated and refluxed for 7 hours, then cooled to room temperature. Resulting crystals were dried under reduced pressure at 60° C., to obtain 9.38 g (81% yield) of the object compound as a white solid,.

$^1$H-NMR data for the obtained compound is as follows:

$^1$H-NMR (DMSO-d$_6$) δ2.48 (m, 4H), 2.97 (m, 2H), 3.82 (m, 1H), 4.18–4.58 (m, 4H).

Synthesis Example 3

Synthesis of Exemplary Compound FS-4

3-1) Synthesis of Di(3,3,4,4,5,5,6,6,7,7,7-nonafluoroheptyl) Maleate 17.6 g (0.18 millimoles) of maleic anhydride, 100 g (0.36 millimoles) of 4,4,5,5,6,6,7,7,7-nonafluoroheptyl), and 0.5 g of p-toluenesulfonic acid monohydrate were heated and refluxed in 250 mL of toluene for 12 hours, while distilling off water which was generated therein. Then, the mixture was cooled to room temperature, to this chloroform was added, and an organic phase was washed with 1 mol/L of sodium hydroxide aqueous solution and saturated sodium chloride aqueous solution to quantitatively obtain 114.1 g of compound as white solid.

3-2) Synthesis of FS-4

95.8 g (156 millimoles) of di(4,4,5,5,6,6,7,7,7-nonafluoroheptyl)maleate, 7.9 g (172 millimoles) of sodium hydrogensulfite, and 100 mL of water with ethanol (1/1:v/v) were heated and refluxed for 20 hours. Then, to this ethyl acetate was added, and an organic phase was washed with saturated sodium chloride aqueous solution. After an organic layer was dried with sodium sulfate, and the solvent was concentrated under reduced pressure, resulting mixture was recrystallized with acetonitrile. These crystals were dried at reduced pressure at 60° C. to obtain 95.8 g (83% yield) of compound as white crystals.

$^1$H-NMR data for the obtained compound is as follows:

$^1$H-NMR (DMSO-d$_6$) δ1.80 (m, 4H), 2.19–2.34 (m, 4H), 2.79–2.97 (m, 2H), 3.68 (dd, 1H), 4.01–4.29 (m, 4H).

Synthesis Example 4

Synthesis of Exemplary Compound FS-19

4-1) Synthesis of Di(3,3,4,4,5,5,6,6,6-nonafluorohexyl) Itaconate 13.5 g (0.12 moles) of itaconic anhydride, 69.8 g (0.26 moles) of 3,3,4,4,5,5,6,6,6-nonafluorohexanol, and 1.14 g (6 millimoles) of p-toluene sulfonic acid first hydrate were heated and refluxed in 500 mL of toluene for 12 hours, while distilling off water which was generated therein. Then, the mixture was cooled to room temperature, to this ethyl acetate was added, and an organic phase was washed with 1 mol/L of sodium hydroxide aqueous solution and saturated sodium chloride aqueous solution to obtain 51.3 g (69% yield) of compound as oil-state compound.

4–2) Synthesis of FS-19

20.0 g (32 millimoles) of di(3,3,4,4,5,5,6,6,6-nonafluorohexyl) itaconate, 4.0 g (38 millimoles) of sodium hydrogensulfite, and 25 mL of water and ethanol (1/1:v/v) were heated and refluxed for 6 hours. Then, to this ethyl acetate was added, an organic phase was washed with saturated sodium chloride aqueous solution, and an organic layer was dried with sodium sulfate. After the solvent was concentrated under reduced pressure, the mixture was recrystallized with acetonitrile. These crystals were dried under reduced pressure for 2 hours at 80° C. to obtain 20.6 g (89% yield) of compound as white crystals.

$^1$H-NMR data for the obtained compound is as follows:

$^1$H-NMR (DMSO-d$_6$) δ2.49–2.78 (m, 5H), 3.04–3.13 (m,2H), 3.47 (br, 2H), 4.23 (t,4H).

In the present invention, when the aforementioned surface active agent is used in the layer of the photographic photosensitive material, an aqueous coating composition which includes the surface active agent may be formed from only the surface active agent of the present invention and water. Depending on the purpose, it may comprise other appropriate components.

In the aforementioned aqueous coating composition, one surface active agent according to the present invention may be used alone, or two or more types may be mixed. Moreover, a surface active agent other than the surface active agent of the present invention may be used with the surface active agent of the present invention. Examples of the surface active agents which can be used with the agents of the present invention include respective types of anion-based, cation-based, and nonion-based surface active agents. High polymer surface active agents and fluorine-based surface active agents other than the surface active agents of the present invention also may be used. Among these examples, anion-based and nonion-based surface active agents are more preferable. Examples of the surface active agents, which can be used with the agents of the present invention are disclosed in JP-A 62-215,272 (pp. 649–706), Research Disclosure (RD) Item 17643, pp. 26–27 (December 1978), RD Item 18716 p. 650 (November 1979), RD Item 307105, pp. 875–876 (November 1989), and the like.

Representative components, which may be included in the aforementioned aqueous coating composition, arc polymer compounds. The polymer compound may be a polymer, which is soluble in a water-based medium, or a water-dispersion of a polymer (so-called polymer latex). Examples of the soluble polymer are not particularly limited, and include gelatins, polyvinyl alcohol, casein, agars, gum arabic, hydroxyethyl cellulose, methyl cellulose, and carboxymethyl cellulose. Examples of the polymer latex include homopolymers or copolymers of various vinyl monomers (for example, acrylate derivatives, methacrylate derivatives, acrylate amide derivatives, methacrylate amide derivatives, styrene derivatives, conjugate diene derivatives, N-vinyl compounds, o-vinyl compounds, vinylnitriles, and other vinyl compounds (for example, ethylenes, vinylidene chlorides)) and dispersions (for example, polyesters, polyurethanes, polycarbonates, and polyamides) of condensation polymers. Detailed examples of these types of polymers can be found in, for example, JP-A 62-215272 (pp. 707–763), RD Item 17643, p. 651 (December 1978), RD Item 18716 p. 650 (November 1979), RD Item 307105, pp. 873–874 (November 1989), and the like.

As the medium in the aforementioned aqueous coating composition, water may be used alone, or a mixed solvent of water and an organic medium (for example, methanol, ethanol, isopropyl alcohol, n-butanol, methyl cellosolve, dimethylformamide, acetone, and the like) may be used. A ratio of water in the aqueous coating medium is preferably at least 50% by weight or more.

In the aforementioned aqueous coating composition, various compounds may be included in accordance with the layer of the photographic photosensitive material. Moreover, these compounds may be dissolved in a medium, or may be dispersed. Examples of these compounds include various couplers, UV absorbents, color-mixing inhibitors, static inhibitors, scavengers, fogging inhibitors, hardeners, dyes, and antimold agent and the like. Moreover, the aqueous coating composition is preferable to use in a top layer of a hydrophilic colloid layer in order to obtain antistatic properties and coating evenness in the photographic photosensitive material.

In this case, the coating composition of the layer may include hydrophilic colloids (for example, gelatins), surface active agents other than the boron-based surface active agents of the invention, matting agents, sliding agents, colloidal silicas, gelatin plasticizers, and the like.

There is no particular limitation in an amount of surface active agent used of general formulae (FS), (FS-a), (FS-b). Moreover, the amount used can be changed as desired by the structure or use of the surface active agent, the type or amount of the compound included in the aqueous coating composition, the structure of the medium, and the like. For example, when the surface active agent of the invention is used as a coating liquid for the hydrophilic colloid (gelatin) layer on the uppermost layer of the photographic photosensitive material, which is a preferable embodiment of the invention, concentration of the surface active agent (% by weight) in the coating solution is preferably 0.003 to 0.5%, and 0.03 to 5% relative to gelatin solid components.

The photosensitive material of the invention also preferably has at least one non-photosensitive hydrophilic colloid layer having an anti-halation function.

The non-photosensitive hydrophilic colloid layer having an anti-halation function contains a halation preventing dye. The dye used for preventing halation may be any dye that is effective for preventing halation. The dye may be either a water soluble dye or a solid fine particle dispersion of a dye, and a solid fine particle dispersion of a dye is preferable from the standpoint of the effect of the invention.

The substituents referred in the invention will be described in detail below.

The term "fatty series" or "aliphatic" referred herein may be either linear, branched or cyclic, and may be ether saturated or unsaturated. Examples thereof include alkyl, alkenyl, alkynyl, cycloalkyl and cycloalkenyl, which may further have a substituent. The term aromatic herein means aryl, which may further have a substituent. The term heterocyclic herein has a heterogeneous atom in a ring, which includes those having aromatic nature, and may further have a substituent. The substituent substituted on the substituent in the invention including aliphatic, aromatic and heterocyclic ones may be any group that can be substituted as far as there is no definition, and examples thereof include an aliphatic group, an aromatic group, a heterocyclic group, an acyl group, an acyloxy group, an acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfamoyl group, an aromatic sulfamoyl group, an aliphatic sulfonamide group, an aromatic sulfonamide group, an aliphatic amino group, an aromatic amino group, an aliphatic sulfinyl group, an aromatic sulfinyl group, an aliphatic thio group, an aromatic thio group, a mercapto group, a hydroxyl group, a cyano group, a nitro group, a hydroxyamino group and a halogen atom.

The silver halide color photographic photosensitive material of the invention preferably contains a compound represented by the following general formula (I):

$$D—(X)_y \qquad (I)$$

In the general formula (I), D represents a residual group of a compound having a chromophoric group; X represents a dissociative hydrogen atom or a group having a dissociative hydrogen atom; and y represents an integer of from 1 to 7.

The dye represented by the general formula (I) will be described.

In the general formula (I), D represents a residual group of a compound having a chromophoric group; X represents a dissociative hydrogen atom or a group having a dissociative hydrogen atom; and y represents an integer of from 1 to 7. The dye represented by the general formula (I), which is preferably used in the invention, has such a characteristic feature that a dissociative hydrogen atom is contained in the molecular structure.

The residual group of a compound having a chromophoric group represented by D can be selected from numerous colorants that have been known.

Examples of the compound include an oxonol dye, a merocyanine dye, a cyanine dye, an arylidene dye, an azomethine dye, a triphenylmethane dye, an azo dye, an anthraquinone dye and an indoaniline dye.

X represents a dissociative hydrogen atom or a group having a dissociative hydrogen atom that is connected to D directly or through a divalent linking group.

Examples of the divalent linking group present between X and D include an alkylene group, an arylene group, a heterocyclic residual group, —CO—, —$SO_n$— (wherein n is 0, 1 or 2), —NR— (wherein R represents a hydrogen atom, an alkyl group or an aryl group), —O— and a divalent group obtained by combining these groups, and these groups may further have a substituent, such as an allyl group, an aryl group, an alkoxy group, an amino group, an acylamino group, a halogen atom, a hydroxyl group, a carboxyl group, a sulfamoyl group, a carbamoyl group and a sulfonamide group. Preferable examples thereof include —$(CH_2)_n$— (wherein n is 1, 2 or 3), —$CH_2CH(CH_3)CH_2$—, 1,2-phenylene, 5-carboxy-1,3-phenylene, 1,4-phenylene, 6-methoxy-1,3-phenylene and —$CONHC_6H_4$—.

The dissociative hydrogen atom or the group having a dissociative hydrogen atom represented by X is non-dissociative state when the dye represented by the general formula (I) is added to the silver halide photographic photosensitive material of the invention, and has such a function in which the dye of the general formula (I) is made substantially water insoluble. In the process step where the photosensitive material is subjected to development, the dissociative hydrogen atom or the group having a dissociative hydrogen atom is dissociated, whereby the compound of the general formula (I) is made substantially water soluble. Examples of the group having a dissociative hydrogen atom represented by X include groups having a carboxyl group, a sulfonamide group, a sulfamoyl group, a sulfonylcarbamoyl group, an acylsulfamoyl group and a phenolic hydroxyl group. Examples of the dissociative hydrogen atom represented by X include a hydrogen atom of an enol group of an oxonol dye.

y preferably represents an integer of from 1 to 5, and particularly preferably from 1 to 3.

In a preferable example of the compound represented by the general formula (I), the group having a dissociative hydrogen atom represented by X is a group having a carboxyl group, and particularly, a compound having an aryl group substituted by a carboxyl group is preferable.

In the compound represented by the general formula (I), compounds represented by the following general formula (II) or (III) are preferable.

$$A^1{=}L^1{-}(L^2{=}L^3)_m{-}Q \quad \text{(II)}$$

In the general formula (II), $A^1$ represents an acidic nucleus, Q represents an aryl group or a heterocyclic group, $L^1$, $L^2$ and $L^3$ each represents a methine group, and m represents 0, 1 or 2. The compound of the general formula (II) has, as water soluble groups inside the molecule, from 1 to 7 groups selected from the group consisting of a carboxyl group, a sulfonamide group, a sulfamoyl group, a sulfonylcarbamoyl group, an acylsulfamoyl group, a phenolic hydroxyl group and an enol group of an oxonol dye.

$$A^1{=}L^1{-}(L^2{=}L^3)_n{-}A^2 \quad \text{(III)}$$

In the general formula (III), $A^1$ and $A^2$ each represents an acidic nucleus, $L^1$, $L^2$ and $L^3$ each represents a methine group, and n represents 0, 1, 2 or 3. The compound of the general formula (III) has, as water soluble groups inside the molecule, from 1 to 7 groups selected from the group consisting of a carboxyl group, a sulfonamide group, a sulfamoyl group, a sulfonylcarbamoyl group, an acylsulfamoyl group, a phenolic hydroxyl group and an enol group of an oxonol dye.

The compounds represented by the general formulae (II) and (III) will be described in detail below.

The acid nucleus represented by $A^1$ and $A^2$ is preferably that derived from a cyclic ketomethylene compound or a compound having a methylene group interposed between electron acceptive groups. Examples of the cyclic ketomethylene compound include 2-pyrazolin-5-one, rhodanine, hydantoin, thiohydantoin, 2,4-oxazolidindione, isooxazolone, barbituric acid, thiobarbituric acid, indandione, dioxopyrazolopyridine, hydorxypyridine, pyrazolidindione and 2,5-dihydrofuran. These compounds may have a substituent.

The compound having a methylene group interposed between electron acceptive groups can be represented by the formula $Z^1CH_2Z^2$, wherein $Z^1$ and $Z^2$ each represents —CN, $-SO_2R^{11}$, $-COR^{11}$, $-COOR^{12}$, $-CONHR^{12}$, $-SO_2NHR^{12}$ or $-C(=C(CN)_2)R^{11}$, $R^{11}$ represents an alkyl group, an aryl group or a heterocyclic group, and $R^{12}$ represents a hydrogen atom or the groups represented by $R^{11}$. These compounds may have a substituent.

Examples of the aryl group represented by Q include a phenyl group and a naphthyl group, which may have a substituent. Examples of the heterocyclic group represented by Q include pyrrole, indole, furan, thiophene, imidazole, pyrazole, indolidine, quinoline, carbazole, phenothiazine, phenoxazine, indoline, thazole, pyridine, pyridazine, thiadiazine, pyran, thiopyran, oxodiazole, benzoquinoline, thiadiazole, pyrrolothiazole, pyrrolopyridazine, tetrazole, oxazole, coumarin and coumarone. These groups may have a substituent.

The methine group represented by $L^1$, $L^2$ or $L^3$ may have a substituent, and a 5-membered or 6-membered ring (for example, cyclopentene and cyclohexene) may be formed by connecting the substituents.

The substituents that may be included in the groups are not particularly limited as far as they are not a substituent that makes the compounds of general formulae (I) to (III) to be substantially solubilized in water of pH 5 to 7.

Examples thereof include a carboxyl group, a sulfonamide group having from 1 to 10 carbon atoms (such as methanesulfonamide, benzenesulfonamide, butanesulfonamide and n-octanesulfonamide), an unsubstituted or alkyl- or aryl-substituted sulfamoyl group having 0 to 10 carbon atoms (such as unsubstituted sulfamoyl, methylsulfamoyl, phenylsulfamoyl, naphthylsulfamoyl and butylsulfamoyl), a sulfonylcarbamoyl group having from 2 to 10 carbon atoms (such as methanesulfonylcarbamoyl, propanesulfonylcarbamoyl and benzenesulfonylcarbamoyl), an acylsulfamoyl group having from 1 to 10 carbon atoms (such as acetylsulfamoyl, propyonylsulfamoyl, pivaloylsulfamoyl and benzoylsulfamoyl), a linear or cyclic alkyl group having from 1 to 8 carbon atoms (such as methyl, ethyl, isopropyl, butyl, hexyl, cyclopropyl, cyclopentyl, cyclohexyl, 2-hydroxyethyl, 4-carboxybutyl, 2-methoxyethyl, benzyl, phenethyl, 4-carboxybenzyl and 2-diethylamonoethyl), an alkenyl group having from 2 to 8 carbon atoms (such as vinyl and allyl), an alkoxy group having from 1 to 8 carbon atoms (such as methoxy, ethoxy and butoxy), a halogen atom (such as F, Cl and Br), an amino group having from 0 to 10 carbon atoms (such as unsubstituted amino, dimethylamino, diethylamino and carboxyethylamino), an ester group having from 2 to 10 carbon atoms (such as methoxycarbonyl), an amide group having from 1 to 10 carbon atoms (such as acetylamino and benzamide), a carbamoyl group having from 1 to 10 carbon atoms (such as unsubstituted carbamoyl, methylcarbamoyl and ethylcarbamoyl), an aryl group having from 6 to 10 carbon atoms (such as phenyl, naphthyl, hydroxyphenyl, 4-carboxyphenyl, 3-carboxyphenyl, 3,5-dicarboxyphenyl, 4-methanesulfonylamidephenyl and 4-butanesulfonamidephenyl), an aryloxy group having from 6 to 10 carbon atoms (such as phenoxy, 4-carboxyphenoxy, 3-methylphenoxy and naphthoxy), an alkylthio group having from 1 to 8 carbon atoms (such as methylthio, ethylthio and octylthio), an arylthio group having from 6 to 10 carbon atoms (such as phenylthio and naphthylthio), an acyl group having from 1 to 10 carbon atoms (such as acetyl, benzoyl and propanoyl), a sulfonyl group having from 1 to 10 carbon atoms (such as methanesulfonyl and benzenesulfonyl), a ureido group having from 1 to 10 carbon atoms (such as ureido and methylureido), a urethane group having from 2 to 10 carbon atoms (such as methoxycarbonylamino and ethoxycarbonylamino), a cyano group, a hydroxyl group, a nitro group, and a heterocyclic group (such as a 5-carboxybenzooxazole ring, a pyridine ring, a sulfolane ring, a pyrrole ring, a pyrrolidine ring, a morpholine ring, a piperazine ring, a pyrimidine ring and a furan ring).

Preferable examples of the compound represented by the general formula (III) include a compound represented by the following general formula (IV). The compound represented by the general formula (IV) has a hydrogen atom of an enol group as a dissociative hydrogen atom.

General formula (IV)

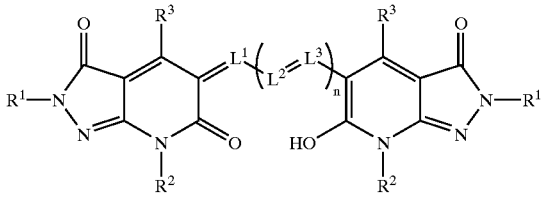

In the general formula (IV), $R^1$ represents a hydrogen atom, an alkyl group, an aryl group or a heterocyclic group; $R^2$ represents a hydrogen atom, an alkyl group, an aryl group, a heterocyclic group, —$COR^4$ or —$SO_2R^4$; $R^3$ represents a hydrogen atom, a cyano group, a hydroxyl group, a carboxyl group, an alkyl group, an aryl group, —$CO_2R^4$, —$OR^4$, —$NR^5R^6$, —$CONR^5R^6$, —$NR^5COR^4$, —$NR^5SO_2R^4$ or —$NR^5CONR^5R^6$, $R^4$ represents an alkyl group or an aryl group; $R^5$ and $R^6$ each represents a hydrogen atom, an alkyl group or an aryl group; $L^1$, $L^2$ and $L^3$ each represents a methine group; and n represents 1 or 2.

In the general formula (IV), examples of the alkyl group represented by $R^1$ include an alkyl group having from 1 to 4 carbon atoms, a 2-cyanoethyl group, a 2-hydroxyethyl group and a carboxybenzyl group, examples of the aryl group include a phenyl group, a 2-methylphenyl group, a 2-carboxyphenyl group, a 3-carboxyphenyl group, a 4-carboxyphenyl group, a 3,6-dicarboxyphenyl group, a 2-hydroxyphenyl group, a 3-hydroxyphenyl group, a 4-hydroxyphenyl group, a 2-chloro-4-carboxyphenyl group and 4-methylsulfamoylphenyl group, and examples of the heterocyclic group include a 5-carboxybenzooxazol-2-yl group.

Examples of the alkyl group represented by $R^2$ include an alkyl group having from 1 to 4 carbon atoms, a carboxymethyl group, a 2-hydroxyethyl group and a 2-methoxyethyl group, examples of the aryl group include a 2-carboxyphenyl group, a 3-carboxyphenyl group, a 4-carboxyphenyl group and a 3,6-dicarboxyphenyl group, examples of the heterocyclic group include a pyridyl group, examples of the group —$COR^4$ include an acetyl group, and examples of the group —$SO_2R^4$ include a methanesulfonyl group.

Examples of the alkyl group represented by $R^3$, $R^4$, $R^5$ and $R^6$ include an alkyl group having from 1 to 4 carbon atoms. Examples of the aryl group represented by $R^3$, $R^4$, $R^5$ and $R^6$ include a phenyl group and a methylphenyl group.

In the invention, it is preferable that $R^1$ represents a carboxyl group-substituted phenyl group (such as 2-carboxyphenyl, 3-carboxyphenyl, 4-carboxyphenyl and 3,6-dicarboxyphenyl).

Specific examples of the compounds represented by the general formulae (I) to (IV) that can be preferably used in the invention will be described below, but the invention is not limited thereto.

(I-1)

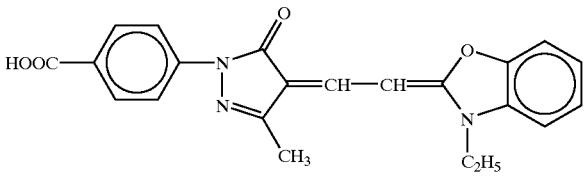

(I-2)

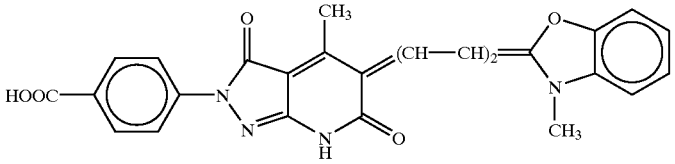

(I-3)

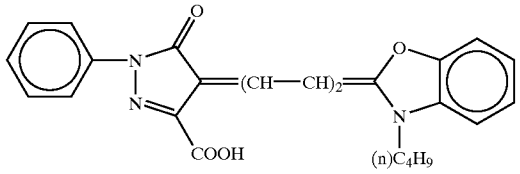

(I-4)

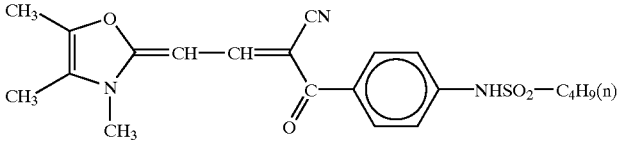

-continued
(I-5)
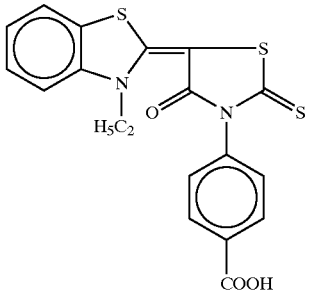
(I-6)
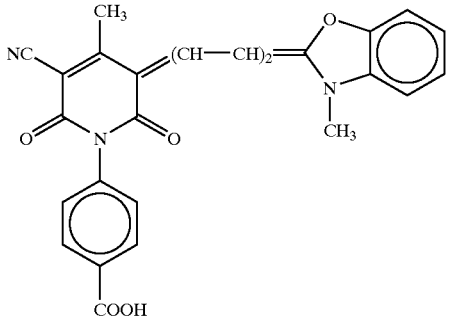
(I-7)
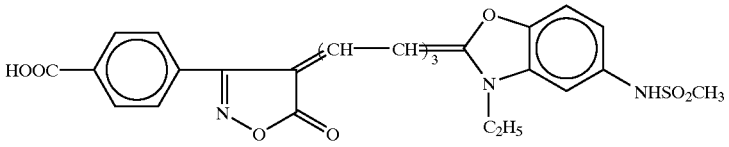
(I-8)
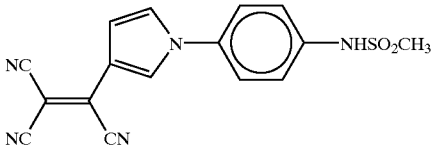
(I-9)
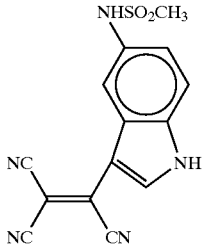
(I-10)
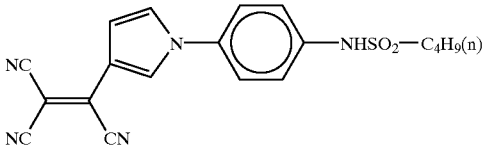
(I-11)
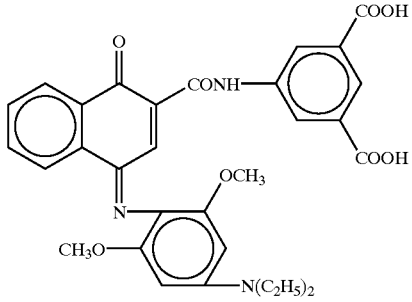
(I-12)
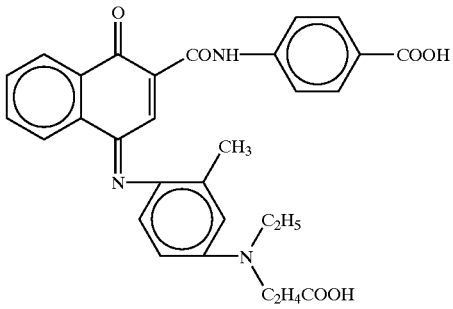
(I-13)
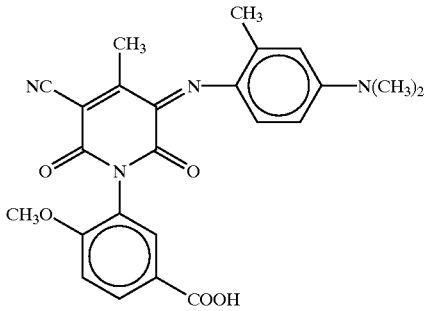

-continued
(I-14)
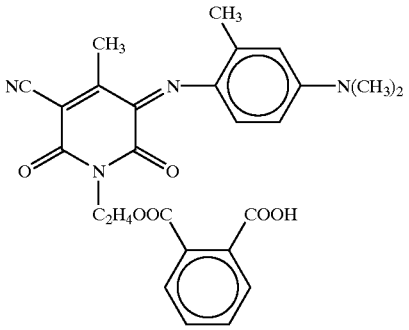
(II-1)
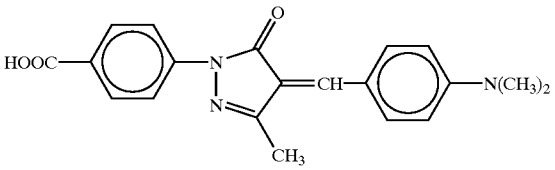
(II-2)
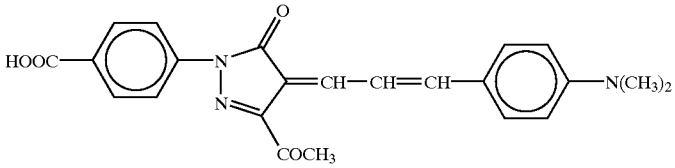
(II-3)
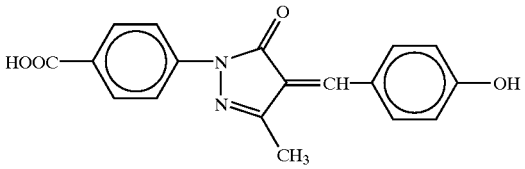
(II-4)
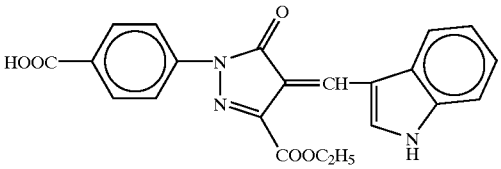
(II-5)
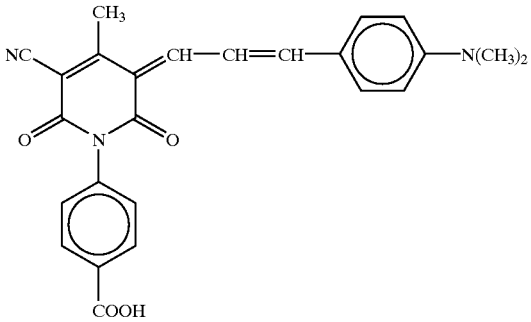
(II-6)
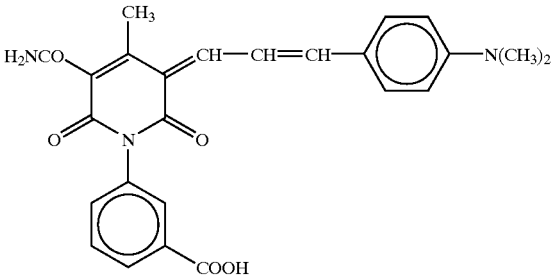
(II-7)
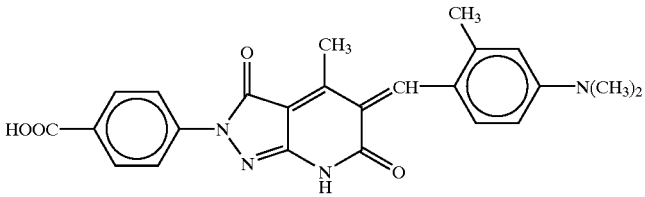
(II-8)
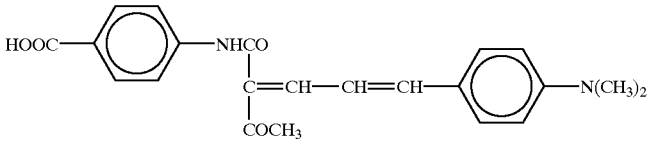
(II-9)
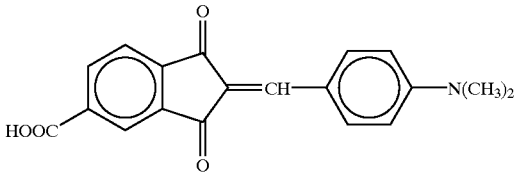

-continued
(II-10)
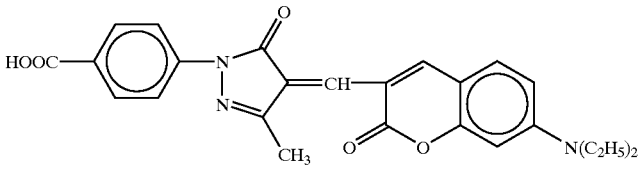
(II-11)
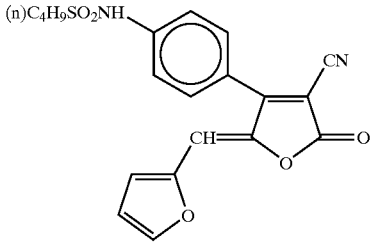
(II-12)
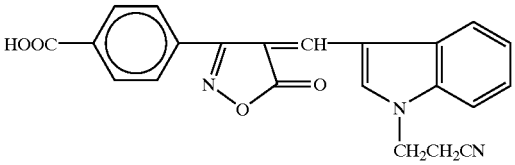
(II-13)
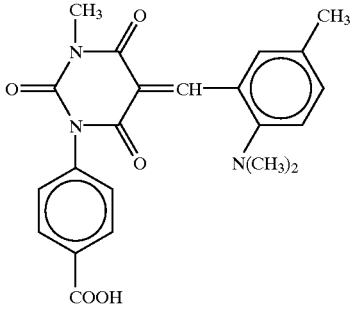
(II-14)
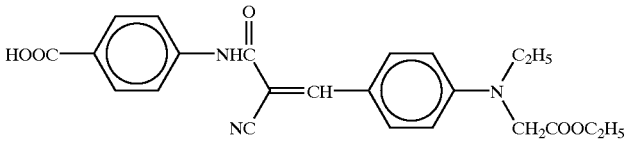
(II-15)
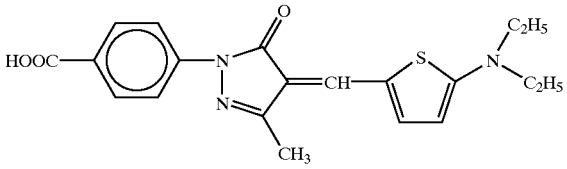
(II-16)
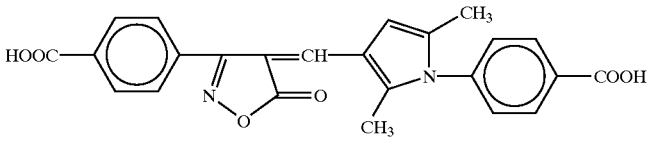
(II-17)
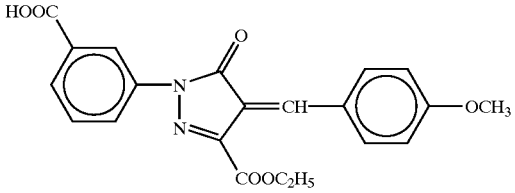
(II-18)
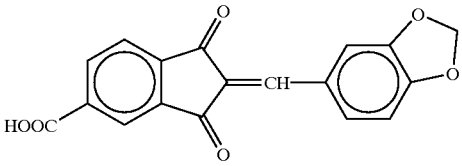

-continued
(II-19)
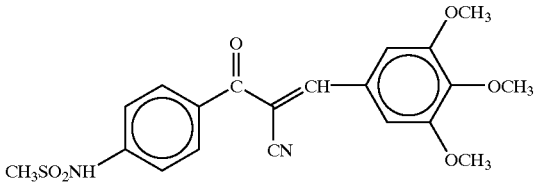
(II-20)
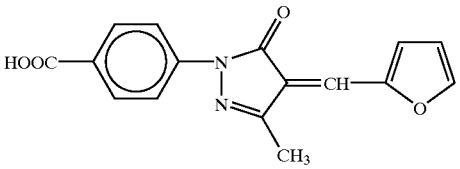
(II-21)
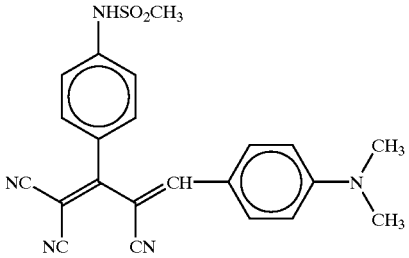
(II-22)
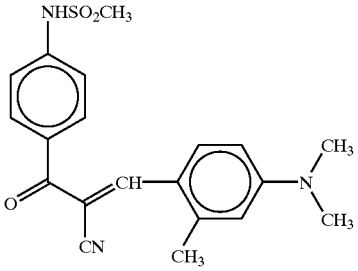
(II-23)
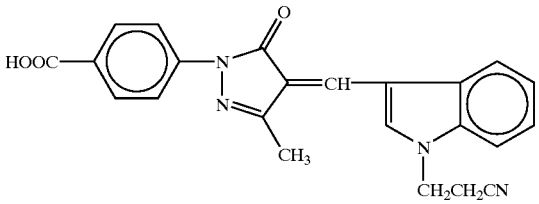
(II-24)
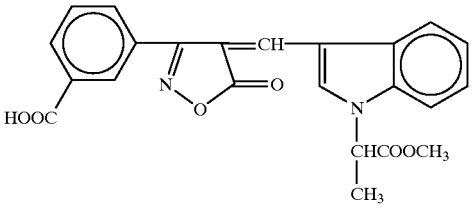
(II-25)
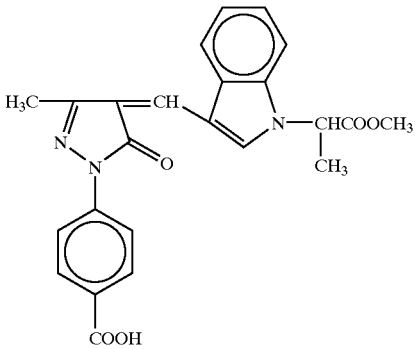
(III-1)
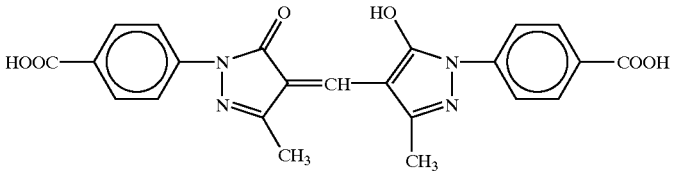
(III-2)
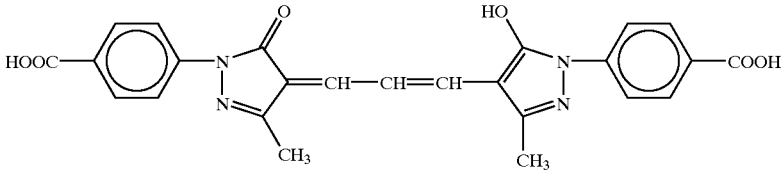
(III-3)
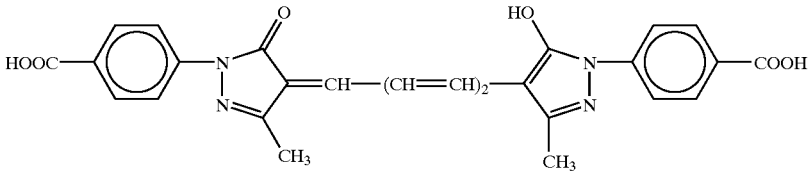

-continued
(III-4)
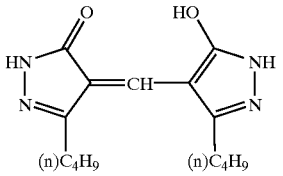
(III-5)
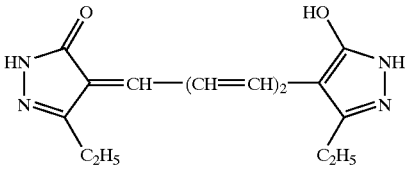
(III-6)
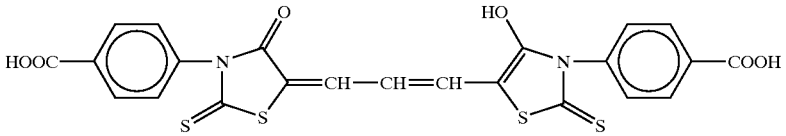
(III-7)
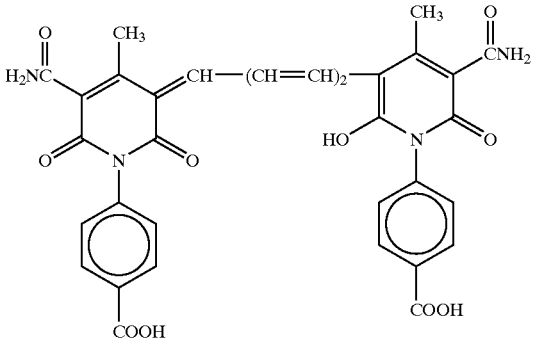
(III-8)
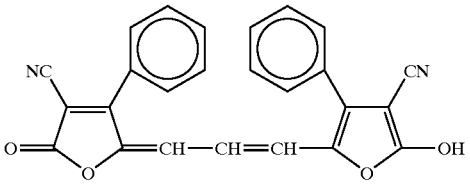
(III-9)
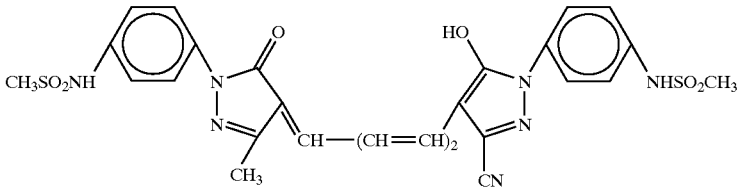
(III-10)
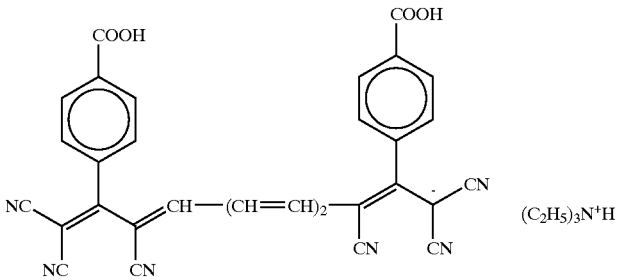
(III-11)
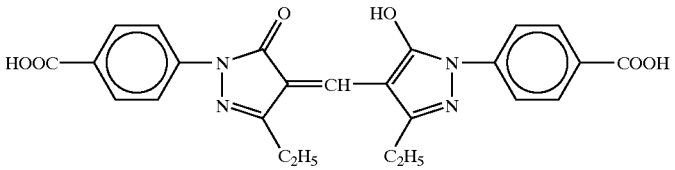
(III-12)
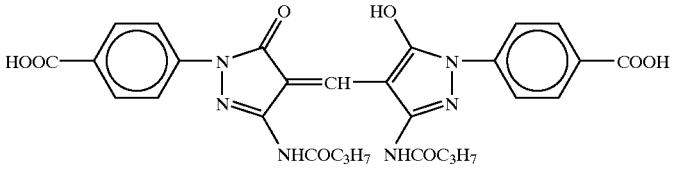

-continued
(III-13)
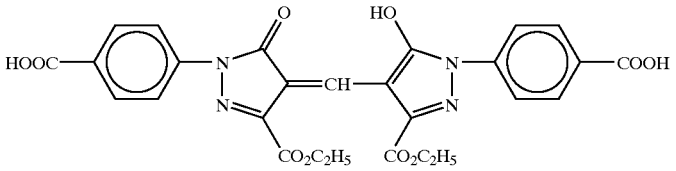
(III-14)
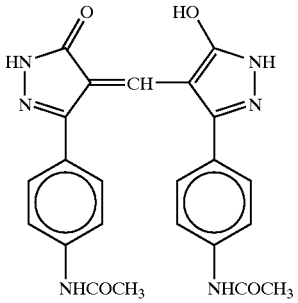
(III-15)
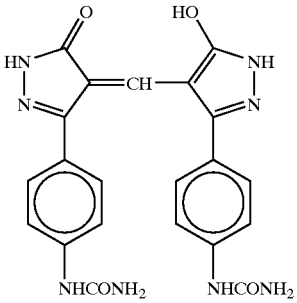
(III-16)
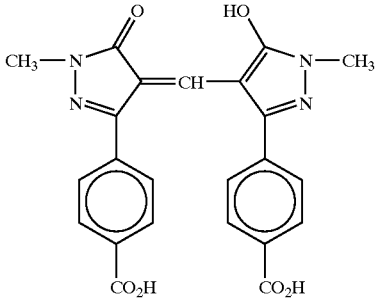
(III-17)
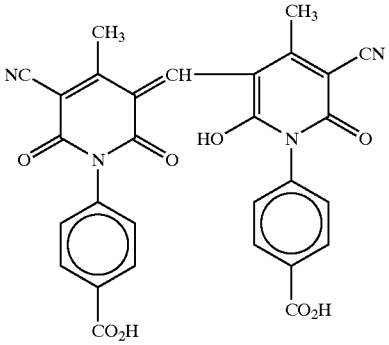
(III-18)
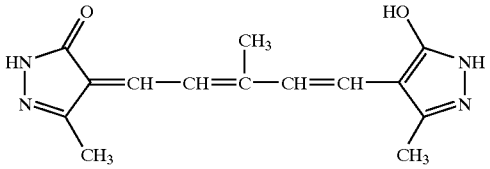
(III-19)
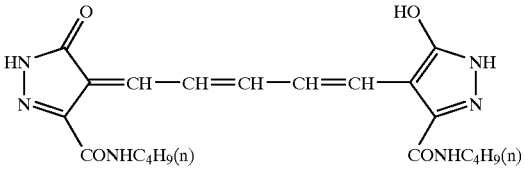
(III-20)
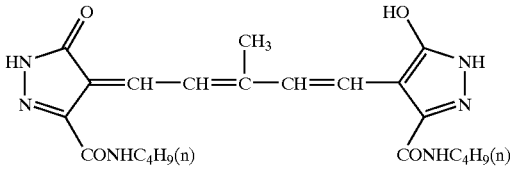
(III-21)
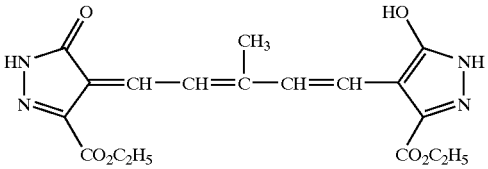
(III-22)
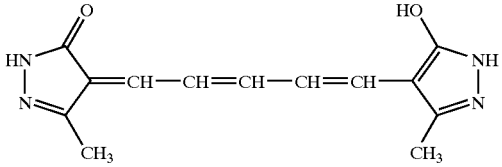
(III-23)
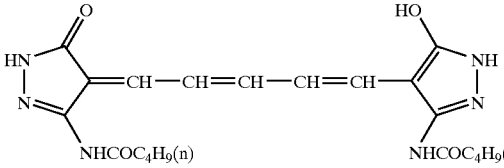
(III-24)
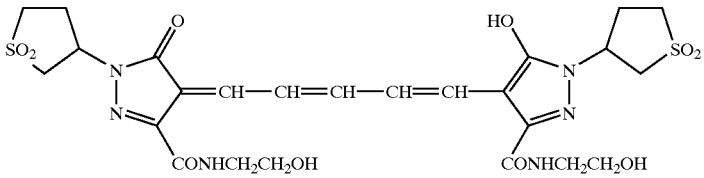

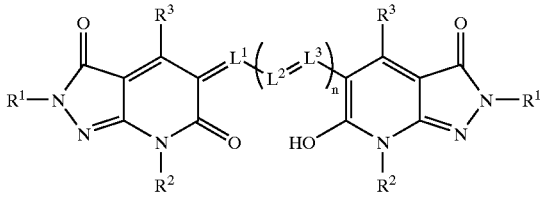
| | $R^1$ | $R^2$ | $R^3$ | $=L^1-(L^2=L^3)_n-$ |
|---|---|---|---|---|
| IV-1 | 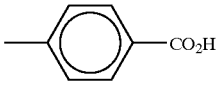 | —H | $-CH_3$ | =CH—CH=CH— |
| IV-2 | 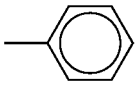 | —H | $-CH_3$ | =CH—CH=CH— |
| IV-3 | $-CH_3$ | —H | $-CH_3$ | =CH—CH=CH— |
| IV-4 | 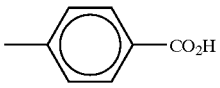 | $-CH_3$ | $-CH_3$ | =CH—CH=CH— |
| IV-5 | 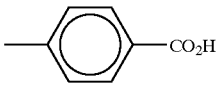 | 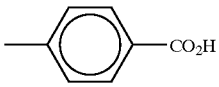 | $-CH_3$ | =CH—CH=CH— |
| IV-6 | 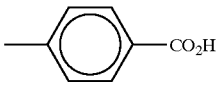 | $-CH_3$ | $-CO_2C_2H_5$ | =CH—CH=CH— |
| IV-7 | 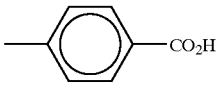 | $-CH_3$ | $-CO_2H$ | =CH—CH=CH— |
| IV-8 | $-CH_3$ | 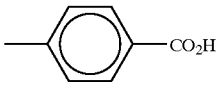 | $-CH_3$ | =CH—CH=CH— |
| IV-9 | $-CH_3$ | 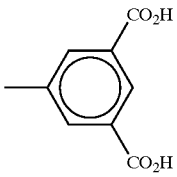 | $-CH_3$ | =CH—CH=CH— |
| IV-10 | $-CH_3$ | $-CH_3$ | $-CH_3$ | =CH—CH=CH— |
| IV-11 | 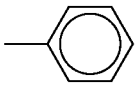 | 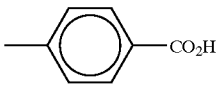 | $-CH_3$ | =CH—CH=CH— |
| IV-12 | 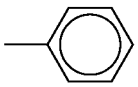 | 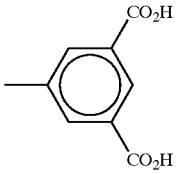 | $-CH_3$ | =CH—CH=CH— |

-continued
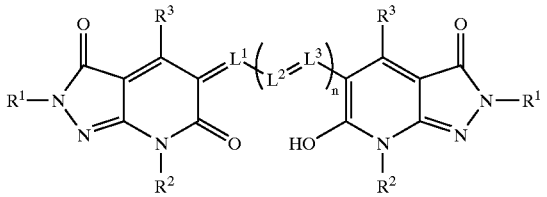
| | $R^1$ | $R^2$ | $R^3$ | $=L^1-(L^2=L^3)_n-$ |
|---|---|---|---|---|
| IV-13 | 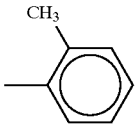 | 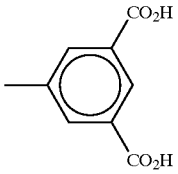 | $-CH_3$ | $=CH-CH=CH-$ |
| IV-14 | 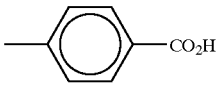 | $-H$ | $-CH_3$ | 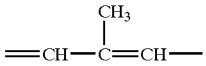 |
| IV-15 | 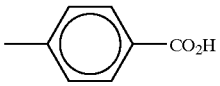 | $-H$ | $-CO_2C_2H_5$ | $=CH-CH=CH-$ |
| IV-16 | 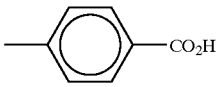 | $-H$ | $-CO_2H$ | $=CH-CH=CH-$ |
| IV-17 | 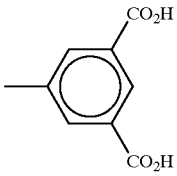 | $-H$ | $-CH_3$ | $=CH-CH=CH-$ |
| IV-18 | 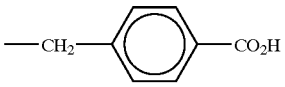 | $-H$ | $-CH_3$ | 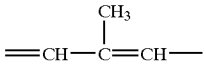 |
| IV-19 | 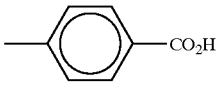 | $-CH_2CH_2OH$ | $-H$ | $=CH-CH=CH-$ |
| IV-20 | 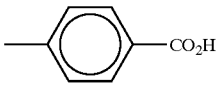 | $-CH_2CO_2H$ | $-CH_3$ | 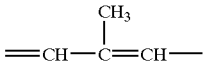 |
| IV-21 | 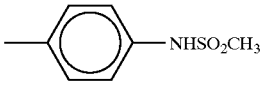 | $-H$ | $-CH_3$ | $=CH-CH=CH-$ |
| IV-22 | 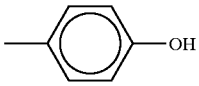 | $-H$ | $-CH_3$ | $=CH-CH=CH-$ |
| IV-23 | $-CH_2CH_2OH$ | $-H$ | $-CH_3$ | $=CH-CH=CH-$ |
| IV-24 | $-CH_3$ | $-CH_2CH_2OH$ | $-CH_3$ | $=CH-CH=CH-$ |
| IV-25 | $-H$ | 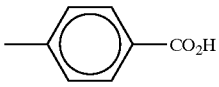 | $-CH_3$ | $=CH-CH=CH-$ |

-continued
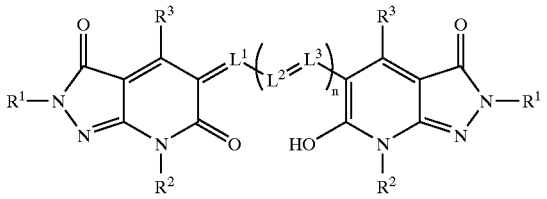
| | $R^1$ | $R^2$ | $R^3$ | $=L^1-(L^2=L^3)_n-$ |
|---|---|---|---|---|
| IV-26 | —H | —H | $-CO_2H$ | =CH—CH=CH— |
| IV-27 | 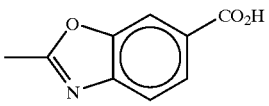 | —H | $-C_2H_5$ | =CH—CH=CH— |
| IV-28 | 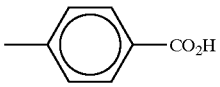 | $-SO_2CH_3$ | $-CO_2CH_3$ | 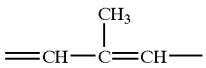 |
| IV-29 | 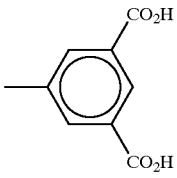 | $-COCH_3$ | $-CH_3$ | =CH—CH=CH— |
| IV-30 | —H | 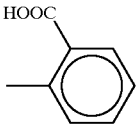 | $-CH_3$ | =CH—CH=CH— |
| IV-31 | 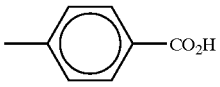 | 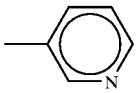 | $-CH_3$ | 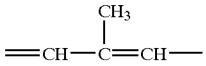 |
| IV-32 | 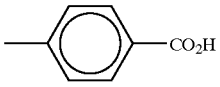 | $-CH_3$ | —CN | =CH—CH=CH— |
| IV-33 | 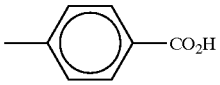 | —H | —H | =CH—CH=CH— |
| IV-34 | 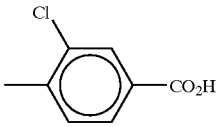 | —H | $-OC_2H_5$ | =CH—CH=CH— |
| IV-35 | 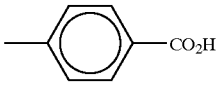 | —H | $(n)C_4H_9-$ | =CH—CH=CH— |
| IV-36 | 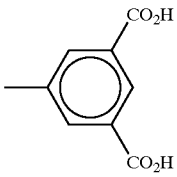 | $-CH_3$ | $-NHCH_3$ | =CH—CH=CH— |

-continued
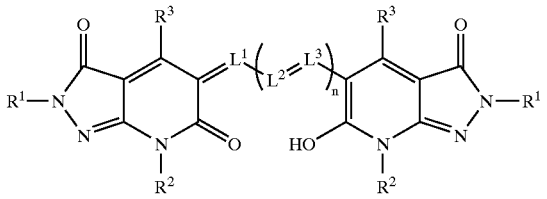
| | $R^1$ | $R^2$ | $R^3$ | $=L^1-(L^2=L^3)_n-$ |
|---|---|---|---|---|
| IV-37 | 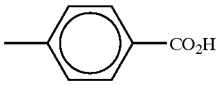 | $-COCH_3$ | $-NHCOCH_3$ | $=CH-CH=CH-$ |
| IV-38 | 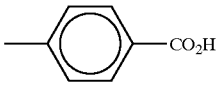 | $-CO_2CH_3$ | $-NHSO_2CH_3$ | $=CH-CH=CH-$ |
| IV-39 | 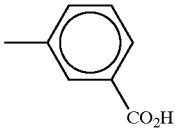 | $-CH_2CH_2OH$ | $-CH_3$ | $=CH-CH=CH-$ |
| IV-40 | $-CH_2CH_2CN$ | $-H$ | $-CH_3$ | $=CH-CH=CH-$ |
| IV-41 | 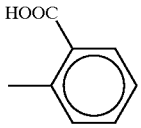 | $-H$ | $-CH_3$ | $=CH-CH=CH-$ |
| IV-42 | 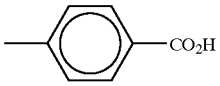 | $-H$ | $-C_2H_5$ | $=CH-CH=CH-$ |
| IV-43 | 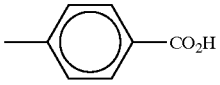 | $-CH_2CH_2OCH_3$ | $-CH_3$ | 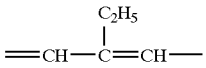 |
| IV-44 | 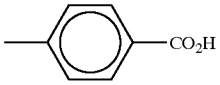 | $-H$ | $-CH_3$ | 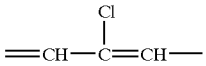 |
| IV-45 | 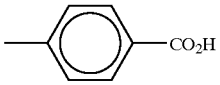 | $-H$ | $-CO_2H$ | 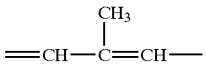 |
| IV-46 | 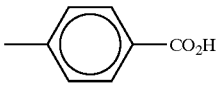 | $-H$ | $-CO_2H$ | 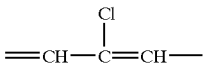 |
| IV-47 | $-CH_2CH_2CN$ | 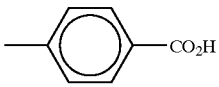 | $-CH_3$ | $=CH-CH=CH-$ |
| IV-48 | $-CH_2CH_2CN$ | 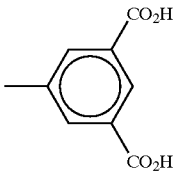 | $-CH_3$ | $=CH-CH=CH-$ |

-continued

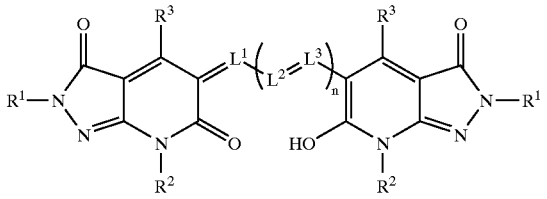

| | $R^1$ | $R^2$ | $R^3$ | $=L^1-(L^2=L^3)_n-$ |
|---|---|---|---|---|
| IV-49 | 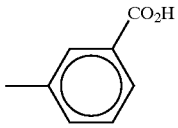 | —H | $-CH_3$ | =CH—CH=CH— |
| IV-50 | 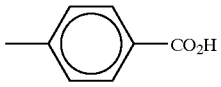 | —H | $-CH_3$ | =CH—CH=CH—CH=CH— |
| IV-51 | $-CH_3$ | 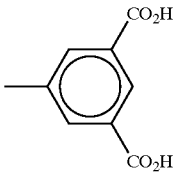 | $-CH_3$ | =CH—CH=CH—CH=CH— |

The dye used in the invention can be synthesized by or according to the methods disclosed in the specifications and the publications of International Patent No. WO88/04794, EP-A Nos. 274,723A1, 276,566, and 299,435, JP-A Nos. 52-92716, 55-155350, 55-155351, 61-205934, and 48-68623, U.S. Pat. Nos. 2,527,583, 3,486,897, 3,746,539, 3,933,798, 4,130,429, and 4,040,841, JP-A Nos. 3-282244, 3-7931 and 3-167546.

The solid fine particle dispersion of the dye used in the invention can be prepared in the known methods. The details of the production methods are disclosed, for example, in "Kinousei Ganryou Ouyou Gijutu" (Application Techniques of Functional Pigments) (CMC Press, 1991).

Media dispersion is one of the general methods. In this method, the dye powder or the dye in a state wet with water or an organic solvent, which dye powder or dye is referred to as a wet cake, is formed into an aqueous slurry, and is then pulverized with mechanical power in the presence of a dispersion medium (such as steel balls, ceramic balls, glass beads, alumina beads, zirconia silicate beads, zirconia beads and Ottawa sand) by a known pulverizing machine (such as a ball mill, a vibrating ball mill, a planet ball mill, a vertical sand mill, a roller mill, a pin mill, a coball mill, a caddie mill, a transverse sand mill and an attritor). Among these, the beads used herein preferably have an average diameter of from 0.3 to 2 mm, more preferably from 0.3 to 1 mm, and further preferably from 0.3 to 0.5 mm. In addition to the foregoing methods, a method of pulverizing with a jet mill, a roll mill, a homogenizer, a colloid mill or a dissolver, and a method of pulverizing with an ultrasonic dispersing machine can also be employed.

Such methods can also be employed that after dissolving as a uniform solution, a poor solvent is added thereto to deposit solid fine particles as disclosed in U.S. Pat. No. 2,870,012, and after dissolving as an alkaline solution, the pH thereof is decreased to deposit solid fine particles as disclosed in JP-A No. 3-182743.

Upon preparing the solid fine particle dispersion, it is preferable that a dispersion assistant is present. Examples of the known dispersion assistants include an anionic dispersant, such as an alkylphenoxyethoxysulfonate salt, an alkylbenzenesulfonate salt, an alkylnaphthalenesulfonate salt, an alkylsulfate ester salt, an alkylsulfosuccinate salt, sodium oleylmethyltauride, a formaldehyde polycondensate of naphthalenesulfonic acid, polyacrylic acid, polymethacrylic acid, a copolymer of maleic acid and acrylic acid, carboxymethyl cellulose and cellulose sulfate, a nonionic dispersant, such as a polyoxyethylene alkyl ether, a sorbitan fatty acid ester and a polyoxyethylene sorbitan fatty acid ester, a cationic dispersant, and a betaine dispersant. A polyalkyleneoxide represented by the following general formula (V-a) or (V-b) is particularly preferably used.

General formula (V-a)

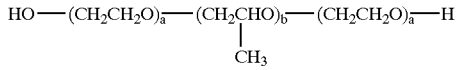

General formula (V-b)

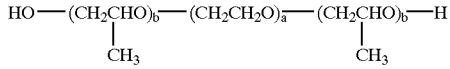

In the general formulae (V-a) and (V-b), a and b each represents a value of from 5 to 500. a and b each is preferably from 10 to 200, and more preferably from 50 to 150. When the values of a and b are in one of these ranges, it is preferable from the standpoint of improvement of the uniformity of the coated surface.

In the dispersant, the proportion of the polyethyleneoxide part is preferably from 0.3 to 0.9, more preferably from 0.7 to 0.9, and further preferably from 0.8 to 0.9, by weight. The dispersion assistant preferably has an average molecular weight of from 1,000 to 30,000, more preferably from 5,000 to 40,000, and further preferably from 8,000 to 20,000. The dispersion assistant preferably has an HLB (hydrophilicity/lipophilicity balance) of from 7 to 30, more preferably from 12 to 30, and further preferably from 18 to 30. When the values are in these ranges, it is preferable from the standpoint of improvement of the uniformity of the coated surface.

These compounds are commercially available, examples of which include PLURONIC, produced by BASF, Ltd.

Specific examples of the compound represented by the general formula (V-a) or (V-b) used in the invention are shown below.

General formula (V-a)

$$HO-(CH_2CH_2O)_a-(CH_2\underset{\underset{CH_3}{|}}{C}HO)_b-(CH_2CH_2O)_a-H$$

| No. | Weight Ratio of Polyethyleneoxide | Average Molecular Weight | HLB |
|---|---|---|---|
| V-1 | 0.5 | 1,900 | ≧18 |
| V-2 | 0.8 | 4,700 | ≧20 |
| V-3 | 0.3 | 1,850 | 7–12 |
| V-4 | 0.4 | 2,200 | 12–18 |
| V-5 | 0.4 | 2,900 | 12–18 |
| V-6 | 0.5 | 3,400 | 12–18 |
| V-7 | 0.8 | 8,400 | ≧20 |
| V-8 | 0.7 | 6,600 | ≧20 |
| V-9 | 0.4 | 4,200 | 12–18 |
| V-10 | 0.5 | 4,600 | 12–18 |
| V-11 | 0.7 | 7,700 | ≧20 |
| V-12 | 0.8 | 11,400 | ≧20 |
| V-13 | 0.8 | 13,000 | ≧20 |
| V-14 | 0.3 | 4,950 | 7–12 |
| V-15 | 0.4 | 5,900 | 12–18 |
| V-16 | 0.5 | 6,500 | 12–18 |
| V-17 | 0.8 | 14,600 | ≧20 |
| V-18 | 0.3 | 5,750 | 7–12 |
| V-19 | 0.7 | 12,600 | ≧18 |

General formula (V-b)

$$HO-(CH_2\underset{\underset{CH_3}{|}}{C}HO)_b-(CH_2CH_2O)_a-(CH_2\underset{\underset{CH_3}{|}}{C}HO)_b-H$$

| No. | Weight Ratio of Polyethyleneoxide | Average Molecular Weight | HLB |
|---|---|---|---|
| V-20 | 0.5 | 1,950 | 12–18 |
| V-21 | 0.4 | 2,650 | 7–12 |
| V-22 | 0.4 | 3,600 | 7–12 |
| V-23 | 0.8 | 8,600 | 12–18 |

The dye represented by the following general formula (A) can also be preferably used.

General formula (A)

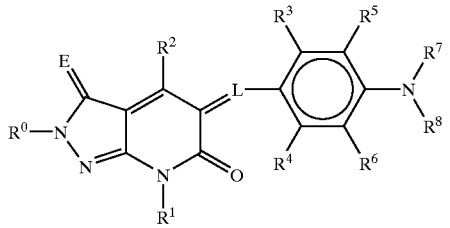

In the general formula (A), L represents a nitrogen atom or a group formed by linking 1, 3, 5 or 7 methine groups, which may be substituted, through a conjugated double bond; E represents O, S or N—$R^9$; $R^0$ and $R^9$ each independently represents a hydrogen atom, an alkyl group, an alkenyl group, an alkynyl group, an aryl group, a heterocyclic group, an amino group, a hydrazino group or a diazenyl group, which groups may be further substituted with another substituent; $R^1$ represents a hydrogen atom, an allyl group, an aryl group, an alkenyl group, an alkynyl group or a heterocyclic group, which groups may be further substituted with another substituent; $R^2$ represents a hydrogen atom, a halogen atom, a cyano group, a nitro group, a hydroxyl group, a carboxyl group, an alkyl group, an aryl group, an alkenyl group, a heterocyclic group, an alkoxy group, an aryloxy group, an alkoxycarbonyl group, an aryloxycarbonyl group, an amino group, an acyloxy group, a carbamoyl group, a sulfamoyl group, an alkylthio group, an arylthio group, an alkylsulfonyl group, an arylsulfonyl group or an alkynyl group, wherein the alkyl group, the aryl group, the alkenyl group, the heterocyclic group, the alkoxy group, the aryloxy group, the alkoxycarbonyl group, the aryloxycarbonyl group, the amino group, the acyloxy group, the carbamoyl group, the sulfamoyl group, the alkylthio group, the arylthio group, the alkylsulfonyl group, the arylsulfonyl group and the alkynyl group may be further substituted with another substituent, provided that $R^0$ and $R^9$ may be connected to form a ring; $R^3$ and $R^4$ each independently represents a hydrogen atom, a halogen atom, an alkoxy group, an alkyl group, an alkenyl group, an aryloxy group or an aryl group; $R^5$ and $R^6$ each independently represents a hydrogen atom or a substituent; and $R^7$ and $R^8$ each independently represents an alkyl group, an aryl group, a vinyl group, an acyl group, an alkyl group or an arylsulfonyl group, provided that $R^3$ and $R^5$, $R^4$ and $R^6$, $R^7$ and $R^8$, $R^5$ and $R^7$, and $R^6$ and $R^8$ each may be connected to form a ring.

The groups in the general formula (A) will be described in detail below.

L preferably represents a nitrogen atom or a group represented by the following general formula (A-a), and more preferably a group represented by the general formula (A-a).

$$=L^1-(L^2=L^3)_p- \qquad \text{General formula (A-a)}$$

In the general formula (A-a), $L^1$, $L^2$ and $L^3$ each represents a substituted or unsubstituted methine group, and p represents 0 or 1.

Examples of the substituent on $L^1$, $L^2$ and $L^3$ include a methyl group and an ethyl group.

E preferably represents O and N—$R^9$, and $R^9$ preferably represents an alkyl group having from 1 to 20 carbon atoms, which may be substituted (such as methyl, ethyl, n-propyl and n-octyl), an alkenyl group having from 3 to 6 carbon atoms, which may be substituted (such as allyl), a aryl group having from 6 to 10 carbon atoms, which may be substituted (such as phenyl and naphthyl), an amino group, which may be substituted, a hydrazino group, which may be substituted, and a diazenyl group, which may be substituted. In the case where E represents N—$R^9$, it is preferable that $R^9$ and $R^0$ be connected to form a ring. Preferable examples of the ring formed by connecting $R^9$ and $R^0$ include imidazole, triazole and tetrazole rings, which may have a substituent and may form a condensed ring with other rings (such as benzoimidazole).

Preferable examples of the group represented by $R^0$ include an alkyl group having from 1 to 20 carbon atoms, which may be substituted (such as methyl, ethyl, n-propyl, t-butyl, n-butyl, n-octyl, n-dodecyl and isooctadecyl), an aryl group having from 6 to 20 carbon atoms, which may be substituted (such as phenyl and naphthyl), and a 5-membered or 6-membered heterocyclic group, which may be substituted (such as, those containing, for example, B, N, O, S, Se and Te, as a heterogeneous atom). Specific examples of the heterocyclic group include a saturated heterocyclic ring, which may be substituted, such as a pyrrolidyl group, a morpholino group, a 2-bora-1,3-dioxolanyl group and a 1,3-thiazodinyl group, and an unsaturated heterocyclic ring, which may be substituted, such as imidazolyl, thiazolyl, benzothiazolyl, benzooxazolyl, benzotetrazolyl, benzoselenazolyl, pyridyl, pyrimidynyl and quinolinyl. The substituent that can be substituted on these groups is not particularly limited except for such groups that the dye molecules are solubilized (such as a sulfonic acid group) upon coating the solid fine particle dispersion of the dye, and examples thereof include a halogen atom (such as F, Cl, Br and I), a cyano group, a nitro group, a carboxyl group, a hydroxyl group, an alkoxy group having from 1 to 20 carbon atoms (such as methoxy, isopropoxy and hexadecyloxy), an aryloxy group having from 6 to 10 carbon atoms (such as phenoxy, 4-carboxyphenoxy, 2,4-di-t-pentylphenoxy, m-pentadecylphenoxy, p-methylphenoxy and 3,5-dichlorophenyl), an alkyl group having from 1 to 20 carbon atoms (such as methyl, ethyl, n-propyl, isopropyl, t-butyl, 2-methoxyethyl and trifluoromethyl), an aryl group having from 6 to 10 carbon atoms (such as phenyl, 2-carboxyphenyl, 3-carboxyphenyl, 4-carboxyphenyl, 3,5-dicarboxyphenyl, 3-chlorophenyl, 4-methanesulfonamidephenyl, 4-hexylphenyl and 2-naphthyl), an unsubstituted amino group, a substituted amino group having from 1 to 20 carbon atoms (such as dimethylamino, methylamino, diethylamino, phenylamino, acetylamino, methanesulfonylamino, methylcarbamoylamino, phenylthiocarbamoylamino and benzenesulfonylamino), an unsubstituted carbamoyl group, a substituted carbamoyl group having from 2 to 20 carbon atoms (such as ethylcarbamoyl, methylcarbamoyl, phenylcarbamoyl, octadecylcarbamoyl, diethylcarbamoyl and pyrrolidinocarbonyl), an unsubstituted sulfamoyl group, a substituted sulfamoyl group having from 1 to 20 carbon atoms (such as methylsulfamoyl, dimethylsulfamoyl, t-butylsulfamoyl, phenylsulfamoyl, pyrrolidinosulfonyl and 3-(2,4-di-t-pentylphenoxy)butylsulfamoyl), an alkylthio group having from 1 to 20 carbon atoms or an arylthio group having from 6 to 10 carbon atoms (such as methylthio, phenylthio, benzylthio and octadecylthio), an alkylsulfonyl group having from 1 to 20 carbon atoms (such as methanesulfonyl and 2-ethoxyethylsulfonyl), an arylsulfonyl group having from 6 to 10 carbon atoms (such as benzenesulfonyl, dodecylbenzenesulfonyl and 2-(2-methoxyethoxy)-5-(4-hydroxyphenylazo)-benzenesulfonyl), and an ester group having from 2 to 20 carbon atoms (such as methoxycarbonyl, ethoxycarbonyl, octacecylcarbonyl and phenoxycarbonyl).

Particularly preferable examples of the group represented by $R^0$ include a hydrogen atom, an alkyl group having from 1 to 10 carbon atoms (such as methyl, ethyl, n-propyl, n-hexyl, n-decyl and isopropyl, which may be substituted with the foregoing preferable substituents), an aryl group having from 6 to 10 carbon atoms (such as phenyl and naphthyl, which may be substituted with the foregoing preferable substituents), and a 5-membered or 6-membered heterocyclic group (such as 2-pyridyl, 4-pyridyl, 2-benzthiazolyl, 2-(1-methylimidazolyl) and 4,6-diethylamino-2-triazinyl).

Preferable examples of the group represented by $R^1$ include a hydrogen atom, an alkyl group having from 1 to 20 carbon atoms, which may be substituted, a phenyl group having from 6 to 10 carbon atoms, which may be substituted, and a heterocyclic group, which may be substituted (the number of members of the ring is 5 or 6, and the heterogeneous atom is selected from B, N, O, S, Se and Te). Preferable examples of a substituent substituted on these groups include those described as the preferable substituents on $R^0$.

More preferable examples of the group represented by $R^1$ include a hydrogen atom, an alkyl group having from 1 to 10 carbon atoms, which may be substituted with the group described as the substituent on $R^0$ (such as methyl, ethyl, n-propyl, t-butyl, benzyl, 2-methoxyethyl, trifluoromethyl and benzoyloxymethyl), a phenyl group, which may be substituted with the group described as the substituent on $R^0$ (such as phenyl, 4-carboxyphenyl, 4-methoxyphenyl, 3-chlorophenyl, 3-trifluoromethylphenyl, 2-methanesulfonyl-4-nitrophenyl, 2-nitro-4-dimethylsulfamoylphenyl and 4-methanesulfonylphenyl), and a 5-membered or 6-membered heterocyclic ring (such as 2-pyridyl, 4-pyridyl, 3-pyridyl, 2-benzthiazolyl, 2-(1-methylimidazolyl) and 4,6-butylamino-2-triazinyl).

Preferable examples of the group represented by $R^2$ include a hydrogen atom, an alkyl group having from 1 to 20 carbon atoms, which may be substituted, an aryl group having from 6 to 10 carbon atoms, which may be substituted, a carbamoyl group having from 1 to 20 carbon atoms, which may be substituted, an alkoxycarbonyl group having from 2 to 20 carbon atoms, which may be substituted, an aryloxycarbonyl group having from 7 to 11 carbon atoms, which may be substituted, a carboxyl group and a hydroxyl group. Preferable examples of a substituent substituted on these groups include those described as the preferable substituents on $R^0$.

Specific preferable examples of the group represented by $R^2$ include methyl, ethyl, t-butyl, trifuloromethyl, 2-ethylhexyl, pentadecyl, phenyl, 4-carboxyphenyl, 4-methoxyphenyl, 4-nitrophenyl, carbamoyl, methylcarbamoyl, butylcarbamoyl, diethylcarbamoyl, pyrrolidinocarbonyl, morpholinocarbonyl, hydroxyethylcarmamoyl, phenylcarbamoyl, 4-carboxyphenylcarbamoyl, 2-methoxyethoxycarbamoyl, 2-ethylhexylcarbamoyl, ethoxycarbonyl, butoxycarbonyl, benzyloxycarbonyl, 2-methoxyethyoxycarbonyl and 2-dodecyloxyethoxycarbonyl.

Preferable examples of the substituent represented by $R^3$ and $R^4$ include a hydrogen atom, a chlorine atom, a fluorine atom, a substituted or unsubstituted alkoxy group having from 1 to 10 carbon atoms (such as methoxy, ethoxy and octyloxy), and a substituted or unsubstituted alkyl group having from 1 to 10 carbon atoms (such as methyl, isopropyl, 2-methoxyethyl and benzyl).

Particularly preferable examples of the substituent represented by $R^3$ and $R^4$ include a hydrogen atom, a chlorine atom, an alkyl group having from 1 to 5 carbon atoms (such as methyl, ethyl, isopropyl, isobutyl and t-amyl), and an alkoxy group having from 1 to 8 carbon atoms (such as methoxy, ethoxy, sec-butoxy, t-butoxy and 2-methoxyethoxy).

Examples of the substituent represented by $R^5$ and $R^6$ include a halogen atom (such as a fluorine atom, a chlorine atom and a bromine atom), a hydroxyl group, a cyano group, a substituted or unsubstituted alkyl group having from 1 to 10 carbon atoms (such as methyl, ethyl, butyl and 2-ethylhexyl) that is bonded to the benzene ring directly or through a divalent linking group, and a substituted or substituted aryl group having from 6 to 10 carbon atoms (such as phenyl, naphthyl, 4-carboxyphenyl, 3-sulfamoylphenyl and 5-methanesulfonamide-1-naphthyl). Examples of the divalent linking group include —O—, —NHCO—, —$NHSO_2$—, —NHCOO—, —NHCONH—, —COO—, —CO—, —$SO_2$— and —NR— (wherein R represents a hydrogen atom or a substituted or unsubstituted alkyl group having from 1 to 16 carbon atoms, such as methyl, ethyl and n-butyl).

Particularly preferable examples of the group represented by $R^5$ and $R^6$ include a hydrogen atom or an alkyl group having from 1 to 8 carbon atoms (such as methyl, isobutyl, cyclohexyl, 2-ethoxypropyl and ethyl).

The alkyl groups represented by $R^7$ and $R^8$ may be the same as or different from each other, and are preferably an alkyl group having from 1 to 18 carbon atoms (such as methyl, ethyl, propyl, isobutyl, n-octyl, n-dodecyl and n-octadecyl), which may have a substituent (such as an cyano group, a hydroxyl group, a methoxy group, a carboxyl group, an alkoxy group, such as an ethoxy group, an aryloxy group, such as a phenoxy group, an amide group, such as a methanesulfonamide group and an acetamide group, and a halogen atom, such as a chlorine atom and a fluorine atom).

The aryl groups represented by $R^7$ and $R^8$ may be the same as or different from each other, and examples thereof include a substituted or unsubstituted phenyl group and a substituted or unsubstituted naphthyl group, and preferable examples of the substituent on the phenyl group and the naphthyl group include a carboxyl group, a hydroxyl group, a cyano group, a halogen atom (such as a chlorine atom and a fluorine atom), an acyl group having from 2 to 18 carbon atoms (such as acetyl, propyonyl and stearoyl), a sulfonyl group having from 1 to 18 carbon atoms (such as methanesulfonyl, ethanesulfonyl and octanesulfonyl), a carbamoyl group having from 1 to 18 carbon atoms (such as unsubstituted carbamoyl, methylcarbamoyl and octylcarbamoyl), a sulfamoyl group having from 1 to 18 carbon atoms (such as unsubstituted sulfamoyl, methylsulfamoyl and butylsulfamoyl), an alkoxycarbonyl group having from 2 to 18 carbon atoms (such as methoxycarbonyl, trichloroethoxycarbonyl and decyloxycarbonyl), an alkoxy group having from 1 to 18 carbon atoms (such as methoxy, butoxy and pentadecyloxy), and an amino group (such as dimethylamino, diethylamino and dihexylamino).

Preferable examples of the vinyl groups represented by $R^7$ and $R^8$, which are independent from each other, include a substituted or unsubstituted vinyl group having from 2 to 18 carbon atoms (such as vinyl, 1-propenyl, 2,2-dimethylvinyl and 1-methyl-1-propenyl).

Preferable examples of the acyl groups represented by $R^7$ and $R^8$, which are independent from each other, include an aliphatic or aromatic acyl group having from 1 to 18 carbon atoms, which may be substituted, (such as acetyl, pivaloyl, benzoyl and 2-carboxybenzoyl).

Preferable examples of the alkyl- or arylsulfonyl groups represented by $R^7$ and $R^8$, which are independent from each other, include an alkyl- or arylsulfonyl group having from 1 to 18 carbon atoms, which may be substituted, (such as methanesulfonyl, octanesulfonyl, benzenesulfonyl, 3-carboxybenzenesulfonyl, trifluoromethanesulfonyl and hydroxymethanesulfonyl).

Preferable examples of the ring formed by connecting $R^3$ and $R^5$, or $R^4$ and $R^6$ include a 5-membered or 6-membered ring, and an aromatic ring, such as a benzene ring, and an aromatic heterocyclic ring, such as a pyridine ring, an imidazole ring, a thiazole ring and a pyrimidine ring, are particularly preferable.

Preferable examples of the ring formed by connecting $R^5$ and $R^7$, or $R^6$ and $R^8$ include a 5-membered or 6-membered ring.

Preferable examples of the ring formed by connecting $R^7$ and $R^8$ include a 5-membered or 6-membered ring, and a pyrrolidine ring, a piperidine ring and a morpholine ring are particularly preferable.

With respect to all the substituents contained in the compound represented by the general formula (A), a group having a pKa (acid dissociation constant) of 2 or less, such as a sulfonic acid group, is not preferable, and groups having a pKa of 3 or more are preferable. In order to facilitate the outflow of the compound from the photographic material, it is particularly preferable that the compound has from 1 to 4 groups, each of which has a pKa of from 3 to 12, particularly preferably from 4 to 11. Examples of the groups include a carboxyl group, a phenolic hydroxyl group, an —$NHSO_2$— group, and an active methylene group, such as —$COCH_2CO$—. A carboxyl group directly connected to the aryl group is particularly preferable.

Specific examples of the compound represented by the general formula (A) will be shown below, but the invention is not limited to these examples.

1

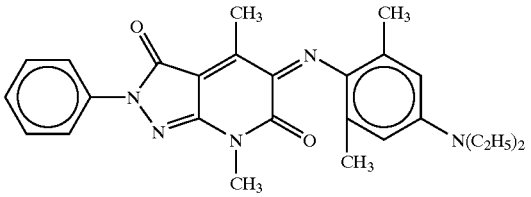

2

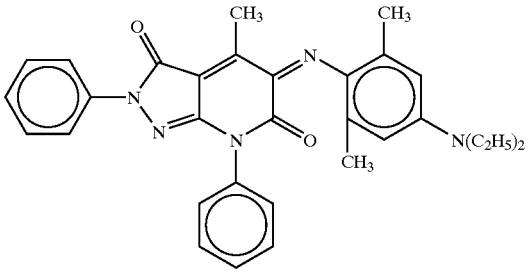

-continued
3
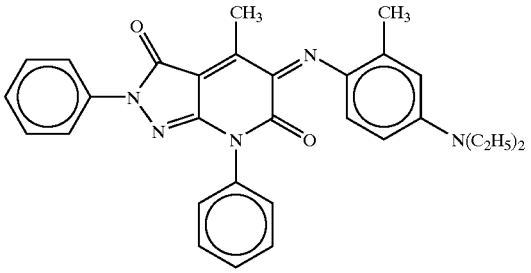
4
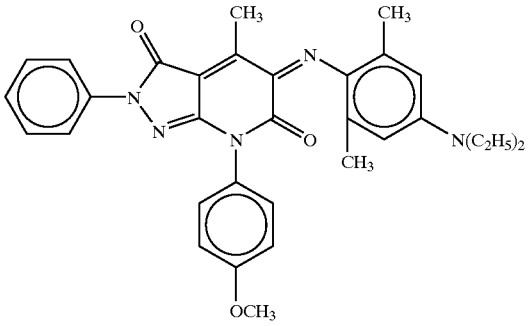
5
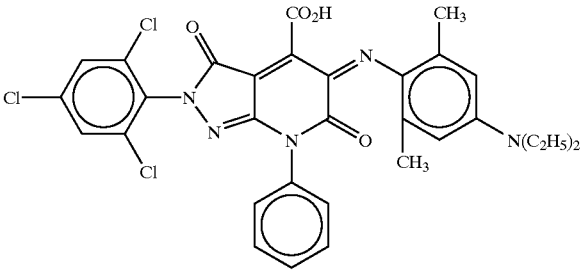
6
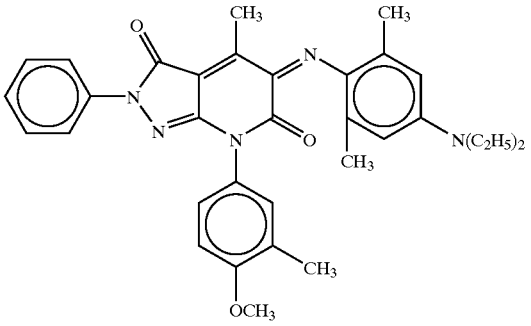
7
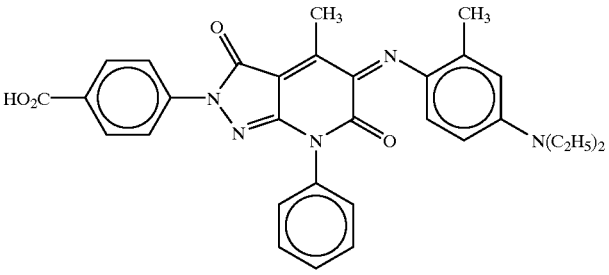
8
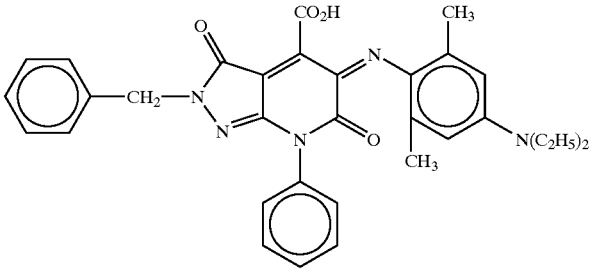

-continued
9
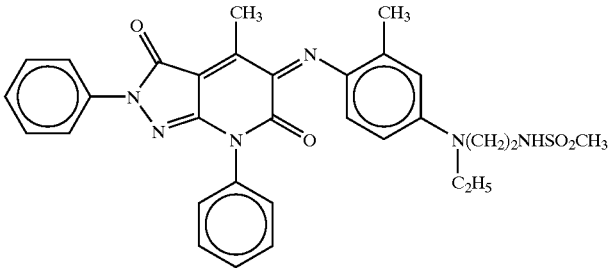
10
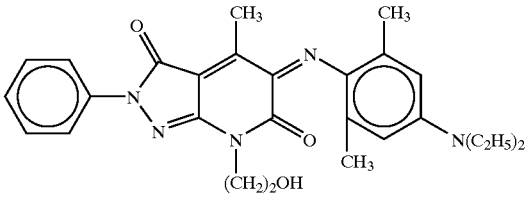
11
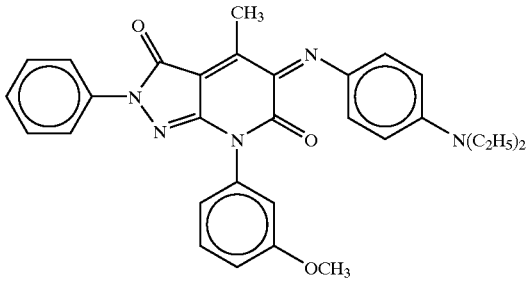
12
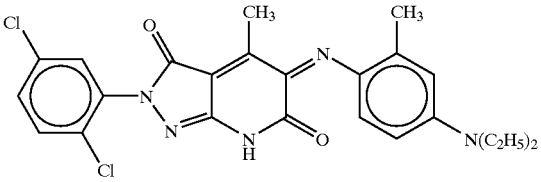
13
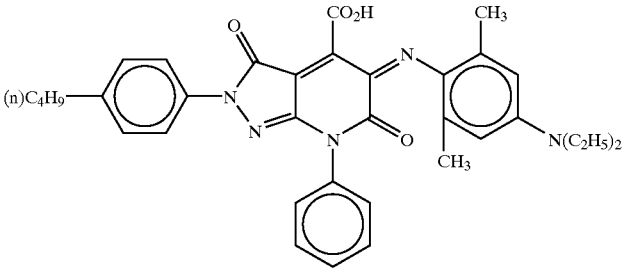
14
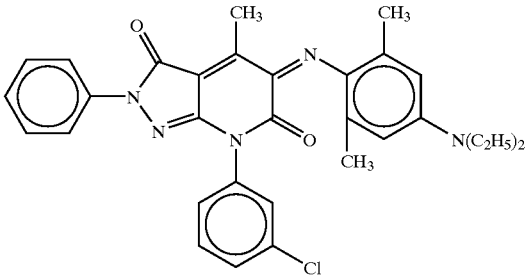
15
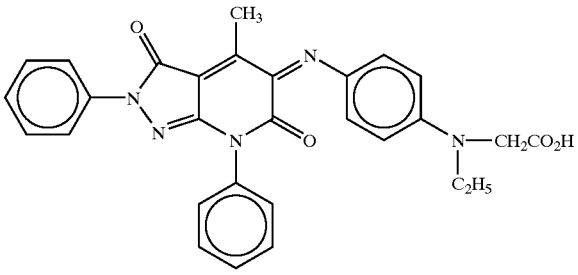

-continued
16
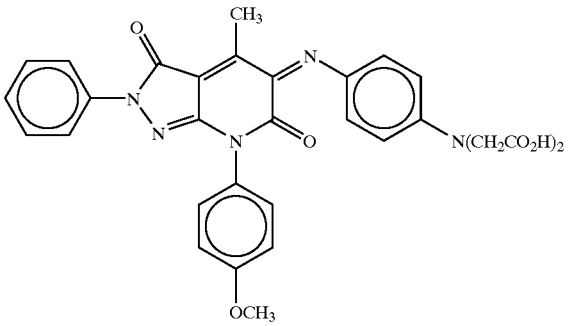
17
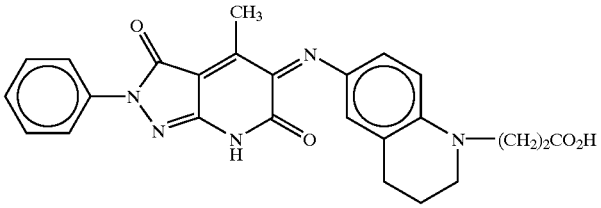
18
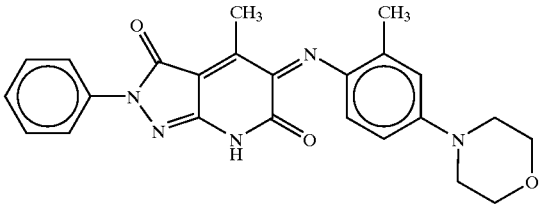
19
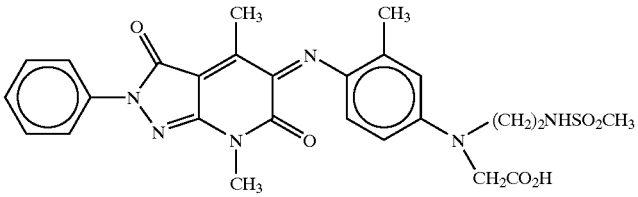
20
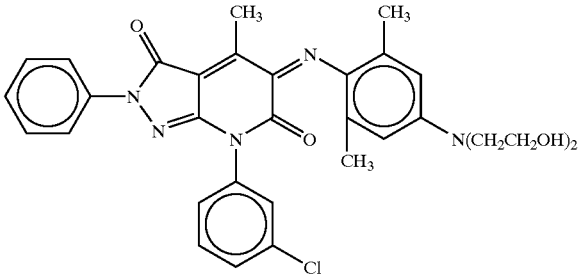
21
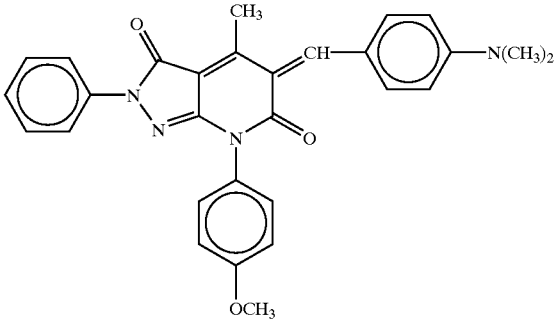

-continued
22
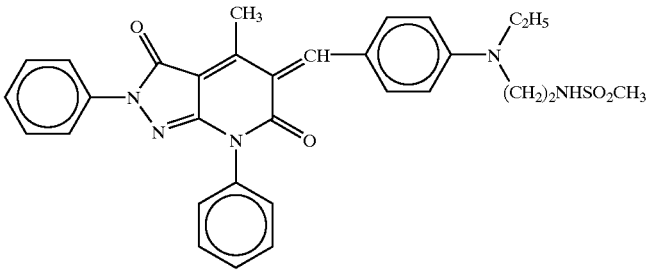
23
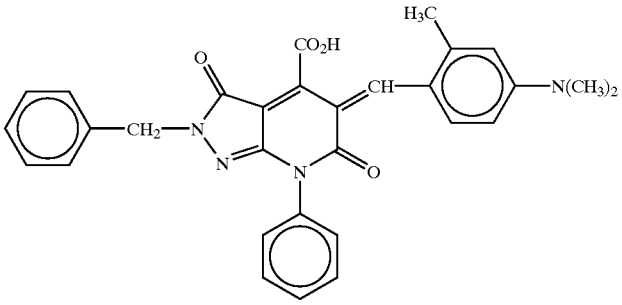
24
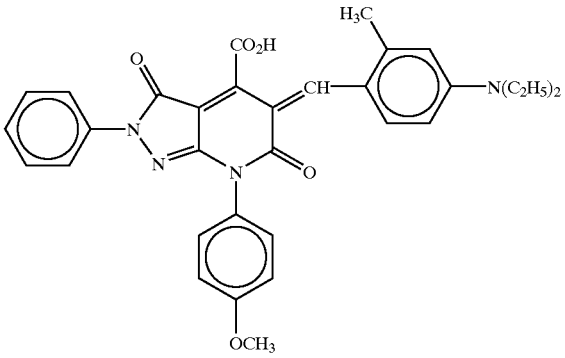
25
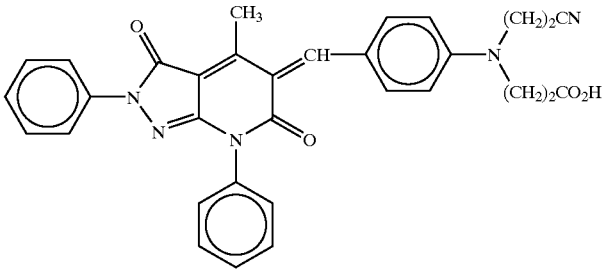
26
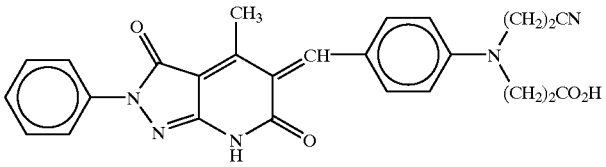

-continued
27
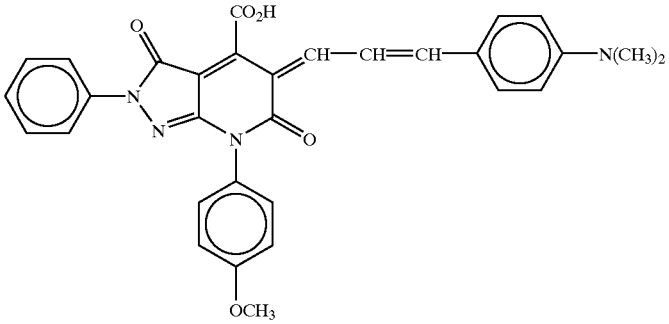
28
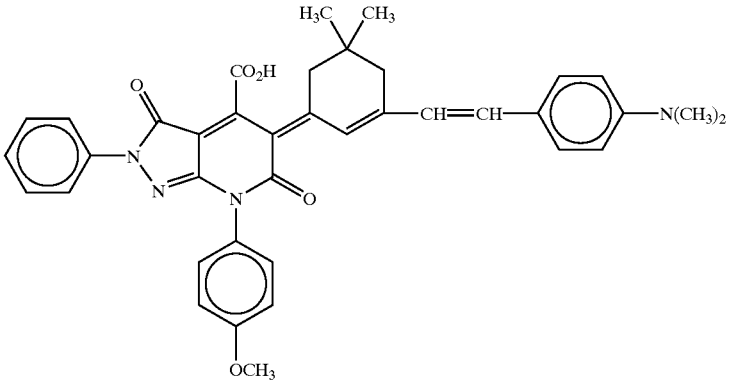
29
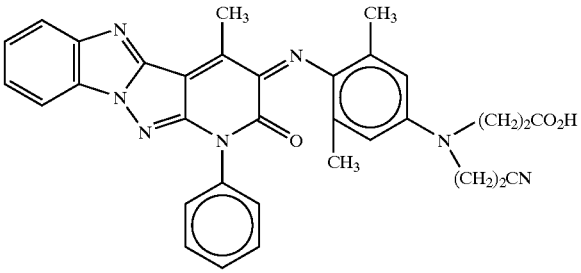
30
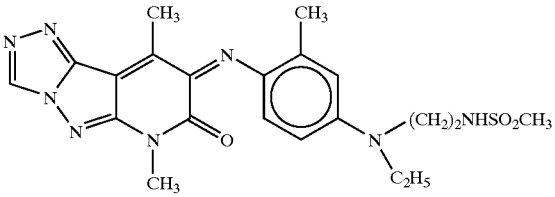
31
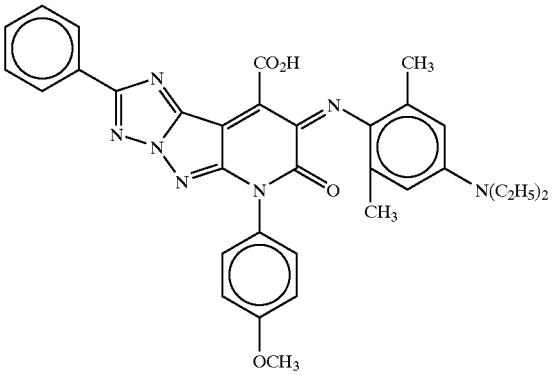

-continued
32
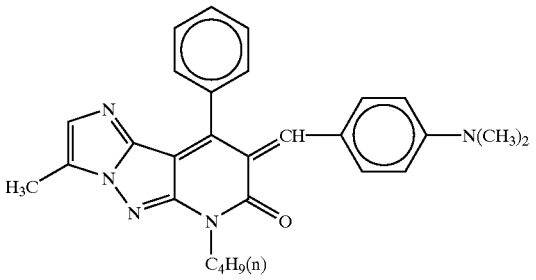
33
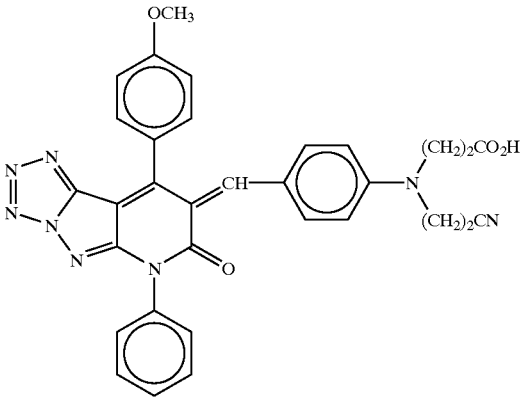
34
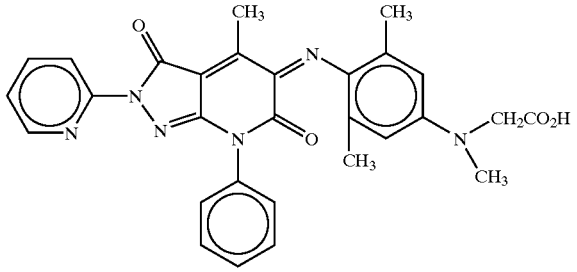
35
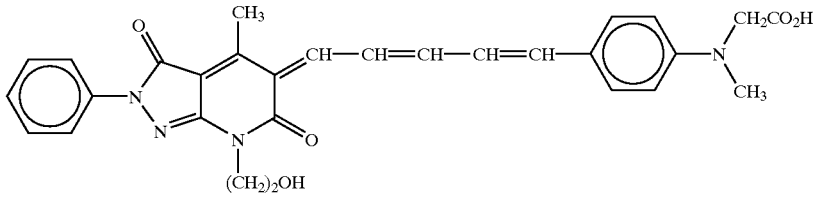
36
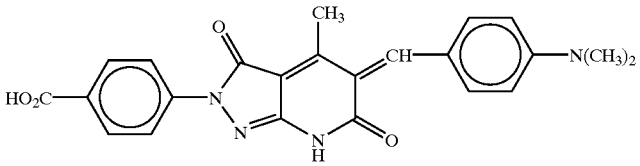
37
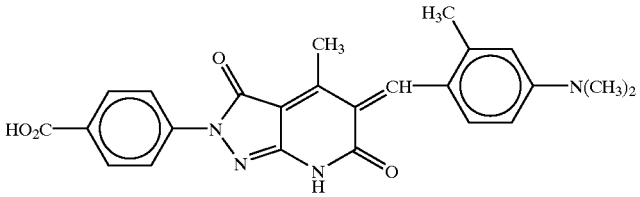
38
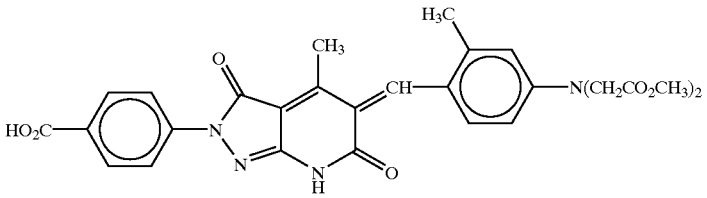

-continued
39
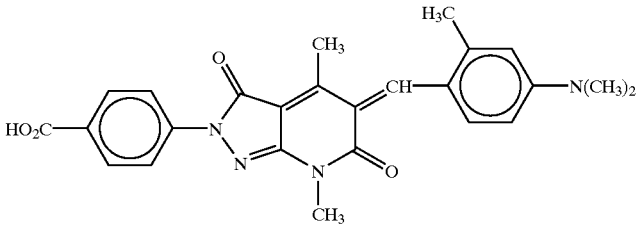
40
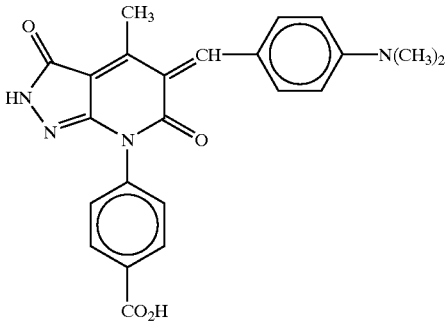
41
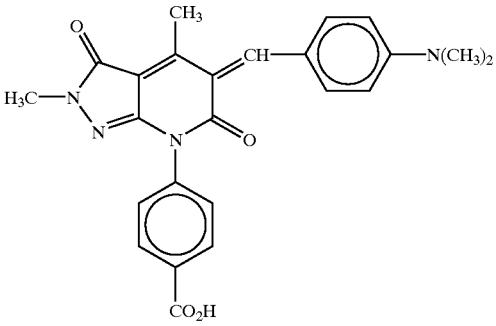
42
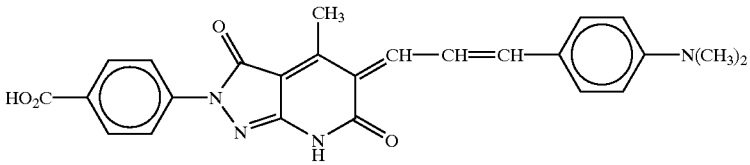
43
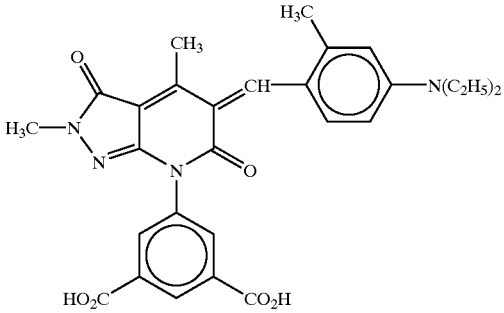
44
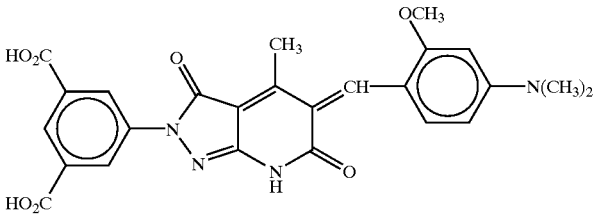
45
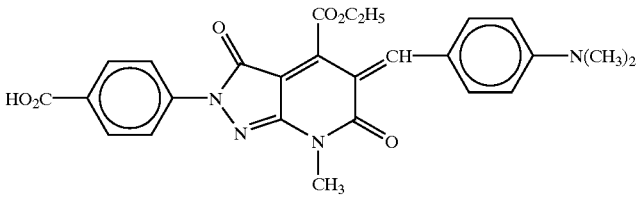

-continued
46
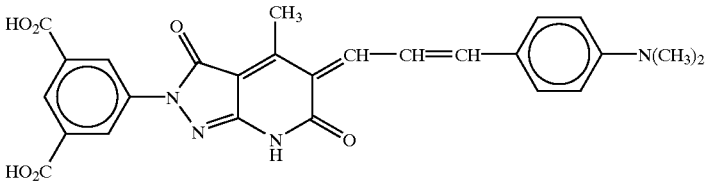
47
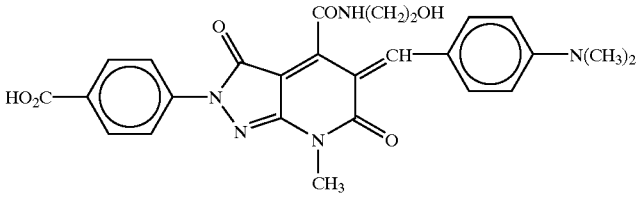
48
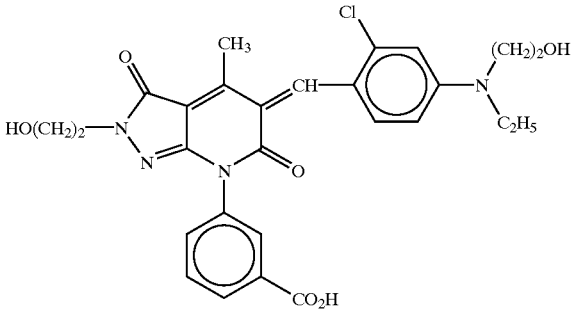
49
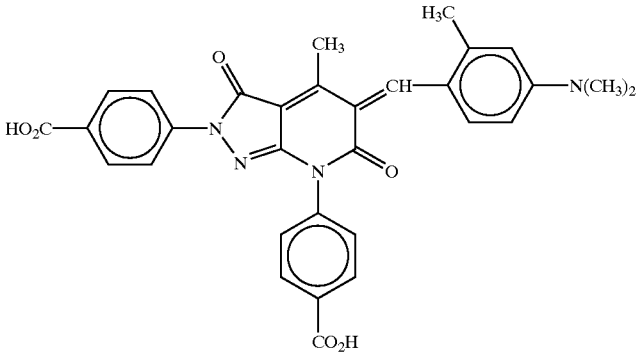
50
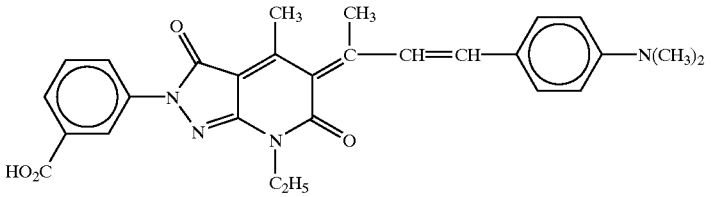

The compound of the invention can be synthesized by referring to the method disclosed in JP-A No. 52-135335. That is, it can be synthesized by condensing the compound represented by the general formula (I-a) with a nitrosoaniline compound, a benzaldehyde compound or a cinnamic aldehyde compound.

General formula (I-a)

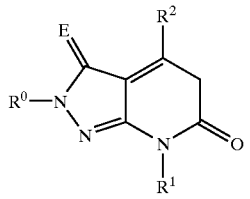

In the general formula (I-a), $R^0$, $R^1$, $R^2$ and E have the same meaning as in the general formula (A).

The compound represented by the general formula (I-a) can be synthesized by heating a compound represented by the following general formula (I-b) and a compound represented by the following general formula (I-c) under an acidic condition.

General formula (I-b)

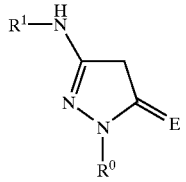

In the general formula (I-b), $R^0$, $R^1$ and E have the same meaning as $R^0$, $R^1$ and E in the general formula (A).

General formula (I-c)

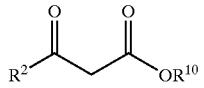

In the general formula (I-c), $R^2$ has the same meaning as $R^2$ in the general formula (A), and $R^{10}$ represents an alkyl group or an aryl group.

The functional group on the compound represented by the general formula (A) or the general formula (I-a) can be converted to another functional group by the known process.

Synthesis examples of the compound of the invention will be shown below.

Synthesis Example 5

Synthesis of Compound 2

1-Phenyl-3-anilino-2-pyrazolin-5-one (25 g), ethyl acetoacetate (18 g) and acetic acid (150 ml) were heated to be refluxed for 6 hours. The reaction solution was diluted with water, and the resulting solid matter is crystallized from acetonitrile to obtain 10.9 g of 2,7-diphenyl-4-methylpyrazolo(3,4-b)pyridin-3,6-dione. It had a melting point of from 145 to 147° C.

3.17 g of the compound was dissolved in 150 ml of methanol and 1.4 ml of triethylamine, and 2.4 g of N,N-diethyl-2,5-dimethyl-4-nitrosoaniline hydrochloride and 0.94 ml of acetic anhydride were further added thereto, followed by stirring at room temperature for 1 hour. The crystals thus deposited were filtrated and washed with methanol. The crystals were dissolved in a ⅕ mixed solvent of ethyl acetate and chloroform and passed through a silica gel short column for purification. After distilling the solvents, the crystals were dissolved in chloroform, and methanol was added thereto to deposit crystals. The crystals were filtrated and dried to obtain 0.3 g of the compound 2. It had a melting point of from 183 to 185° C.

Synthesis Example 6

Synthesis of Compound 12

200 ml of acetic acid and 26.4 g of ethyl acetate were added to 48.8 g of 3-amino-1-(2,5-dichlorophenyl)-2-pyrazolin-5-one, which were then refluxed for 2 hours. The reaction solution was put in 800 ml of water, and the resulting crystals were filtrated and then washed with water, isopropanol and ethyl acetate in this order. The crystals were dispersed in 200 ml of isopropanol and washed by heating and stirring, and the crystals were filtrated and dried to obtain 4.7 g of 4-methyl-2-(2,5-dichlorophenyl)pyrazolo(3,4-b)pyridin-3,6-dione.

3.1 g of the resulting compound was dissolved in 200 ml of methanol and 1.4 ml of triethylamine, and 1.92 g of N,N-diethyl-4-nitrosometatoluidine and 0.94 ml of acetic anhydride were further added thereto, followed by stirring at room temperature for 30 minutes. 0.7 ml of acetic acid was added thereto, The resulting mixture was then put in 500 ml of water, and then it was extracted with chloroform. The extract was twice purified by silica gel chromatography, and parts of blue-green color were collected, followed by distilling the solvent to obtain 0.6 g of compound 12. It had a melting point of 300° C. or more.

Synthesis Example 7

Synthesis of Compound 14

30 ml of acetic acid and 4 g of ethyl acetoacetate were added to 5.7 g of 3-(3-chlorophenylamino)-1-phenyl-2-pyrazolin-5-one, and they were heated and stirred over a bath of 150° C. for 10 hours and 20 minutes. Insoluble matter was filtrated from the reaction solution in a hot state, and washed with isopropanol, followed by drying with air, to obtain 2.3 g of 7-(3-chlorophenyl)-2-phenyl-4-methylpyrazolo(3,4-b)pyridin-3,6-dione. It had a melting point of from 278 to 282° C.

100 ml of methanol and 0.6 ml of triethylamine were added to 1.5 g of the resulting compound, and after removing a slight amount of insoluble matters by filtration, 1.1 g of N,N-diethyl-3,5-dimethyl-4-nitrosoaniline hydrochloride and 0.41 ml of acetic anhydride were added thereto, followed by stirring at room temperature for 30 minutes. The crystals thus deposited were filtrated and washed with methanol, and then they were recrystallized from a mixture of chloroform and methanol to obtain 0.2 g of the compound 14. It had a melting point of from 178 to 180° C.

Synthesis Example 8

Synthesis of Compound 36

2.8 g of 2-(4-carboxyphenyl)-4-methylpyrazolo(3,4-b)pyridin-3,6-dione, 1.6 g of 4-dimethylaminobenzaldehyde, 25 ml of acetic acid and 5 ml of acetic anhydride were mixed and heated at an interior temperature of from 70 to 75° C. for 2 hours while stirring. The resulting crystals were filtrated and washed with methanol. The crystals were dispersed in 30 ml of methanol and refluxed for 1 hour. Insoluble crystals were filtrated and washed with methanol, followed by drying, to obtain 2.1 g of the compound 36. It had a melting point of 300° C. or more. It exhibited $\lambda max=559$ nm and $\epsilon=4.18\times10^4$ (dimethylsulfoxide).

Synthesis Example 9

Synthesis of Compound 37

2.8 g of 2-(4-carboxyphenyl)-4-methylpyrazolo(3,4-b) pyridin-3,6-dione, 1.8 g of 4-dimethylamino-2-methylbenzaldehyde, 25 ml of acetic acid and 5 ml of acetic anhydride were mixed and heated at an interior temperature of from 80 to 85° C. for 2 hours while stirring. The resulting crystals were filtrated and washed with methanol.

The crystals were dispersed in 50 ml of methanol and refluxed for 1 hour. Insoluble crystals were filtrated and washed with methanol, followed by drying, to obtain 2.7 g of the compound 37. It had a melting point of 300° C. or more. It exhibited $\lambda max=582$ nm and $\epsilon=4.23\times10^4$ (dimethylsulfoxide).

Synthesis Example 10

Synthesis of Compound 39

6.0 g of 2-(4-carboxyphenyl)-4,7-dimethylpyrazolo(3,4-b)pyridin-3,6-dione, 3.6 g of 4-dimethylamino-2-methylbenzaldehyde, 30 ml of acetic acid and 10 ml of acetic anhydride were mixed and heated at an interior temperature of from 80 to 85° C. for 2 hours while stirring. The resulting crystals were filtrated and washed with methanol. The crystals were dispersed in 100 ml of methanol and refluxed for 1 hour. Insoluble crystals were filtrated and washed with methanol, followed by drying, to obtain 6.8 g of the compound 39. It had a melting point of 300° C. or more. It exhibited $\lambda max=585$ nm and $\epsilon=4.35\times10^4$ (dimethylsulfoxide).

Synthesis Example 11

Synthesis of Compound 42

2.8 g of 2-(4-carboxyphenyl)-4-methylpyrazolo(3,4-b) pyridin-3,6-dione, 1.9 g of dimethylaminocinnamaldehyde, 25 ml of acetic acid and 5 ml of acetic anhydride were mixed and heated at an interior temperature of from 80 to 85° C. for 2.5 hours while stirring. The resulting crystals were filtrated and washed with methanol. The crystals were dispersed in 100 ml of methanol and refluxed for 1 hour. Insoluble crystals were filtrated and washed with methanol, followed by drying, to obtain 1.7 g of the compound 42. It had a melting point of 300° C. or more. It exhibited $\lambda max=628$ nm and $\epsilon=6.16\times10^4$ (dimethylsulfoxide).

The dye represented by the general formula (A) is generally used in an amount of about from 1 to 1,000 mg per $m^2$ of the photosensitive material, and preferably from about 1 to 250 mg per 1 $m^2$.

In the case where the dye represented by the general formula (A) is used as a filter dye or an anti-halation dye, an arbitrary amount thereof that exerts the intended effect can be used, and it is preferably used in such an amount that exhibits an optical density of from 0.05 to 3.5. The timing of addition thereof may be any process step before coating.

The dye can be used in either the emulsion layers or the other hydrophilic colloid layers.

As the method for dispersing the dye as a fine crystal dispersion, the known pulverization method in the presence of a dispersant, such as methods using ball milling (such as a ball mill, a vibration ball mill and a planet ball mill), sand milling, colloid milling, jet milling and roller milling, may be used. (In this case, a solvent, such as water and an alcohol, may also be present.) In alternative, it is possible that the compound is dissolved in a suitable solvent, and a poor solvent for the compound is added thereto to deposit fine crystal powder. In this case, a surface active agent for dispersion may be used. Further in alternative, the compound is dissolved by controlling pH, and then formed into fine crystals by changing the pH. The fine crystal particles of the compound of the general formula (A) in the dispersion preferably have an average particle diameter of 10 $\mu$m or less, more preferably 2 $\mu$m or less, and particularly preferably 0.5 $\mu$m or less, and in some cases, it is particularly preferably they are fine particles having an average particle diameter of 0.1 $\mu$m or less.

Representative examples of the hydrophilic colloid include gelatin, and other known materials that can be used for photographic purposes can also be used.

The amount of the dispersion assistant used based on the dye that is preferably used is preferably from 0.05 to 0.5, and more preferably from 0.1 to 0.3, by weight ratio. The amount of the dispersion assistant used in these ranges is preferable from the standpoint of improvement of uniformity on the coated surface.

In order for stability and low viscosity of the solid fine particle dispersion, a hydrophilic colloid, such as polyvinyl alcohol, polyvinylpyrrolidone, polyethylene glycol, a polysaccharide and gelatin, may be present in combination upon preparation of the solid fine particle dispersion. It is particularly preferable in the invention that the compound represented by the general formula (VI) described later is present in combination.

The solid fine particle dispersion of the dye that is preferably used in the invention is preferably subjected to a heat treatment before, during or after the dispersion by the method disclosed in JP-A No. 5-216166.

In order to obtain the effect of the invention, it is preferable that the dye of the invention be subjected to a heat treatment before installing in the photosensitive material. Examples of the heat treatment that can be preferably applied to the dye dispersion in the invention include a method, in which the heat treatment is carried out before fine dispersion in a solid form, e.g., heating the dye powder in the solvent, a method, in which the dye dispersed by not cooling or by applying heat when dispersing it in water or other solvents in the presence of a dispersant, and a method, in which a liquid obtained by dispersion or a coating composition is subjected to the heat treatment, and among these, it is particularly preferable that the heat treatment be carried out after dispersion.

In the case where multiple kinds of the solid fine particle dispersions containing the dye represented by the general formula (I) are used in the particular layers, it is sufficient that at least one kind thereof be subjected to the heat treatment.

The pH upon dispersion and the heat treatment after dispersion may be those wherein the dispersion can be present in stable conditions, and the pH is preferably from 2.0 to 8.0, more preferably from 2.0 to 6.5, and further preferably 2.5 or more and less than 4.5. The pH during the heat treatment is preferably in the range from the standpoint of improvement of the film strength of the coated layer.

The pH of the dispersion can be adjusted, for example, with sulfuric acid, hydrochloric acid, acetic acid, citric acid, phosphoric acid, oxalic acid, carbonic acid, sodium hydrogencarbonate, sodium carbonate, sodium hydroxide, potassium hydroxide and a buffer solution formed therewith.

The temperature of the heat treatment cannot be determined unconditionally because it varies depending on the process step of the heat treatment, the size and the shape of the powder or the particles, the conditions for the heat treatment, and the solvent. The temperature may be in such a range that is 40° C. or more but less than the temperature, at which the dye is decomposed. In the case where the heat treatment is applied to the powder, the temperature is suitably from 40 to 200° C., and preferably from 50 to 150°

C. In the case where the heat treatment is applied in the solvent, the temperature is suitably from 40 to 150° C., and preferably from 50 to 150° C. In the case where the heat treatment is applied to the dispersion, the temperature is suitably from 40 to 90° C., and preferably from 50 to 90° C. In the case where the heat treatment is applied to the dispersion after dispersing, the temperature is suitably from 40 to 100° C., and preferably from 50 to 95° C. When the temperature of the heat treatment is less than 40° C., it is not preferable since the effect becomes poor.

In the case where the heat treatment is applied in a solvent, the kind of the solvent is not particularly limited as far as it does substantially not dissolve the dye. Examples thereof include water, an alcohol (such as methanol, ethanol, isopropyl alcohol, butanol, isoamyl alcohol, octanol, ethylene glycol, diethylene glycol and ethylcellosolve), a ketone (such as acetone and methyl ethyl ketone), an ester (such as ethyl acetate and butyl acetate), an alkylcarboxylic acid (such as acetic acid and propionic acid), a nitrile (such as acetonitrile), an ether (such as dimethoxyethane, dioxane and tetrahydrofuran), and an amide (such as dimethylformamide).

Even in the case where the sole solvent among these dissolves the dye, it can be used if the dye is substantially not dissolved therein by mixing with water or other solvents or by adjusting the pH.

The period of time for the heat treatment also cannot be determined unconditionally, and when the temperature is lower, a long period is required, whereas the temperature is higher, a short period may be sufficient. The period can be arbitrarily set in a range, in which the heat treatment can be carried out without any adverse affect on production process, and in general, it is preferably from 1 hour to 4 days.

The layer containing the fine particles of the dye is provided in the photographic photosensitive material in such a manner that the thus resulting fine particles are dispersed in a suitable binder to form a solid dispersion of substantially uniform particles, and it is then coated on a desired support.

The binder is not particularly limited as it is a hydrophilic colloid that can be used in the photosensitive emulsion layer and the non-photosensitive layer, and in general, gelatin and a synthetic polymer, such as polyvinyl alcohol and polyacrylamide, are used.

The fine particles in the solid dispersion generally have an average particle diameter of from 0.005 to 10 $\mu$m, preferably from 0.01 to 1 $\mu$m, and more preferably from 0.01 to 0.7 $\mu$m. The particle diameter in the range is preferable from the standpoint of non-aggregation property and absorption efficiency of light. The solid fine particle dispersion of the dye of the general formula (I) that is preferably used in the invention can be used solely or in combination with multiple solid fine particle dispersions.

The hydrophilic colloid layer, to which the solid fine particles are to be added, may be only one layer or multiple layers. Examples thereof include the case where the single solid fine particle dispersion is added to only one layer, the case where it is added to multiple layers through dividing, the case where multiple solid fine particle dispersions are simultaneously added to only a single layer, and the case where they are added to the different layers, but the invention is not limited to these cases.

Furthermore, it is possible that the solid fine particle dispersion is added to the anti-halation layer in the necessary amount, and may also be added to the photosensitive silver halide emulsion layer in the necessary amount for preventing irradiation.

The hydrophilic colloid layer containing the solid fine particle dispersion of the dye represented by general formula (I) that is preferably used in the invention is provided between the support and the silver halide emulsion layer that is the nearest to the support. Between the support and the silver halide emulsion layer that is the nearest to the support, a non-photosensitive hydrophilic colloid layer may also be provided in addition to the hydrophilic colloid layer containing the solid fine particle dispersion.

The solid fine particle dispersion of the dye that can be preferably used in the invention is contained in the non-photosensitive hydrophilic colloid layers of the silver halide photographic photosensitive material corresponding to the hue of the dye, and in an embodiment where multiple non-photosensitive layers are provide, the solid fine particle dispersion may be contained in the multiple layers.

The dye concentration of the solid fine particle dispersion that can be preferably used in the invention is suitably from 0.1 to 50% by weight, and preferably from 2 to 30% by weight. The dye concentration is preferably in the range from the standpoint of the viscosity of the dispersion. The coating amount of the solid fine particle dye is preferably about 0.05 to 0.5 g/m$^2$.

In the invention, it is preferable that the compound represented by the following general formula (VI) and the solid fine particle dispersion are contained in the same photographic constituting layer.

$$P—((S)m—R)n \qquad (VI)$$

In the general formula (VI), R represents a hydrogen atom, a hydrophobic group or a hydrophobic polymer; P represents a polymer that contains at least one of the following constituting layer units A, B and C and has a polymerization degree of from 10 to 3,500; n represents 1 or 2; and m represents 1 or 0.

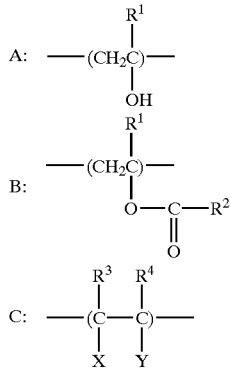

In the formulae, $R^1$ represents —H or an alkyl group having from 1 to 6 carbon atoms; $R^2$ represents —H or an alkyl group having from 1 to 10 carbon atoms; $R^3$ represents —H or —$CH_3$; $R^4$ represents —H, —$CH_3$, —$CH_2COOH$ (including ammonium and metallic salts) or —CN; X represents —H, —COOH (including ammonium and metallic salts) or —$CONH_2$; and Y represents —COOH (including ammonium and metallic salts), —$SO_3H$ (including ammonium and metallic salts), —$OSO_3H$ (including ammonium and metallic salts), —$CH_2SO_3H$ (including ammonium and metallic salts), —$CONHC(CH_3)_2CH_2SO_3H$ (including ammonium and metallic salts) or —$CONHCH_2CH_2CH_2N^+(CH_3)_3Cl^-$.

The details of the compound represented by general formula (VI) that can be preferably used in the invention (e.g., specific descriptions, preferable limitations, example compounds, using amounts and synthesis methods) are disclosed in JP-A No. 11-95371, page 24, column 46, line 27 to page 33, column 63, line 2 (paragraphs 0090 to 0128), which are incorporated herein by reference.

The photographic layers of the silver halide color photographic photosensitive material of the invention will be described.

The silver halide color photographic photosensitive material of the invention is a silver halide color photographic photosensitive material having a transmitting support, and is a silver halide color photographic photosensitive material that contains, on the support, at least one photosensitive layer formed with multiple silver halide emulsion layers having substantially different color sensitivities. The invention can be applied to an ordinary color photosensitive material and a cinematographic color photosensitive material, such as a color negative film, a positive film, a cinematographic color negative film, a color positive film and a cinematographic positive film.

It is particularly preferable that the invention be applied to a cinematographic color positive photosensitive material.

The photographic additives that can be used in the invention are disclosed in the publications of Research Disclosure (RD), and the related portions thereof are shown in the following table.

| | Kind of Additive | RD 17643 | RD 18716 | RD 307105 |
|---|---|---|---|---|
| 1 | Chemical Sensitizer | p. 23 | p. 648, right column | p. 866 |
| 2 | Sensitivity Increasing Agent | | p. 648, right column | |
| 3 | Spectral Sensitizer and Strengthening Sensitizer | pp. 23–24 | p. 648, right column to p. 649, right column | pp. 866–868 |
| 4 | Brightening Agent | p. 24 | p. 647, right column | p. 868 |
| 5 | Light Absorbent, Filter Dye and UV Absorbent | pp. 25–26 | p. 649, right column to p. 650, left column | p. 873 |
| 6 | Binder | p. 26 | p. 651, left column | pp. 873–874 |
| 7 | Plasticizer and Lubricant | p. 27 | p. 650, right column | p. 876 |
| 8 | Coating Assistant and Surface Active Agent | pp. 26–27 | p. 650, right column | pp. 875–876 |
| 9 | Static Preventing Agent. | p. 27 | p. 650, right column | pp. 876–877 |
| 10 | Matting agent | | | pp. 878–879 |

In the photosensitive material of the invention, various kinds of dye forming couplers, and the following dye forming couplers are particularly preferably used.

Examples of the yellow coupler include the couplers represented by formulae (I) and (II) in EP No. 502,424A; the couplers represented by formulae (1) and (2) in EP No. 513,496A (particularly Y-28 in page 18); the couplers represented by general formula (I) of claim 1 of JP-A No. 5-307248; the couplers represented by general formula (I) in column 1, lines 45 to 55 of U.S. Pat. No. 5,066,576; the couplers represented by general formula (I) in paragraph 0008 of JP-A No. 4-274425; the couplers disclosed in claim 1 of EP No. 498,381A1, page 40 (particularly D-35 in page 18); the couplers represented by formula (Y) disclosed in EP No. 447,969A1, page 4 (particularly Y-1 (in page 17) and Y-54 (in page 41)); and the couplers represented by formulae (II) to (IV) disclosed in U.S. Pat. No. 4,476,219, column 7, lines 36 to 58 (particularly II-17 and II-19 (in column 17) and II-24 (in column 19)).

Examples of the magenta coupler include those disclosed in JP-A No. 3-39737 (L-57 (right lower column of page 11), L-68 (right lower column of page 12) and L77 (right lower column of page 13)); those disclosed in EP No. 456,257 (A-4-63 (page 134), and A-4-73 and A-4-75 (page 139)); M-4 and M-6 (page 26) and M-7 (page 27) of EP No. 486,965; M-45 in paragraph 0024 of JP-A No. 6-43611; M-1 in paragraph 0036 of JP-A No. 5-204106; and M-22 in paragraph 0237 of JP-A No. 4-362631.

Examples of the cyan coupler include CX-1, 3, 4, 5, 11, 12, 14 and 15 (pages 14 to 16) of JP-A No. 4-204843; C-7 and C-10 (page 35), C-34 and C-35 (page 37), (I-1) and (I-17) (pages 42 and 43) of JP-A No. 4-43345; and the couplers represented by general formula (Ia) or (Ib) in claim 1 of JP-A No. 6-67385.

Examples of the polymer coupler include P-1 and P-5 (page 11) of JP-A No. 2-44345, and couplers disclosed in JP-A No. 5-313324 and No. 6-347906.

Examples of the infrared coupler for forming a sound track include the couplers disclosed in JP-A No. 63-143546 and the patent publications cited therein.

As a coupler having a coloring dye with suitable diffusibility, those disclosed in U.S. Pat. No. 4,366,237, British Patent No. 2,125,570, EP No. 96,873B and DE No. 3,234,533 are preferable.

Preferable examples of the coupler for compensating unnecessary absorption of the coloring dye include the yellow colored cyan couplers represented by formulae (CI), (CII), (CIII) and (CIV) in EP No. 456,257A1, page 5 (particularly YC-86 in page 84); the yellow colored magenta couplers ExM-7 (page 202), EX-1 (page 249) and EX-7 (page 251) disclosed in the EP publication; the magenta colored cyan couplers CC-9 (column 8) and CC-13 (column 10) disclosed in U.S. Pat. No. 4,833,069; (2) (column 8) in U.S. Pat. No. 4,837,136; and the colorless masking coupler represented by formula (A) in claim 1 of WO92/11575 (particularly the example compounds shown in pages 36 to 45).

Examples of the compound (including couplers) that releases a photographically useful residual group upon reaction with an oxidized product of a developer include the following. Examples of the development suppressor releasing compound include the compounds represented by formulae (I), (II), (III) and (IV) disclosed in EP No. 378,236A1, page 11 (particularly T-101 (page 30), T-104 (page 31), T-113 (page 36), T-131 (page 45), T-144 (page 51) and T-158 (page 58)), the compounds represented by formula (I) in EP No. 436,938A2, page 7 (particularly D-49 (page 51)), the compounds represented by formula (1) in JP-A No. 5-307248 (particularly (23) in paragraph 0027), and the compounds represented by formulae (I), (II) and (III) in EP No. 440,195A2, pages 5 and 6 (particularly I-(1) in page 29). Examples of the bleaching accelerator releasing compound include the compounds represented by formulae (I) and (I') in EP No. 310,125A2, page 5 (particularly (60) and (61) in page 61) and the compounds represented by formula (I) in claim 1 of JP-A No. 6-59411 (particularly (7) in paragraph 0022). Examples of the ligand releasing compound include the compounds represented by LIG-X disclosed in claim 1 of U.S. Pat. No. 4,555,478 (particularly the compounds disclosed in column 12, lines 21 to 41). Examples of the leuco dye releasing compound include the compounds 1 to 6 disclosed in columns 3 to 8 of U.S. Pat. No. 4,749,641. Examples of the fluorescent dye releasing compound include the compounds represented by COUP-DYE in claim 1 of U.S. Pat. No. 4,774,181 (particularly the compounds 1 to 11 in columns 7 to 10). Examples of the developing accelerator and a fogging agent releasing compound include the compounds represented by formulae (1), (2) and (3) disclosed in column 3 of U.S. Pat. No. 4,656,123 (particularly (I-22) in column 25) and ExZK-2 disclosed in EP No. 450,637A2, page 75, lines 36 to 38. Examples of the compound that releases such a group that becomes a dye upon releasing include the compounds represented by formula (I) in claim 1 of U.S. Pat. No. 4,857,447 (particularly Y-1 to Y-19 in columns 25 to 36).

Preferable examples of the other additives than the couplers include the following.

Examples of the dispersion medium of the lipophilic organic compound include P-3, 5, 16, 19, 25, 30, 42, 49, 54, 55, 66, 81, 85, 86 and 93 disclosed in JP-A No. 62-215272 (pages 140 to 144). Examples of the scavenger for the oxidized product of the developing agent include the compounds represented by formula (I) in U.S. Pat. No. 4,978,606, column 2, lines 54 to 62 (particularly I-(1), (2), (6) and (12) (columns 4 to 5), and the compound represented by formula in U.S. Pat. No. 4,923,787, column 2, lines 5 to 10 (particularly compound 1 (column 3)). Examples of the stain preventing agent include the compound represented by formulae (I) to (III) in EP No. 298,321A, page 4, lines 30 to 33, particularly 1-47 and 72, and III-1 and 27 (pages 24 to 48). Examples of the discoloration preventing agent include A-6, 7, 20, 21, 23, 24, 25, 26, 30, 37, 40, 42, 48, 63, 90, 92, 94 and 164 in EP No. 298,321A (pages 69 to 118), II-1 to III-23 in U.S. Pat. No. 5,122,444, columns 25 to 38, particularly III-10, I-1 to III-4 in EP No. 471,347A, page 8 to 12, particularly II-2, and A-1 to 48 in U.S. Pat. No. 5,139,931, columns 32 to 40, particularly A-39 and A-42. Examples of the material that decreases the using amounts of the coloration enhancing agent and the color mixing preventing agent include I-1 to II-15 in EP No. 411,324A, pages 5 to 24, particularly I-46. Examples of the formalin scavenger include SCV-1 to 28 in EP No. 477,932A, pages 24 to 29, particularly SCV-8. Examples of the hardening agent include H-1, 4, 6, 8 and 14 in JP-A No. 1-214845, page 17, the compounds represented by formulae (VII) to (XII) in U.S. Pat. No. 4,618,573, columns 13 to 23 (H-1 to H-54), the compounds represented by formula (6) in JP-A No. 2-214852, page 8, right lower column (H-1 to H-76), particularly H-14, and the compounds disclosed in claim 1 of U.S. Pat. No. 3,325,287. Examples of the developing suppressor precursor include P-24, 37 and 39 in JP-A No. 62-168139 (pages 6 and 7), and the compounds disclosed in claim 1 of U.S. Pat. No. 5,019,492, particularly 28 to 29 in column 7. Examples of the antiseptic agent and the antifungal agent include I-1 to III-43 in U.S. Pat. No. 4,923,790, columns 3 to 15, particularly II-1, 9, 10 and 18 and III-25. Examples of the stabilizer and the fog preventing agent include I-1 to (14) in U.S. Pat. No. 4,923,793, columns 6 to 16, particularly I-1 and 60, (2) and (13), and the compounds 1 to 65 in U.S. Pat. No. 4,952,483, columns 25 to 32, particularly the compound 36. Examples of the chemical sensitizer include triphenylphosphine selenide and the compound 50 disclosed in JP-A No. 5-40324. Examples of the dye include a-1 to b-20 in JP-A No. 3-156450, pages 15 to 18, particularly a-1, 12, 18, 27, 35 and 36 and b-5, V-1 to 23 in ditto, pages 27 to 29, particularly V-1, F-I-1 to F-II-43 in EP No. 445,627A, pages 33 to 55, particularly F-I-11 and F-II-8, III-1 to 36 in EP No. 457,153A, pages 17 to 28, particularly III-1 and 3, fine crystal dispersions of Dye-1 to 124 in WO88/04794, pages 8 to 26, the compounds 1 to 22 in EP No. 319,999A, pages 6 to 11, particularly the compound 1, the compounds D-1 to 87 (pages 3 to 28) represented by formulae (1) to (3) in EP No. 519,306A, the compounds 1 to 22 (columns 3 to 10) represented by formula (I) in U.S. Pat. No. 4,268,622, and the compounds (1) to (31) (columns 2 to 9) represented by formula (1) in U.S. Pat. No. 4,923,788. Examples of the UV absorbent include the compounds (18b) to (18r) and 101 to 427 (pages 6 to 9) represented by formula (1) in JP-A No. 46-3335, the compounds (3) to (66) (pages 10 to 44) represented by formula (I) and the compounds HBT-1 to HBT-10 (page 14) represented by formula (III) in EP No. 520,938A, and the compounds (1) to (31) (columns 2 to 9) represented by formula (1) in EP No. 521,823A.

The silver halide color photographic photosensitive material of the invention preferably has a total thickness of all the hydrophilic colloid layers formed on the side where the emulsion layers are formed of 28 μm or less, more preferably 23 μm or less, further preferably 18 μm or less, and particularly preferably 16 μm or less. The film swelling rate T1/2 is preferably 30 seconds or less, and more preferably 20 seconds or less. T1/2 is defined in such a manner that when 90% of the maximum swelled film thickness attained upon processing with a coloring developer at 30° C. for 3 minutes and 15 seconds is referred to as a saturated film thickness, the period of time until the film thickness reaches ½ thereof is designated as T1/2. The film thickness herein means a film thickness after conditioning at 25° C. and 55% RH for 2 days, and T1/2 can be measured by using a swellometer of the model disclosed in A. Green, "Photographic Sci. Eng.", vol. 19(2), pp. 124–129. The value T1/2 can be adjusted by adding a hardening agent to gelatin as a binder or by changing the time-lapse conditions after coating. The swelling ratio is preferably from 150 to 400%. The swelling ratio can be calculated by using the maximum swelled film thickness under the conditions described above according to the equation, ((maximum swelled film thickness)-(film thickness))/(film thickness).

The swelling ratio herein is a measure of an equivalent swelled amount when the silver halide photographic photosensitive material of the invention is swelled by immersing in distilled water at 35° C., and is defined by the following equation.

$$\text{swelling ratio (\%)} = (\text{total thickness upon swelling})/(\text{dried total thickness}) \times 100$$

The swelling ration is preferably from 170 to 280%, and more preferably from 190 to 250%.

The swelling ratio can be controlled to the foregoing range by adjusting the addition amount of a gelatin hardener.

The support will be described below.

Examples of a plastic film support include films of polyethylene terephthalate, polyethylene naphthalate, cellulose triacetate, cellulose acetate butyrate, cellulose acetate propionate, polycarbonate, polystyrene and polyethylene.

Among these, a polyethylene terephthalate film is preferable, and a polyethylene terephthalate film having been subjected to biaxial stretching and thermal fixing is particularly preferable from the standpoint of stability and toughness.

The thickness of the support is not particularly limited, and is generally in a range of from 15 to 500 μm, and those having a thickness of from 40 to 200 μm are preferable since they are advantageous in easy handling and versatility, with a range of from 100 to 150 μm being most preferable. The transmitting support is preferably a support that transmits 90% or more of visible light, and may contain dyed silicon, alumina sol, a chromium salt and a zirconium salt in such an amount that does not substantially impair transmission of light.

In order that the photosensitive layer is firmly adhered on the surface of the plastic film support, the following surface treatment is generally carried out. The surface of the support, on which a charge preventing layer (back layer) is to be formed, is generally subjected to the similar surface treatment.

Examples of the surface treatment include:

(1) a method in which a surface activation treatment, such as a chemical treatment, a mechanical treatment, a corona discharge treatment, a flame treatment, an ultraviolet ray treatment, a high frequency radiation treatment, a glow discharge treatment, an activated plasma treatment, a laser treatment, a mixed acid treatment and an ozone and oxygen treatment, is carried out, and then the photographic emulsion (coating composition for forming photosensitive layer) is directly coated to obtain an adhesive force, and (2) a method in which after applying the foregoing surface treatment, an undercoating layer is provided, and the photographic emulsion layer is coated on the undercoating layer.

Among these methods, the method (2) is more effective and has been frequently practiced. It is believed that the surface treatment enhances the adhesion force by forming a certain amount of polar groups on the surface of the support, which is inherently hydrophobic, by removing a thin layer that becomes a negative factor with respect to adhesion on the surface, and by increasing the crosslinking density on the surface. As a result, the affinity of the components contained in the coating composition for the undercoating layer with the polar group is increased, and the fastness of the adhesion surface is increased, whereby the adhesion property between the undercoating layer and the surface of the support is improved.

On the surface of the plastic film support on which the photosensitive layer is not provided, a non-photosensitive layer containing electroconductive metallic oxide particles of the invention (the charge preventing layer of the invention) is provided.

As a binder used in the non-photosensitive layer, an acrylic resin, a vinyl resin, a polyurethane resin and a polyester resin are preferably used. The non-photosensitive layer in the invention is preferably hardened, and examples of a hardening agent include those of an aziridine series, a triazine series, a vinylsulfone series, an aldehyde series, a cyanoacrylate series, a peptide series, an epoxy series and a melamine series. A melamine series compound is particularly preferable from the standpoint of firm fixation of the electroconductive metallic oxide particles.

Examples of the material of the electroconductive metallic oxide particles include ZnO, $TiO_2$, $SnO_2$, $Al_2O_3$, $In_2O_3$, MgO, BaO, $MoO_3$, $V_2O_5$, a composite oxide thereof, and a metallic oxide containing these metallic oxides and a heterogeneous atom.

As the metallic oxide, $SnO_2$, ZnO, $Al_2O_3$, $TiO_2$, $In_2O_3$, MgO and $V_2O_5$ are preferable, $SnO_2$, ZnO, $In_2O_3$, $TiO_2$ and $V_2O_5$ are more preferable, and $SnO_2$ and $V_2O_5$ are particularly preferable. Examples of those containing a small amount of a heterogeneous atom include ZnO doped with Al or In, $TiO_2$ doped with Nb or Ta, $In_2O_3$ doped with Sn, and $SnO_2$ doped with Sb, Nb or a halogen atom, in an amount of the heterogeneous atom of from 0.01 to 30% by mole (preferably from 0.1 to 10% by mole). When the addition amount of the heterogeneous atom is less than 0.01% by mole, sufficient electroconductivity cannot be imparted to the oxide or composite oxide, and when the amount exceeds 30% by mole, it is not preferable since the blackness degree of the particles is increased to make the charge preventing layer blackish. Therefore, as the material for the electroconductive metallic oxide particles, a metallic oxide or a composite metallic oxide containing a small amount of a heterogeneous atom is preferable. Those having oxygen defects in the crystalline structure thereof are also preferable.

The volume ratio of the electroconductive metallic oxide particles based on the total non-photosensitive layer is necessarily 50% or less, and preferably from 3 to 30%. The coated amount thereof is preferably from 1 to 300 $mg/m^2$, more preferably from 2 to 200 $mg/m^2$, and most preferably from 100 to 250 $mg/m^2$.

When the volume ratio exceeds 50%, contaminants easily adhere to the surface of the processed color print, and when it is less than 3%, the charge preventing function cannot be sufficiently exerted.

The particle diameter of the electroconductive metallic oxide particles are preferably as small as possible to decrease light scattering as much as possible, and is to be determined with the refractive indexes of the particles and the binder as a parameter, which can be obtained according to Mie's theory. The average particle diameter is generally in a range of from 0.001 to 0.5 $\mu$m, and preferably in a range of from 0.003 to 0.2 $\mu$m. The average particle diameter herein is a value including not only the particle size of the primary particles of the electroconductive metallic oxide particles, but also the particle diameter of higher order structures.

when adding the fine particles of the metallic oxide to the coating composition for forming the charge preventing layer, they may be added as they are and dispersed, and it is preferable that they are added in the form of a dispersion obtained by dispersing them in a solvent, such as water (which may contain a dispersing agent and a binder depending on necessity).

The non-photosensitive layer preferably contains a hardened product of the binder and the hardening agent as the binder that disperses and binds the electroconductive metallic oxide particles. It is preferable in the invention that both the binder and the hardening agent are water soluble or are used in the form dispersed in water, such as an emulsion, from the standpoint of maintenance of good working environments and prevention of air pollution. The binder preferably has one of a methylol group, a hydroxyl group, a carboxyl group and a glycidyl group in order to enable crosslinking reaction with the hardening agent. Among these, a hydroxyl group and a carboxyl group are preferable, and a carboxyl group is particularly preferable. The amount of a hydroxyl group or a carboxyl group contained in the binder is preferably from 0.0001 to 1 equivalent per 1 kg, and particularly preferably from 0.001 to 1 equivalent per 1 kg.

The resins that can be preferably used as the binder will be described.

Examples of the acrylic resin include a homopolymer of a monomer selected from acrylic acid, an acrylate ester, such as alkyl acrylate, acrylamide, acrylonitrile, methacrylic acid, a methacrylate ester, such as alkyl methacrylate, methacrylamide and methacrylonitrile, and a copolymer obtained by polymerization of two or more kinds of the monomers. Among these, homopolymers of monomers selected from an acrylate ester, such as alkyl acrylate and a methacrylate ester, such as alkyl methacrylate, and a copolymer obtained by polymerization of two or more kinds of the monomers are preferable. Examples thereof include homopolymers of monomers selected from an acrylate ester or methacrylate ester having an alkyl group having from 1 to 6 carbon atoms, and a copolymer obtained by polymerization of two or more kinds of the monomers.

The acrylic resin preferably contains the foregoing composition as a main component and is preferably a polymer obtained by partly using a monomer having a group selected, for example, from a methylol group, a hydroxyl group, a carboxyl group and a glycidyl group, in order to enable crosslinking reaction with the hardening agent.

Examples of the vinyl resin include polyvinyl alcohol, acid modified polyvinyl alcohol, polyvinyl formal, polyvinyl butyral, polyvinyl methyl ether, polyolefin, an ethylene-butadiene copolymer, polyvinyl acetate, a vinyl chloride-vinyl acetate copolymer, a vinyl chloride-(meth)acrylate ester copolymer and an ethylene-vinyl acetate copolymer (preferably an ethylene-vinyl acetate-(meth)acrylate ester copolymer). Among these, polyvinyl alcohol, acid modified polyvinyl alcohol, polyvinyl formal, polyolefin, an ethylene-butadiene copolymer and an ethylene-vinyl acetate copolymer (preferably an ethylene-vinyl acetate-(meth)acrylate ester copolymer) are preferable.

In order that the vinyl resin can exert crosslinking reaction with the hardening agent, polyvinyl alcohol units, for example, are made remaining in the polymer, which is polyvinyl alcohol, acid modified polyvinyl alcohol, polyvinyl formal, polyvinyl butyral, polyvinyl methyl ether or polyvinyl acetate, so as to form a polymer containing a hydroxyl group. With respect to the other polymers, a monomer having one of a methylol group, a hydroxyl group, a carboxyl group and a glycidyl group is partly used to obtain the polymer.

Examples of the polyurethane resin include polyurethane derived from one of a polyhydroxy compound (such as ethylene glycol, propylene glycol, glycerin and trimethylolpropane), an aliphatic polyester polyol obtained through reaction of a polyhydroxy compound and a polybasic acid, a polyether polyol (such as poly(oxypropylene ether)polyol and poly(oxyethylene propylene ether)polyol), a polycarbonate polyol and a polyethylene terephthalate polyol or a mixture thereof with a polyisocyanate.

In the polyurethane resin, a hydroxyl group remaining, for example, as unreacted through the reaction between the polyol and the polyisocyante, an unreacted and remaining hydroxyl group can be used as a functional group capable of exerting crosslinking reaction with the hardening agent.

As the polyester resin, polymers obtained by reaction of a polyhydroxy compound (such as ethylene glycol, propylene glycol, glycerin and trimethylolpropane) and a polybasic acid can be generally used.

In the polyester resin, a hydroxyl group and a carboxyl group remaining, for example, as unreacted through the reaction between the polyol and the polybasic acid can be used as a functional group capable of exerting crosslinking reaction with the hardening agent. It is also possible that a third component having the functional group, such as a hydroxyl group, is added.

Among the polymers, an acrylic resin and a polyurethane resin are preferable, and an acrylic resin is particularly preferable.

Examples of a melamine compound that can be preferably used as the hardening agent include a compound having two or more (preferably three or more) methylol group and/or alkoxymethylol group in the melamine molecule, and a melamine resin and a melamine-urea resin, which are polycondensates of the compound.

Examples of the initial condensate of melamine and formalin include dimethylolmelamine, trimethylolmelamine, tetramethylolmelamine, pentamethylolmelamine and hexamethylolmelamine, and specific examples of commercially available products include SUMITEX RESIN M-3, MW, MK and MC (produced by Sumitomo Chemical Co., Ltd.), but the invention is not limited to them.

Examples of the polycondensate include a hexamethylolmelamine resin, a trimethylolmelamine resin and a trimethyloltrimethoxymethylmelamine resin. Examples of commercially available products include MA-1 and MA-204 (produced by Sumitomo Bakelite Co., Ltd.), BECKAMINE MA-S, BECKAMINE APM and BECKAMINE J-101 (produced by Dainippon Ink And Chemicals, Inc.), ULOID 344 (produced by Mitsui Chemical, Inc.) and OSHIKA RESIN M31 and OSHIKA RESIN PWP-8 (produced by Oshika Shinko Co., Ltd.), but the invention is not limited to these examples.

The melamine compound preferably has a functional group equivalent of from 50 to 300, which is a value obtained by dividing the molecular weight by the number of functional groups in one molecule. The functional group herein means a methylol group and/or an alkoxymethyl group. When the value exceeds 300, the hardened density is small to fail to obtain high strength, and when the amount of the melamine compound is increased, the coating property is lowered. When the hardened density is small, score marks are liable to be formed. When the extent of hardening is low, the force for maintaining the electroconductive metallic oxide is also lowered. When the functional group equivalent is less than 50, the hardened density is high, but the transparency is deteriorated, which is not improved by decreasing the amount.

The addition amount of the aqueous melamine compound is generally from 0.1 to 100% by weight, and preferably from 10 to 90% by weight, based on the polymer.

In the charge preventing layer, a matting agent, a surface active agent and a lubricant may also be used in combination depending on necessity.

Examples of the matting agent include an oxide, such as silicon oxide, aluminum oxide and magnesium oxide, and a polymer and a copolymer, such as polymethyl methacrylate and polystyrene, that have a particle diameter of from 0.001 to 10 $\mu$m.

Examples of the surface active agent include an anionic surface active agent, a cationic surface active agent, an amphoteric surface active agent and a nonionic surface active agent, which have been known in the art.

Examples of the lubricant include a phosphate ester of a higher alcohol having from 8 to 22 carbon atoms and an amino salt thereof; palmitic acid, stearic acid, behenic acid and an ester thereof; and a silicone compound.

The thickness of the charge preventing layer is preferably in a range of from 0.01 to 1 $\mu$m, and more preferably in a range of from 0.01 to 0.2 $\mu$m. When it is less than 0.01 $\mu$m, the coating composition is difficult to be coated uniformly to form coating unevenness in the products, and when it exceeds 1 $\mu$m, there are some cases where the charge preventing function and the scratch resistance are deteriorated.

A surface layer is preferably provided on the charge preventing layer. The surface layer is provided mainly for improving the lubricating property and the scratch resistance, and also for assisting the function of preventing release of the electroconductive metallic oxide particles of the charge preventing layer.

Examples of the material of the surface layer include (1) wax, a resin and a rubber material containing a homopolymer or a copolymer of a 1-olefin series unsaturated hydrocarbon, such as ethylene, propylene, 1-butene and 4-methyl-1-pentene (such as polyethylene, polypropylene, poly-1-butene, poly-4-methyl-1-pentene, an ethylene-propylene copolymer, an ethylene-1-butene copolymer and a propylene-1-butene copolymer), (2) a rubber copolymer of two or more kinds of the foregoing 1-olefin with a conjugated or non-conjugated diene (such as an ethylene-propylene-ethylidenenorbornene copolymer, an ethylene-propylene-1,5-hexadiene copolymer and an isobutene-isoprene copolymer), (3) a copolymer of the 1-olefin with a conjugated or non-conjugated diene (such as an ethylene-butadiene copolymer and an ethylene-ethylidenenorbornene copolymer), (4) a copolymer of the 1-olefin, particularly ethylene, with vinyl acetate, and a completely or partially saponified product thereof, and (5) a graft polymer obtained by grafting the conjugated or non-conjugated diene or vinyl acetate on a homopolymer or a copolymer of the 1-olefin, and a completely or partially saponified product thereof. The invention is not limited to them. The compounds are disclosed in JP-B No. 5-41656.

The polyolefin preferably contains a carboxyl group and/or a carboxylate salt group. It is generally used as an aqueous solution or an aqueous dispersion.

Water soluble methylcellulose having a methyl group substitution degree of 2.5 or less may be added to the surface layer, and the addition amount thereof is preferably from 0.1 to 40% by weight based on the total binder for forming the surface layer. The water soluble methylcellulose is disclosed in JP-A No. 1-210947.

The surface layer can be formed on the charge preventing layer of the invention by coating a coating composition (such as an aqueous dispersion or an aqueous solution) containing the binder and the other components according to a known coating method, such as a dip coating method, an air knife coating method, a curtain coating method, a wire bar coating method, a gravure coating method and an extrusion coating method.

The thickness of the surface layer is preferably in a range of from 0.01 to 1 $\mu$m, and more preferably in a range of from 0.01 to 0.2 $\mu$m. When it is less than 0.01 $\mu$m, the coating composition is difficult to be coated uniformly to form coating unevenness in the products, and when it exceeds 1 $\mu$m, there are some cases where the charge preventing function and the scratch resistance are deteriorated.

The film pH of the photosensitive material of the invention is preferably from 4.6 to 6.4, and more preferably from 5.5 to 6.3.

The film pH of the silver halide color photographic photosensitive material of the invention is the pH of all the photographic layers obtained by coating the coating compositions on the support, which does not necessarily agree with the pH of the coating compositions. The film pH can be measured in the following method described in JP-A No. 61-245153. That is, (1) 0.05 ml of pure water is dropped on the surface of the photosensitive material, on which the silver halide emulsions are coated; and then (2) after allowing to stand for 3 minutes, the film pH is measured with a surface pH measurement electrode (GS-165F, produced by Toa Electronics Ltd.). The film pH can be adjusted depending on necessity with an acid (such as sulfuric acid and citric acid) or an alkali (such as sodium hydroxide and potassium hydroxide).

A non-decolorizable colorant used in the invention is such a material that is not eluted or decolored upon developing process, but the light absorbing characteristics thereof in the film are substantially not change before and after the processing. The material is not particularly limited, and various kinds of dyes and pigments including known substances can be used.

Examples of the known dye include an oxonol dye, an azomethine dye, an azo dye, a benzoquinone dye, a naphthoquinone dye, an anthraquinone dye, an arylidene dye, a styryl dye, a diphenylmethane dye, a triphenylmethane dye, a xanthene dye, an acridine dye, an azine dye, an oxazine dye, a thiazine dye, a perynone dye, a merocyanine dye, a cyanine dye, an indoaniline dye, a phthalocyanine dye, an indigo dye and a thioindigo dye.

Examples of the pigment include an organic pigment, such as an azo pigment (such as an insoluble monoazo pigment, an insoluble disazo pigment, an azo lake pigment, a condensed azo pigment and a metallic complex azo pigment), a phthalocyanine pigment, a dyeing lake pigment (such as an acidic dyeing lake and a basic dyeing lake), a condensed polycyclic pigment (such as a quinacridone pigment, a thioindigo pigment, a perylene pigment, an anthraquinone pigment, a perynone pigment, a dioxazine pigment, an isoindolinone pigment and a diketopyrrolopyrrol pigment) and other pigments (such as a nitroso pigment, an alizarine lake pigment and alkali blue).

Specific compounds thereof are disclosed in "Shinban Senryo Binran" (New Dye Handbook) (edited by Society of Synthetic Organic Chemistry, Japan, Maruzen, 1970), "Color Index" (The Society of Dyers and Colorists), "Shikizai Kogaku Handobukku" (Color Materials Handbook) (edited by Japan Society of Colour Material, Asakura Shoten, 1989), and "Kaitei Shinban Ganryo Binran" (Revised New Pigment Handbook).

Preferable specific examples of the dyes and the pigments include D-1 to D-35 and P1 to P-30 disclosed in JP-A No. 11-95371, paragraphs 0191 to 0250. The method for adding them into the photosensitive material is also disclosed in detail in paragraphs 0206 to 0215 of that publication, which are incorporated herein by reference.

The photosensitive material of the invention also has suitability for rapid processing, and even when the coloring developing time is 2 minutes and 30 second or less, and more preferably 2 minutes or less, (with the lower limit thereof being 6 seconds or more, more preferably 10 seconds or more, further preferably 20 seconds or more, and most preferably 30 seconds or more), the effect of the invention is notable and preferable.

In the case where a sound track is formed by a colorant image, the steps of first fixing bath 6, water washing bath 7, sound development 12 and water washing 13 can be omitted from the ECP-2 process disclosed in Example 1 later, which is a considerably preferable example in simplification of the process. Furthermore, by omitting a resin back layer, the steps of prebath 1 and water washing bath 2 can be omitted.

The photosensitive material of the invention can exert excellent performance in such processing steps.

EXAMPLES

The invention will be specifically described with reference to the following examples, but the invention is not construed as being limited thereto.

Example 1

Preparation of Support

An undercoating layer was formed on a surface for forming emulsion layers thereon, and an acrylic resin layer containing the following electroconductive polymer (0.05 g/m$^2$) and tin oxide fine particles (0.20 g/m$^2$) was coated on the surface opposite to the surface for forming emulsion layers thereon, so as to prepare a polyethylene terephthalate film support (thickness: 120 $\mu$m).

Electroconductive Polymer

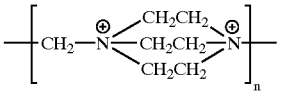

Preparation of Silver Halide Emulsion

Preparation of Blue-Sensitive Silver Halide Emulsion

Large Size Emulsion (B1)

32 g of lime treated gelatin was added to 1,000 ml of distilled water, and after dissolving at 40° C., 3.3 g of sodium chloride was added thereto, followed by increasing the temperature to 74° C. 1.2 ml of N,N'-dimethylimidazolidin-2-thione (1% aqueous solution) was added to the solution. Subsequently, a solution obtained by dissolving 11.0 g of sodium chloride in 200 ml of distilled water was added and mixed to a solution obtained by dissolving 32.0 g of silver nitrate in 200 ml of distilled water over 14 minutes, while the solutions were maintained at 74° C. A solution obtained by dissolving 128.0 g of silver nitrate in 560 ml of distilled water and a solution obtained by dissolving 44.0 g of sodium chloride, 2.24 g of potassium bromide and $5.65\times10^{-6}$ mole of potassium hexachloroiridate (IV) in 560 ml of distilled water were further added and mixed thereto over 40 minutes while the solutions were maintained at 74° C. After subjecting desalting and water washing at 40° C., 90.0 g of lime treated gelatin was added thereto, and the pAg and pH were adjusted to 7.5 and 6.8, respectively, with sodium chloride and sodium hydroxide. Subsequently, the sensitizing dyes A, B and C represented by the structural formulae shown later were added in amounts of $3.5\times10^{-5}$, $2.4\times10^{-4}$ and $1.8\times10^{-4}$ mole per one mole of silver halide, and then gold sulfur sensitization was suitably carried out at 65° C. by using triethylthio urea and aurichloric acid. The thus resulting silver chlorobrimide emulsion was designated as an emulsion B1.

The shape, the size and the particle size distribution of the particles were obtained from an electron micrograph. The particle size was expressed by an average value of the diameters of circles that were equivalent to the projected areas of the particles, and the particle size distribution was expressed by a value obtained by dividing the standard deviation of the particle diameter by the average particle size.

As a result, the particles were cubic particles having a particle size of 0.71 μm and a particle size distribution of 0.09 and containing 2.0% by mole of Br.

Intermediate Size Emulsion (B2)

(cubic particles, particle size: 0.52 μm, particle size distribution: 0.09, halogen composition: Br/Cl=2/98)

A silver nitrate aqueous solution and a mixed aqueous solution of sodium chloride and potassium bromide were added to each other by the control double jet process, which had been known in the art, to prepare the emulsion. The iridium content was controlled to $6\times10^{-6}$ mole per mole of silver. The sensitizing dyes (A to C) represented by the structural formulae shown later were added to the emulsion in the following amounts.

Blue sensitizing dye (A): $4.6\times10^{-5}$ mole per mole of silver

Blue sensitizing dye (B): $4.6\times10^{-4}$ mole per mole of silver

Blue sensitizing dye (C): $2.7\times10^{-5}$ mole per mole of silver

Furthermore, gold sulfur sensitization was suitably carried out by using aurichloric acid and triethylthio urea.

Small Size Emulsion (B3)

(cubic particles, particle size: 0.31 μm, particle size distribution: 0.08, halogen composition: Br/Cl=1.8/98.2)

The same procedures as in the preparation of the emulsion B2 were carried out except that the particle forming temperature was decreased, so as to produce an emulsion B3.

The sensitizing dyes (A to C) represented by the structural formulae shown later were added to the emulsion in the following amounts.

Blue sensitizing dye (A): $1.2\times10^{-4}$ mole per mole of silver

Blue sensitizing dye (B): $4.9\times10^{-4}$ mole per mole of silver

Blue sensitizing dye (C): $6.0\times10^{-5}$ mole per mole of silver

Furthermore, emulsions B4, B5 and B6 were prepared in the same manner as in the preparation of the emulsions B1, B2 and B3 except that the halogen composition was changed to those disclosed in Table 10.

Preparation of Red-sensitive Silver Halide Emulsion

Large Size Emulsion (R1)

(cubic particles, particle size: 0.23 μm, particle size distribution: 0.11, halogen composition: Br/Cl=3/97)

A silver nitrate aqueous solution and a mixed aqueous solution of sodium chloride and potassium bromide were added to each other by the control double jet process, which had been known in the art, to prepare the emulsion. The sensitizing dyes (H) and (I) represented by the structural formulae shown later were added to the emulsion in the following amounts to carry out spectral sensitization.

Red sensitizing dye (H): $3.1\times10^{-5}$ mole per mole of silver

Red sensitizing dye (I): $1.8\times10^{-5}$ mole per mole of silver

Furthermore, gold sulfur sensitization was suitably carried out by using aurichloric acid and triethylthio urea, and then Cpd-31 represented by the structural formula shown later was added in an amount of $9.0\times10^{-4}$ mole per one mole of silver halide.

Intermediate Size Emulsion (R2)

(cubic particles, particle size: 0.174 μm, particle size distribution: 0.12, halogen composition: Br/Cl=2/98)

The same procedures as in the preparation of the emulsion R1 were carried out except that the particle forming temperature was changed and potassium hexachloroiridate(IV) was added to produce an emulsion R2. The sensitizing dyes (H and I) represented by the structural formulae shown later were added to the emulsion in the following amounts according to the same manner as in the emulsion R1.

Red sensitizing dye (H): $4.3\times10^{-5}$ mole per mole of silver

Red sensitizing dye (I): $2.3\times10^{-5}$ mole per mole of silver

Small Size Emulsion (R3)

(cubic particles, particle size: 0.121 μm, particle size distribution: 0.13, halogen composition: Br/Cl=3/97)

The same procedures as in the preparation of the emulsion R1 were carried out except that the particle forming temperature was changed and potassium hexachloroiridate(IV) was added to produce an emulsion R2. The sensitizing dyes (H and I) represented by the structural formulae shown later were added to the emulsion in the following amounts according to the same manner as in the emulsion R1.

Red sensitizing dye (H): $5.5\times10^{-5}$ mole per mole of silver

Red sensitizing dye (I): $3.6\times10^{-5}$ mole per mole of silver

Furthermore, emulsions R4, R5 and R6 were prepared in the same manner as in the preparation of the emulsions R1, R2 and R3 except that the halogen composition was changed to those disclosed in Table 10.

| Emulsion | Halogen Composition | Particle Size (sphere equivalent) | Ir Compound |
|---|---|---|---|
| B1 | Silver chlorobromide having silver chloride content of 98.0% by mole | 0.71 μm | $K_2(IrCl_6)$ |
| B2 | Silver chlorobromide having silver chloride content of 98.0% by mole | 0.52 μm | $K_2(IrCl_6)$ |
| B3 | Silver chlorobromide having silver chloride content of 98.2% by mole | 0.31 μm | $K_2(IrCl_6)$ |
| B4 | Silver chlorobromide having silver chloride content of 75.0% by mole | 0.71 μm | $K_2(IrCl_6)$ |
| B5 | Silver chlorobromide having silver chloride content of 75.0% by mole | 0.52 μm | $K_2(IrCl_6)$ |
| B6 | Silver chlorobromide having silver chloride content of 75.0% by mole | 0.31 μm | $K_2(IrCl_6)$ |
| R1 | Silver chlorobromide having silver chloride content of 97.0% by mole | 0.33 μm | not Included |
| R2 | Silver chlorobromide having silver chloride content of 98.0% by mole | 0.17 μm | $K_2(IrCl_6)$ |
| R3 | Silver chlorobromide having silver chloride content of 97.0% by mole | 0.12 μm | $K_2(IrCl_6)$ |
| R4 | Silver chlorobromide having silver chloride content of 75.0% by mole | 0.33 μm | not Included |
| R5 | Silver chlorobromide having silver chloride content of 75.0% by mole | 0.17 μm | $K_2(IrCl_6)$ |
| R6 | Silver chlorobromide having silver chloride content of 75.0% by mole | 0.12 μm | $K_2(IrCl_6)$ |

Preparation of Green-Sensitive Silver Halide Emulsion

Large Size Emulsion (G1)

(cubic particles, particle size: 0.33 μm, particle size distribution: 0.11, halogen composition: Br/Cl=25/75)

A silver nitrate aqueous solution and a mixed aqueous solution of sodium chloride and potassium bromide were added to each other by the control double jet process, which had been known in the art, to prepare the emulsion. The sensitizing dyes (D to G) represented by the structural formulae shown later were added to the emulsion in the following amounts to carry out spectral sensitization.

Green sensitizing dye (D): $0.5\times10^{-4}$ mole per mole of silver

Green sensitizing dye (E): $1.6\times10^{-4}$ mole per mole of silver

Green sensitizing dye (F): $1.0\times10^{-4}$ mole per mole of silver

Green sensitizing dye (G): $1.0\times10^{-4}$ mole per mole of silver

Furthermore, gold sulfur sensitization was suitably carried out by using aurichloric acid and triethylthio urea.

Intermediate Size Emulsion (G2)

(cubic particles, particle size: 0.24 μm, particle size distribution: 0.12, halogen composition: Br/Cl=25/75)

The same procedures as in the preparation of the emulsion G1 were carried out except that the particle forming temperature was changed, so as to produce an emulsion G2. The sensitizing dyes (D to G) represented by the structural formulae shown later were added to the emulsion in the following amounts according to the same manner as in the emulsion G1.

Green sensitizing dye (D): $0.8\times10^{-4}$ mole per mole of silver

Green sensitizing dye (E): $2.4\times10^{-4}$ mole per mole of silver

Green sensitizing dye (F): $1.2\times10^{-4}$ mole per mole of silver

Green sensitizing dye (G): $1.0\times10^{-4}$ mole per mole of silver

Small Size Emulsion (G3)

(cubic particles, particle size: 0.18 μm, particle size distribution: 0.10, halogen composition: Br/Cl=25/75)

The same procedures as in the preparation of the emulsion G1 were carried out except that the particle forming temperature was changed, so as to produce an emulsion G3. The sensitizing dyes (D to G) represented by the structural formulae shown later were added to the emulsion in the following amounts according to the same manner as in the emulsion G1.

Green sensitizing dye (D): $1.3\times10^{-4}$ mole per mole of silver

Green sensitizing dye (E): $3.0\times10^{-4}$ mole per mole of silver

Green sensitizing dye (F): $1.4\times10^{-4}$ mole per mole of silver

Green sensitizing dye (G): $1.2\times10^{-4}$ mole per mole of silver

Small Size Emulsion (G4)

(cubic particles, particle size: 0.13 μm, particle size distribution: 0.10, halogen composition: Br/Cl=25/75)

The same procedures as in the preparation of the emulsion G1 were carried out except that the particle forming temperature was changed, so as to produce an emulsion G4. The sensitizing dyes (D to G) represented by the structural formulae shown later were added to the emulsion in the following amounts according to the same manner as in the emulsion G1.

Green sensitizing dye (D): $1.7\times10^{-4}$ mole per mole of silver

Green sensitizing dye (E): $3.5\times10^{-4}$ mole per mole of silver

Green sensitizing dye (F): $1.9\times10^{-4}$ mole per mole of silver

Green sensitizing dye (G): $1.2\times10^{-4}$ mole per mole of silver

Furthermore, emulsions G5 to G28 were prepared in the same manner as in the preparation of the emulsions G1, G2, G3 and G4 except that the halogen composition was changed to those disclosed in Table 11.

| Emulsion | Halogen Composition | Particle Size (sphere equivalent) | Ir Compound |
|---|---|---|---|
| G1 | silver chlorobromide having silver chloride content of 75.0% by mole | 0.33 μm | not Included |
| G2 | silver chlorobromide having silver chloride content of 75.0% by mole | 0.24 μm | not Included |
| G3 | silver chlorobromide having silver chloride content of 75.0% by mole | 0.19 μm | not Included |
| G4 | silver chlorobromide having silver chloride content of 75.0% by mole | 0.14 μm | not Included |

-continued

| Emulsion | Halogen Composition | Particle Size (sphere equivalent) | Ir Compound |
|---|---|---|---|
| G5 | silver chlorobromide having silver chloride content of 75.0% by mole | 0.33 μm | $K_2(IrCl_6)$ |
| G6 | silver chlorobromide having silver chloride content of 75.0% by mole | 0.24 μm | $K_2(IrCl_6)$ |
| G7 | silver chlorobromide having silver chloride content of 75.0% by mole | 0.19 μm | $K_2(IrCl_6)$ |
| G8 | silver chlorobromide having silver chloride content of 75.0% by mole | 0.14 μm | $K_2(IrCl_6)$ |
| G9 | silver chlorobromide having silver chloride content of 98.8% by mole | 0.33 μm | not Included |
| G10 | silver chlorobromide having silver chloride content of 98.8% by mole | 0.24 μm | not Included |
| G11 | silver chlorobromide having silver chloride content of 98.8% by mole | 0.19 μm | not Included |
| G12 | silver chlorobromide having silver chloride content of 98.8% by mole | 0.14 μm | not Included |
| G13 | silver chlorobromide having silver chloride content of 98.8% by mole | 0.33 μm | $K_2(IrCl_6)$ |
| G14 | silver chlorobromide having silver chloride content of 98.8% by mole | 0.24 μm | $K_2(IrCl_6)$ |
| G15 | silver chlorobromide having silver chloride content of 98.8% by mole | 0.19 μm | $K_2(IrCl_6)$ |
| G16 | silver chlorobromide having silver chloride content of 98.8% by mole | 0.14 μm | $K_2(IrCl_6)$ |
| G17 | silver chlorobromide having silver chloride content of 98.8% by mole | 0.33 μm | $K_2(Ir(H_2O)Cl_5)$ |
| G18 | silver chlorobromide having silver chloride content of 98.8% by mole | 0.24 μm | $K_2(Ir(H_2O)Cl_5)$ |
| G19 | silver chlorobromide having silver chloride content of 98.8% by mole | 0.19 μm | $K_2(Ir(H_2O)Cl_5)$ |
| G20 | silver chlorobromide having silver chloride content of 98.8% by mole | 0.14 μm | $K_2(Ir(H_2O)Cl_5)$ |
| G21 | silver chlorobromide having silver chloride content of 98.8% by mole | 0.33 μm | $K_2(Ir(5\text{-methylthiazole})Cl_5)$ |
| G22 | silver chlorobromide having silver chloride content of 98.8% by mole | 0.24 μm | $K_2(Ir(5\text{-methylthiazole})Cl_5)$ |
| G23 | silver chlorobromide having silver chloride content of 98.8% by mole | 0.19 μm | $K_2(Ir(5\text{-methylthiazole})Cl_5)$ |
| G24 | silver chlorobromide having silver chloride content of 98.8% by mole | 0.14 μm | $K_2(Ir(5\text{-methylthiazole})Cl_5)$ |
| G25 | silver chlorobromide having silver chloride content of 98.8% by mole | 0.33 μm | $K_2(IrCl_6)^+K_2(Ir(5\text{-methylthiazole})Cl_5)$ |
| G26 | silver chlorobromide having silver chloride content of 98.8% by mole | 0.24 μm | $K_2(IrCl_6)^+K_2(Ir(5\text{-methylthiazole})Cl_5)$ |
| 027 | silver chlorobromide having silver chloride content of 98.8% by mole | 0.19 μm | $K_2(IrCl_6)^+K_2(Ir(5\text{-methylthiazole})Cl_5)$ |
| G28 | silver chlorobromide having silver chloride content of 98.8% by mole | 0.14 μm | $K_2(IrCl_6)^+K_2(Ir(5\text{-methylthiazole})Cl_5)$ |

Production of Sample 101

The layers having the following compositions were coated by multilayer coating on a polyethylene terephthalate film support having an undercoating (thickness: 120 μm, a hydrophilic colloid layer containing an electroconductive polymer 1 disclosed later (0.07 g/m$^2$) and tin oxide fine particles (0.22 g/m$^2$) coated on the side opposite to the emulsion layers), so as to prepare a sample 101 as a multilayer color photographic photosensitive material. The coating compositions for the photographic constituting layers were prepared in the following manner.

The dye solid fine particle dispersion used in the respective samples was prepared in the following manner.

Preparation of Dye Solid Fine Particle Dispersion

Methanol wet cakes of the example compounds (IV-1) and (II-25) were weighed in net amounts of 240 g and 120 g, respectively, and 48 g of the example compound (V-12) was weighed as a dispersion assistant, to which water was added to make 4,000 g. 1.7 L of zirconia beads (diameter: 0.5 mm) were charged in "Circulation Surround Grinder Mill (UVM-2)" (produced by Imecs K. K.), and the materials were pulverized at a discharge amount of 0.5 L/min and a peripheral speed of 10 m/s for 2 hours. Thereafter, the dispersion was diluted to make a concentration of the compound of 3% by weight, and the following compound (VI-2) was added thereto in an amount of 3% by weight based on the amount of the dye (referred to as a dispersion A). The dispersion had an average particle diameter of 0.45 μm. In the case where a heat treatment was carried out, the compound (VI-2) was added after the heat treatment.

(VI-2)

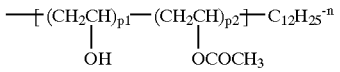

Preparation of 6th Layer Coating Composition 83.3 g of a magenta coupler (ExM), 1.5 g of an additive (Cpd-9), 0.1 g of an additive (Cpd-11) and 2.0 g of an additive (Cpd-13) were dissolved in 80 g of a solvent (Solv-1) and 80 ml of ethyl acetate, and the resulting solution was dispersed and emulsified in 1000 g of a 10% gelatin aqueous solution containing 40 ml of a 10% solution of sodium dodecylbenzenesulfonate, so as to prepare an emulsion dispersion M.

The emulsion dispersion M and the silver chlorobromide emulsions G1 to G4 were mixed and dissolved to prepare a sixth layer coating composition having the composition described later. The coated amount of the emulsion is a value in terms of coated silver amount.

The coating compositions for the first to seventh layers were prepared in the similar manner as in the sixth layer coating composition. As a gelatin hardening agent for the respective layers, 1-oxy-3,5-dichloro-s-triazine sodium salt was used.

The following spectral sensitizing dyes were used in the silver chlorobromide emulsions in the respective photosensitive emulsion layers.

Blue-Sensitive Emulsion Layer (Sensitizing Dye A)

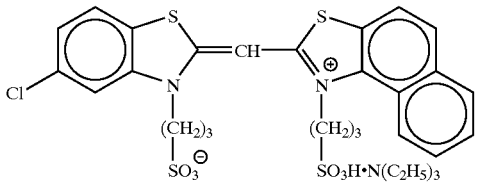

(Sensitizing Dye B)

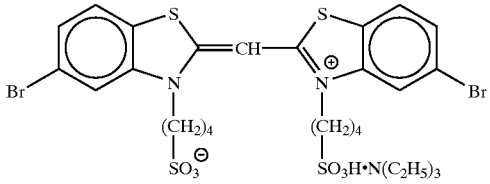

(Sensitizing Dye C)

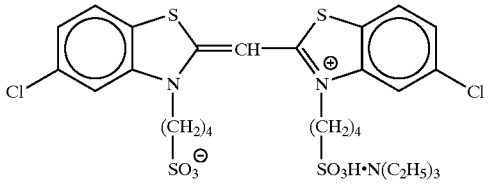

Green-Sensitive Emulsion Layer (Sensitizing Dye D)

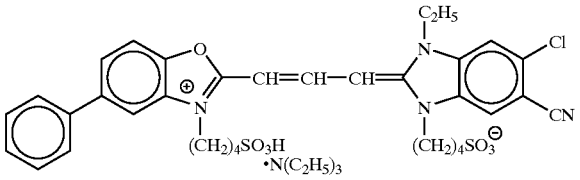

(Sensitizing Dye E)

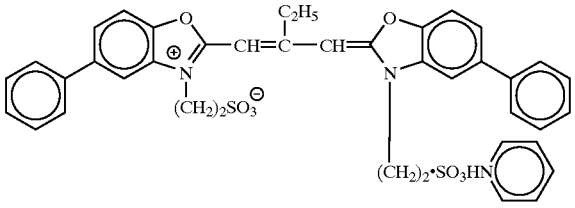

(Sensitizing Dye F)

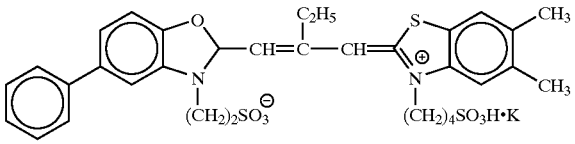

(Sensitizing Dye G)

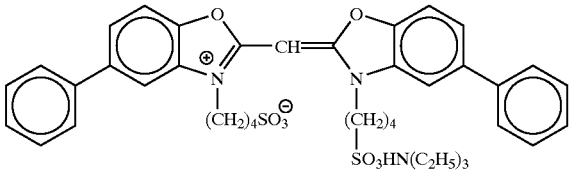

Red-Sensitive Emulsion Layer (Sensitizing Dye H)

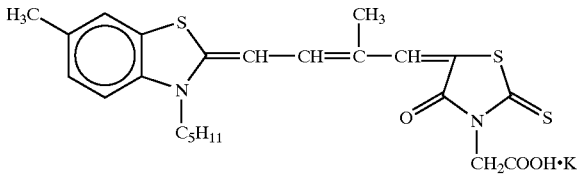

(Sensitizing Dye I)

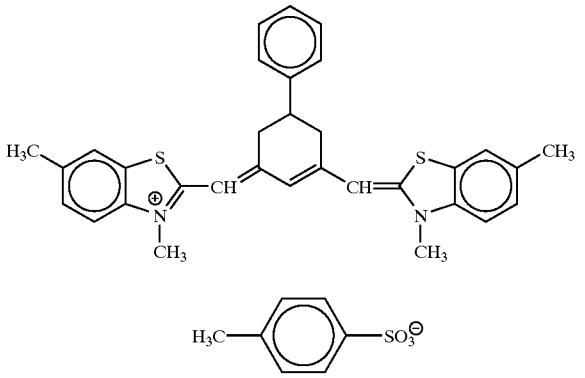

Furthermore, the following compound was added to the red-sensitive emulsion layer in an amount of $9.0\times10^{-4}$ mole per mole of silver halide.

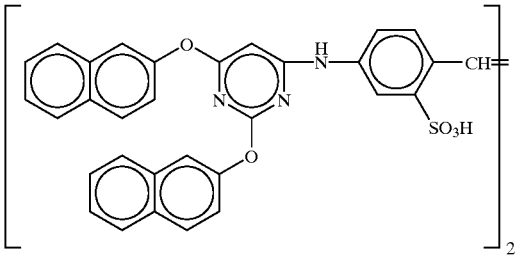

In order to prevent irradiation, the following dyes were added to the emulsion layers.

(SA-1)

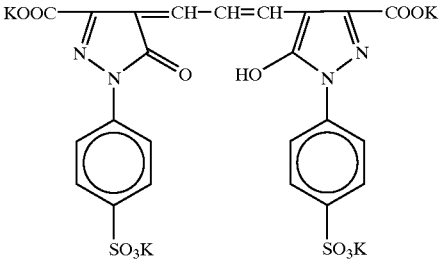

(SA-2)

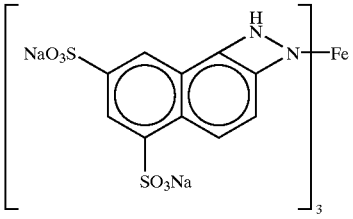

-continued (SA-3)

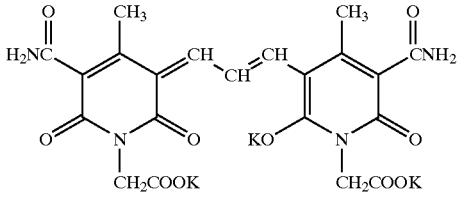

(SA-4)

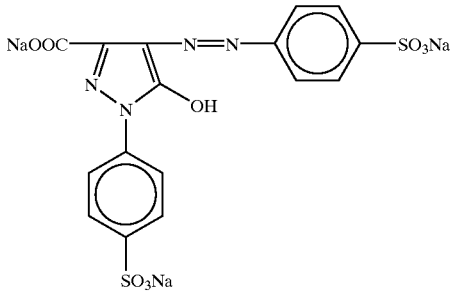

(SA-5)

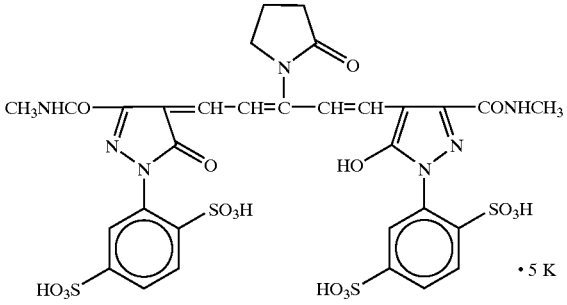

Layer Composition

The compositions of the layers are shown below. The numerals mean coating amount ($g/m^2$). With respect to the silver halide emulsions, the numerals mean coating amounts in terms of coated silver amount.

Support

A polyethylene terephthalate film support having an undercoating (thickness: 120 $\mu$m, a hydrophilic colloid layer containing the following electroconductive polymer (0.05 $g/m^2$) and tin oxide fine particles (0.20 $g/m^2$) coated on the side opposite to the emulsion layers) was used as a support.

| | |
|---|---|
| First layer (Anti-halation layer) | |
| Composition of Anti-halation Layer | |
| Gelatin | 0.80 |
| Dye solid fine particle dispersion A | 0.12 |
| Second layer (Blue-Sensitive Emulsion Layer) | |
| Silver chlorobromide emulsion (mixture of B1, B2 and B3 at a silver molar ratio of 2/2/6) | 0.53 |
| Gelatin | 2.10 |
| Yellow coupler (ExY) | 1.18 |
| (Cpd-1) | 0.0005 |
| (Cpd-2) | 0.03 |
| (Cpd-3) | 0.02 |
| (Cpd-4) | 0.006 |
| (Cpd-5) | 0.019 |
| (Cpd-6) | 0.002 |
| Solvent (Solv-1) | 0.27 |
| (Cpd-14) | 0.140 |
| (Cpd-15) | 0.010 |

-continued

Third layer (Color Mixing Preventing Layer)

| | |
|---|---|
| Gelatin | 0.31 |
| (Cpd-9) | 0.02 |
| (Cpd-3) | 0.04 |
| Solvent (Solv-1) | 0.05 |
| Solvent (Solv-4) | 0.04 |
| Solvent (Solv-5) | 0.01 |
| Solvent (Solv-6) | 0.002 |
| (SA-1) | 0.050 |
| (SA-4) | 0.008 |

Fourth layer (Red-Sensitive Emulsion Layer)

| | |
|---|---|
| Silver chlorobromide emulsion (mixture of R1, R2 and R3 at a silver molar ratio of 2/3/5) | 0.47 |
| Gelatin | 2.44 |
| Cyan coupler (ExC) | 0.69 |
| (Cpd-7) | 0.05 |
| (Cpd-8) | 0.05 |
| (Cpd-10) | 0.03 |
| (Cpd-13) | 0.06 |
| Solvent (Solv-1) | 0.47 |
| Solvent (Solv-2) | 0.26 |
| Solvent (Solv-3) | 0.05 |
| Solvent (Solv-4) | 0.02 |

Fifth layer (Color Mixing Preventing Layer)

| | |
|---|---|
| Gelatin | 0.31 |
| (SA-2) | 0.90 |
| (SA-3) | 0.16 |
| (SA-5) | 0.40 |
| (Cpd-9) | 0.02 |
| (Cpd-3) | 0.03 |
| Solvent (Solv-1) | 0.05 |
| Solvent (Solv-4) | 0.04 |
| Solvent (Solv-5) | 0.01 |
| Solvent (Solv-6) | 0.002 |

Sixth layer (Green-Sensitive Emulsion Layer)

| | |
|---|---|
| Mixture of emulsions G1, G2, G3 and G4 | 0.55 |
| Gelatin | 1.28 |
| Magenta coupler (ExM) | 0.68 |
| (Cpd-9) | 0.014 |
| (Cpd-5) | 0.001 |
| Solvent (Solv-1) | 0.12 |

Seventh layer (Protective Layer)

| | |
|---|---|
| Gelatin | 0.96 |
| Acrylic modified copolymer of polyvinyl alcohol (modification degree: 17%) | 0.02 |
| (Cpd-12) | 0.04 |

ExY (1)

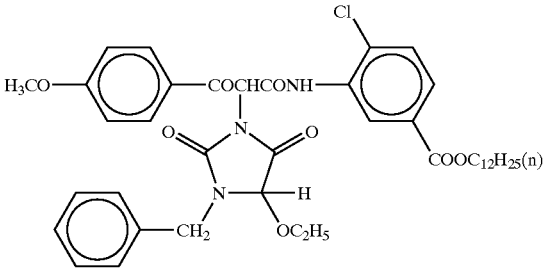

-continued (2)

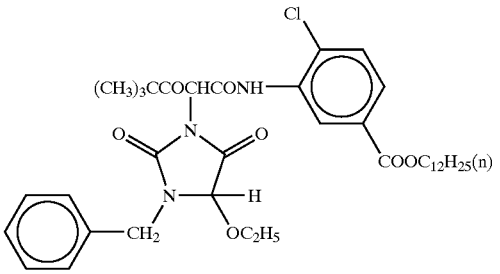

(3)

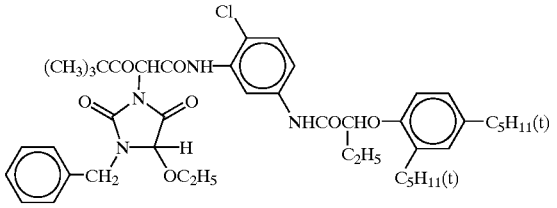

Mixture of (1), (2) and (3) at molar ratio of 80/10/10

ExM (1)

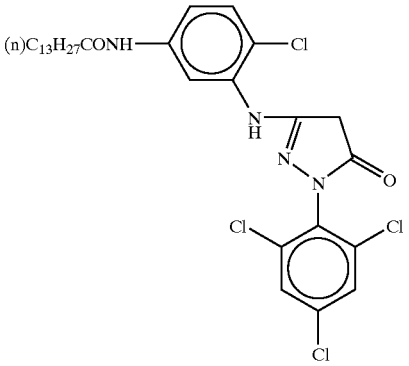

(2)

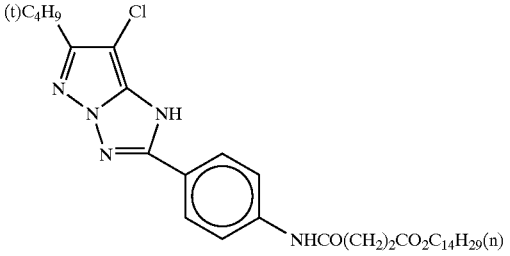

Mixture of (1) and (2) at molar ratio of 90/10

ExC (1)

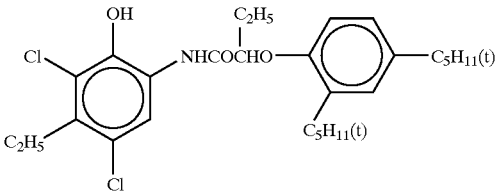

-continued
(2)
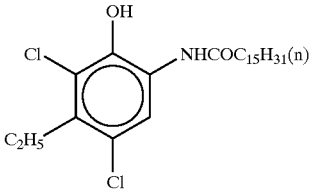
(3)
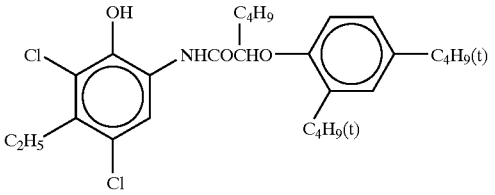
(4)
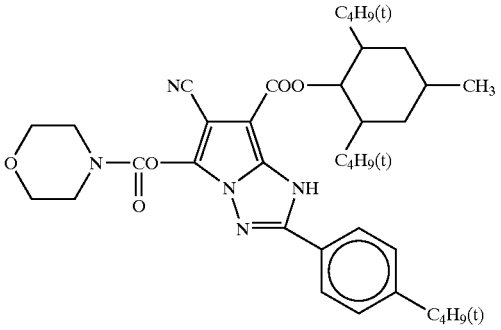
Mixture of (1), (2), (3) and (4) at molar ratio of 55/5/20/20
(Cpd-1)
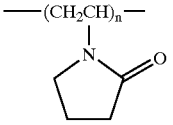
(Cpd-2)
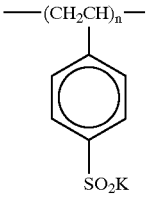
(Cpd-3)
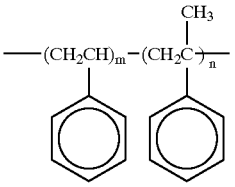
Number average molecular weight: 600
-continued
m/n = 10/90
(Cpd-4)
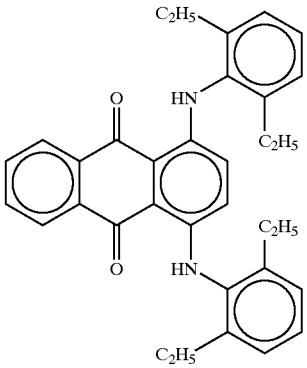
(Cpd-5)
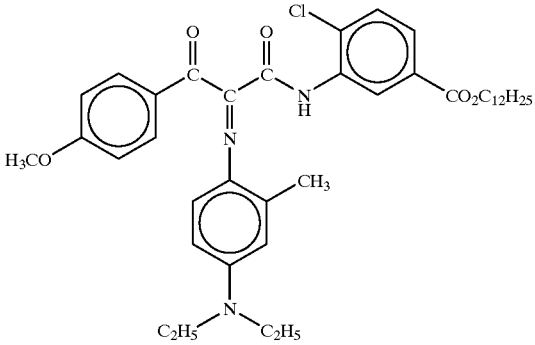
(Cpd-6)
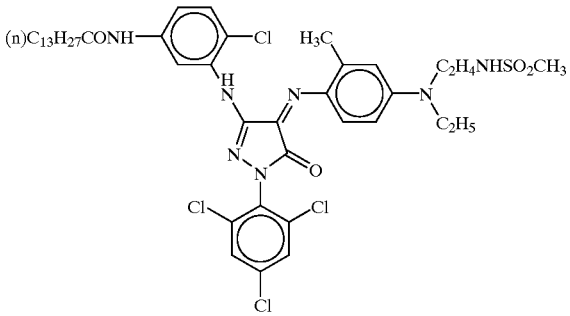
(Cpd-7)
(1)
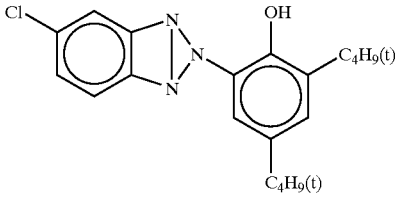

-continued
(2)
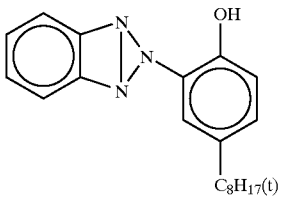
(3)
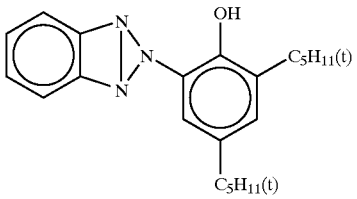
Mixture of (1), (2) and (3) at weight ratio of 2/1/7
(Cpd-8)
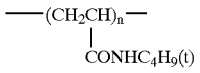
Average molecular weight: ca 60,000
(Cpd-9)
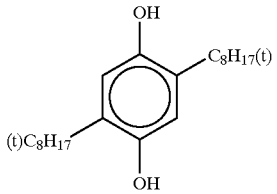
(Cpd-10)
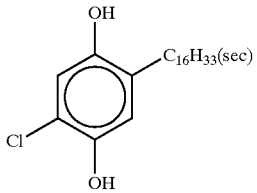
(Cpd-11)
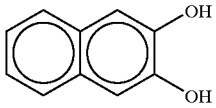
(Cpd-12)
Mixture of
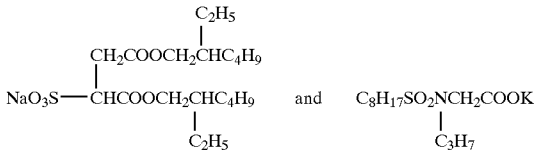
at weight ratio of 7/1
-continued
(Cpd-13)
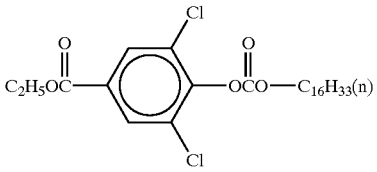
(Cpd-14)
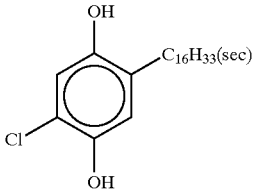
(Cpd-15)
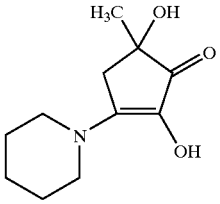
(Solv-1)
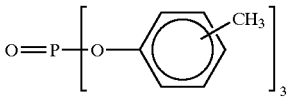
(Solv-2)
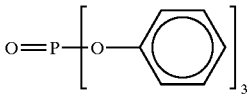
(Solv-3)
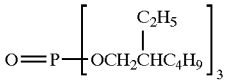
(Solv-4)
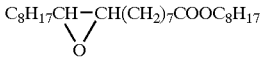
(Solv-5)
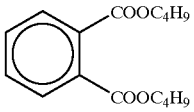

-continued (Solv-6)

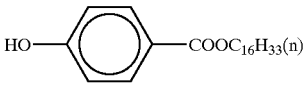

Electroconductive polymer

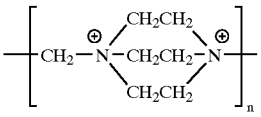

(Preparation of Processing Solutions)

ECP-2 Process disclosed by Eastman Kodak Corp. as a standard processing method for a cinematographic color positive film was used, but the first fixing solution, and the water washing bath and the sound developing step subsequent thereto were omitted. All the samples thus produced were exposed with an image, by which about 30% of the coated silver was developed. After completing the exposure, the sample was subjected to continuous processing (running test) with the foregoing processing method until the amount of the replenisher of the coloring developing bath became twice the tank capacity, whereby a developing process state in a running equilibrium was prepared.

ECP-2 Process

Process Steps

| | Name of step | Processing temperature (° C.) | Processing time (sec) | Replenishing amount (ml per 35 mm × 30.48 m) |
|---|---|---|---|---|
| 1 | Prebath | 27 ± 1 | 10–20 | 400 |
| 2 | Water washing | 27 ± 1 | Jet water washing | — |
| 3 | Development | 36.7 ± 0.1 | 180 | 690 |
| 4 | Termination | 27 ± 1 | 40 | 770 |
| 5 | Water washing | 27 ± 3 | 40 | 1,200 |
| 6 | First fixing | 27 ± 1 | 40 | 200 |
| 7 | Water washing | 27 ± 3 | 40 | 1,200 |
| 8 | Bleach acceleration | 27 ± 1 | 20 | 200 |
| 9 | Bleaching | 27 ± 1 | 40 | 200 |
| 10 | Water washing | 27 ± 3 | 40 | 1,200 |
| 11 | Drying | | | |
| 12 | Sound developing | room temperature | 10–20 | — (coating) |
| 13 | Water washing | 27 ± 3 | 1–2 | — (spraying) |
| 14 | Second fixing | 27 ± 1 | 40 | 200 |
| 15 | Water washing | 27 ± 3 | 60 | 1,200 |
| 16 | Rinsing | 27 ± 3 | 10 | 400 |
| 17 | Drying | | | |

Compositions of Processing Solutions

The compositions per 1 L will be shown.

| Name of step | Name of chemical | Tank solution | Replenisher |
|---|---|---|---|
| Prebath | BORAX (trade name) | 20 g | 20 g |
| | Sodium sulfate | 100 g | 100 g |
| | Sodium hydroxide | 1.0 g | 1.5 g |
| Developing | Kodak ANTICALCIUM No. 4 (trade name) | 1.0 ml | 1.4 ml |
| | Sodium sulfite | 4.35 g | 4.50 g |
| | CD-2 | 2.95 g | 6.00 g |
| | Sodium carbonate | 17.1 g | 18.0 g |
| | Sodium bromide | 1.72 g | 1.60 g |
| | Sodium hydroxide | — | 0.6 g |
| | Sulfuric acid (7N) | 0.62 ml | — |
| Termination | Sulfuric acid (7N) | 50 ml | 50 ml |
| Fixing (common to the first and the second fixings) | Ammonium thiosulfate (58%) | 100 ml | 170 ml |
| | Sodium sulfite | 2.5 g | 16.0 g |
| | Sodium hydrogen sulfite | 10.3 g | 5.8 g |
| | Potassium iodide | 0.5 g | 0.7 g |
| Bleach acceleration | Sodium hydrogen metasulfite | 3.3 g | 5.6 g |
| | Acetic acid | 5.0 ml | 7.0 ml |
| | PBA-1 (KODAK PERSULFATE BLEACH ACCELERATOR, trade name) | 3.3 g | 4.9 g |
| | EDTA-4Na | 0.5 g | 0.7 |
| Bleaching | Gelatin | 0.35 g | 0.50 g |
| | Sodium persulfate | 33 g | 52 g |
| | Sodium chloride | 15 g | 20 g |
| | Sodium dihydrogen phosphate | 7.0 g | 10.0 g |
| | Phosphoric acid (85%) | 2.5 ml | 2.5 ml |
| Sound developing | NATROSAL 250HR | 2.0 g | |
| | Sodium hydroxide | 80 g | |
| | Hexyl glycol | 2.0 ml | |
| | Sodium sulfite | 60 g | |
| | Hydroquinone | 60 g | |
| | Ethylenediamine (98%) | 13 ml | |
| Rinsing | KODAK STABILIZER ADDITIVE (trade name) | 0.14 ml | 0.17 ml |
| | DEARCIDE 702 (trade name) | 0.7 ml | 0.7 ml |

In the foregoing, CD-2 used in the developing step was a developer, and DEARCIDE 702 used in the rinsing step was an antifungal agent.

Production of Samples 102 to 129

Samples 102 to 129 were produced in the same manner as in the production of the photosensitive material 101 except that the following changes were made.

(a) The emulsion in the second layer, the emulsion in the fourth layer and the emulsion in the sixth layer were changed as shown in Table 12. The mixing ratios of the emulsions in Table 12 were arbitrarily changed to adjust the average particle size to those shown in Table 12.

(b) The addition amount of the compound (SA-2) in the fifth layer and the species of gelatin in the seventh layer and the sixth layer were arbitrarily changed to adjust the Fe content in the photosensitive material to those shown in Table 12.

Tests and Evaluations

The following tests were carried out for the samples 101 to 129 for evaluating the granularity, the processing stability and the green storage stability.

Evaluation of Granularity

Exposure of 1/100 second was applied to the samples through a green filter to make a density Dmin+1.0 in the respective samples by using a sensitivity meter (MODEL FW, produced by Fuji Photo Film Co., Ltd., color temperature of light source: 3,200 K), and the samples were subjected to the process according to ECP-2 Process disclosed by Eastman Kodak Corp.

In order to evaluate the granularity of the green-sensitive layer, the RMS granularity was measured with a green filter by using an aperture of 48 μm in diameter. The RMS value×1000 at a density of Dmin+1.0 was designated as an RMS granularity, and evaluation was made by relative values with the RMS granularity of the sample 101 as the standard. (Dmin means the lowest image density.) It was evaluated that the smaller the value was, the better the granularity was.

Evaluation of Processing Stability

Gradation exposure for sensitometry of 1/100 second was applied to the samples at 60,000 lux through a gray filter making the maximum density by using a sensitivity meter (MODEL FW, produced by Fuji Photo Film Co., Ltd., color temperature of light source: 3,200 K), and the samples were subjected to the process according to ECP-2 Process disclosed by Eastman Kodak Corp. The samples thus processed were measured for density with a green filter. The sensitivity was designated as relative values of a logarithmic value of an inverse number of such an exposure amount that was required to increase the optical density by Dmin+1.5.

The foregoing procedures were carried out for the respective samples with the number of samples N of 7. With respect to the magenta sensitivity, the value ΔG=(average magenta sensitivity of seven samples)-(minimum magenta sensitivity among seven samples) was designated as an index of processing stability. It was evaluated that when the value was lower, it meant that processing fluctuation within the seven samples was small, i.e., the processing stability was high.

Evaluation of Green Storage Stability

After producing the samples, the samples were stored under the following conditions and then subjected to the following process.

(1) stored at 25° C. and 55% RH for 7 days (2) stored at 45° C. and 70% RH for 7 days Gradation exposure for sensitometry of 1/100 second was applied to the samples at 60,000 lux through a gray filter making the maximum density by using a sensitivity meter (MODEL FW, produced by Fuji Photo Film Co., Ltd., color temperature of light source: 3,200 K), and the samples were subjected to the process according to ECP-2 Process disclosed by Eastman Kodak Corp. The samples thus processed were measured for density with a green filter. The sensitivity was designated as relative values of a logarithmic value of an inverse number of such an exposure amount that was required to increase the optical density by Dmin+1.5.

The magenta sensitivity was obtained for the respective samples, and the value SG=(1) magenta density−(2) magenta density was designated as an index of green storage stability. It was evaluated that the smaller the absolute value of the value was, the better the green storage stability was.

The results of tests and evaluations thereof for the granularity, the processing stability and the green storage stability are shown in Table 12.

TABLE 12

| Sample | Emulsion of 2nd layer | Emulsion of 4th layer | Emulsion of 6th layer | Average particle size of emulsion of 6th layer | Fe amount (mole/m$^2$) | RMS (granu-larity) | ΔS (processing stability) | SG (green storage stability) | Note |
|---|---|---|---|---|---|---|---|---|---|
| 101 | B1/B2/B3 | R1/R2/R3 | G2/G3/G4 | 0.21 μm | $8 \times 10^{-6}$ | 100 | 0.14 | 0.01 | Comparison |
| 102 | B1/B2/B3 | R1/R2/R3 | G10/G11/G12 | 0.21 μm | $8 \times 10^{-6}$ | 101 | 0.08 | 0.03 | Comparison |
| 103 | B1/B2/B3 | R1/R2/R3 | G6/G7/G8 | 0.21 μm | $8 \times 10^{-6}$ | 100 | 0.10 | 0.01 | Comparison |
| 104 | B1/B2/B3 | R1/R2/R3 | G6/G7/G8 | 0.21 μm | $1 \times 10^{-4}$ | 100 | 0.11 | 0.01 | Comparison |
| 105 | B4/B5/B6 | R1/R2/R3 | G14/G15/G16 | 0.21 μm | $8 \times 10^{-6}$ | 99 | 0.07 | 0.02 | Comparison |
| 106 | B1/B2/B3 | R4/R5/R6 | G14/G15/G16 | 0.21 μm | $8 \times 10^{-6}$ | 100 | 0.07 | 0.02 | Comparison |
| 107 | B1/B2/B3 | R1/R2/R3 | G13/G14/G16 | 0.30 μm | $8 \times 10^{-6}$ | 171 | 0.04 | 0.01 | Comparison |
| 108 | B1/B2/B3 | R1/R2/R3 | G13/G14/G16 | 0.30 μm | $1 \times 10^{-4}$ | 170 | 0.04 | 0.02 | Comparison |
| 109 | B1/B2/B3 | R1/R2/R3 | G14/G15/G16 | 0.26 μm | $8 \times 10^{-6}$ | 148 | 0.02 | 0.01 | Comparison |
| 110 | B1/B2/B3 | R1/R2/R3 | G14/G15/G16 | 0.24 μm | $8 \times 10^{-6}$ | 112 | 0.03 | 0.02 | Invention |
| 111 | B1/B2/B3 | R1/R2/R3 | G13/G15/G16 | 0.20 μm | $8 \times 10^{-6}$ | 93 | 0.01 | 0.02 | Invention |
| 112 | B1/B2/B3 | R1/R2/R3 | G14/G15/G16 | 0.18 μm | $8 \times 10^{-6}$ | 88 | 0.01 | 0.02 | Invention |
| 113 | B1/B2/B3 | R1/R2/R3 | G14/G15/G16 | 0.15 μm | $8 \times 10^{6}$ | 77 | 0.00 | 0.02 | Invention |
| 114 | B1/B2/B3 | R1/R2/R3 | G14/G15/G16 | 0.21 μm | $1 \times 10^{-4}$ | 100 | 0.02 | 0.08 | Comparison |
| 115 | B1/B2/B3 | R1/R2/R3 | G14/G15/G16 | 0.21 μm | $5 \times 10^{5}$ | 99 | 0.02 | 0.07 | Comparison |
| 116 | B1/B2/B3 | R1/R2/R3 | G14/G15/G16 | 0.21 μm | $2.5 \times 10^{-5}$ | 101 | 0.02 | 0.07 | Comparison |
| 117 | B1/B2/B3 | R1/R2/R3 | G14/G15/G16 | 0.21 μm | $1.5 \times 10^{-6}$ | 100 | 0.02 | 0.04 | Invention |
| 118 | B1/B2/B3 | R1/R2/R3 | G14/G15/G16 | 0.21 μm | $8 \times 10^{-6}$ | 99 | 0.02 | 0.02 | Invention |
| 119 | B1/B2/B3 | R1/R2/R3 | G14/G15/G16 | 0.21 μm | $1 \times 10^{-6}$ | 100 | 0.02 | 0.01 | Invention |
| 120 | B1/B2/B3 | R4/R5/R6 | G14/G15/G16 | 0.21 μm | $8 \times 10^{-6}$ | 99 | 0.06 | 0.02 | Comparison |
| 121 | B1/B2/B3 | R4/R5/R6 | G14/G15/G16 | 0.21 μm | $1 \times 10^{-4}$ | 100 | 0.06 | 0.07 | Comparison |
| 122 | B1/B2/B3 | R1/R2/R3 | G18/G19/G20 | 0.21 μm | $8 \times 10^{-6}$ | 99 | 0.01 | 0.01 | Invention |
| 123 | B1/B2/B3 | R1/R2/R3 | G18/G19/G28 | 0.21 μm | $8 \times 10^{-6}$ | 100 | 0.01 | 0.01 | Invention |
| 124 | B1/B2/B3 | R1/R2/R3 | G22/G23/G24 | 0.21 μm | $1 \times 10^{-4}$ | 99 | 0.01 | 0.07 | Comparison |
| 125 | B1/B2/B3 | R1/R2/R3 | G22/G23/G24 | 0.21 μm | $8 \times 10^{-6}$ | 99 | 0.01 | 0.01 | Invention |
| 126 | B1/B2/B3 | R1/R2/R3 | G22/G19/G28 | 0.21 μm | $8 \times 10^{-6}$ | 100 | 0.01 | 0.01 | Invention |
| 127 | B1/B2/B3 | R1/R2/R3 | G26/G27/G28 | 0.21 μm | $8 \times 10^{-6}$ | 101 | 0.01 | 0.01 | Invention |
| 128 | B1/B2/B3 | R1/R2/R3 | G14/G27/G28 | 0.21 μm | $8 \times 10^{-6}$ | 100 | 0.00 | 0.01 | Invention |
| 129 | B1/B2/B3 | R1/R2/R3 | G26/G27/G28 | 0.17 μm | $8 \times 10^{-6}$ | 81 | 0.00 | 0.01 | Invention |

The following effect of the invention has been understood from the evaluation results in Table 12. In the comparative samples 107, 108 and 109, where the average particle size of the green-sensitive emulsion is large, the RMS granularity is large. Therefore, only an image having roughness in magenta color, which is the most important (with high visibility), is obtained, i.e., no high quality image can be obtained, and thus the samples cannot be applied to practical use.

In the comparative samples 101, 103 and 104, where the green-sensitive emulsion is not a high silver chloride emulsion, problems arise in processing stability, and it is considered that the samples are difficult to provide uniform performance in the market.

In the comparative samples 105, 106, 120 and 121, where the emulsions other than the green-sensitive emulsion (i.e., the blue-sensitive emulsion and the red-sensitive emulsion) are not a high silver chloride emulsion, the same phenomenon as the foregoing occurs, and the samples cannot be applied to practical use.

With respect to the comparative sample 102, where the emulsion containing no Ir compound is used in the green-sensitive emulsion, it is understood that the processing stability is poor.

In the comparative samples 114, 115, 116 and 121, where the Fe content in the photosensitive materials is large, such a problem occurs that the change in sensitivity (desensitization) during green storage is large. The change in performance is fatal under such a situation that stable photographic performance is always demanded, and thus the samples cannot be applied to practical use. It is understood that the phenomenon characteristically occurs in the case where the green-sensitive emulsion is high silver chloride, and the average particle size is small. That is, the phenomenon does not occur even with a high Fe concentration, when the green-sensitive emulsion is not high silver chloride (sample 102), and when the average particle size is relatively large (sample 108).

On the other hand, in the samples of the invention (samples 110 to 113, 117 to 119, 122, 123 and 125 to 129), where all the silver halide emulsion particles each has a halogen composition of silver chlorobromide, silver chloroiodide, silver chloroiodobromide or silver chloride having a silver chloride content of 95% by mole or more, at least one kind of green-sensitive silver halide emulsion particles are doped with iridium, the green-sensitive silver halide emulsion particles have an average sphere-equivalent particle diameter of 0.25 $\mu$m or less, and the silver halide color photographic photosensitive material has an Fe content of $8\times10^{-6}$ mol/m$^2$ or less, it has been understood that high image quality is obtained, and the finishing uniformity in laboratories and stability are improved.

In the samples 111, 112, 113 and 129, where the average particle size of the green-sensitive emulsion particles is small, which is a more preferable embodiment, it is understood that the RMS granularity and the processing stability are further improved, and it is also understood that the storage stability is improved in the sample where the Fe content of the photosensitive materials is in the preferable embodiment ($8\times10^{-6}$ mol/m$^2$ or less).

Example 2

Photosensitive material samples 130 to 136 were made by changing only the surface active agent of each of the seventh layers of photosensitive material samples 110, 113, 119, 123, 127, and 129, which were made for Example 1, as shown in Table 13. Structures and compositions of compounds used for this change are shown below.

(F-1)

A mixture of

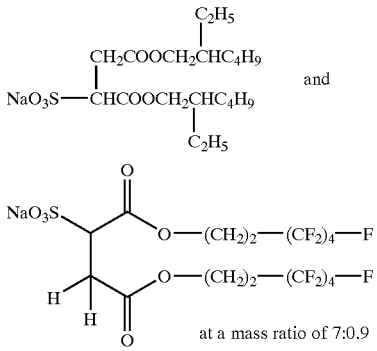

(F-2)

A mixture of

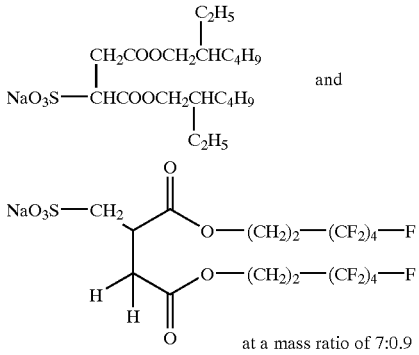

Furthermore, one of each of the samples was stored under the following condition (3) and another of each samples was stored under the following condition (4).

(3) stored for 21 days under conditions of 25° C. and 55% RH (4) stored for 21 days under conditions of 45 and 70% RH.

Then, the same processes as in Example 1 were implemented, magenta sensitivity for each of the samples was compiled and long-term row storability was measured by obtaining LSG, which equals magenta sensitivity for the sample stored under condition (3)—magenta sensitivity for the sample stored under condition (4). The smaller the absolute value of this value is the better. Results are shown in Table 13.

TABLE 13

| Sample No. | Emulsion of 2nd Layer | Emulsion of 4th Layer | Emulsion of 6th Layer | Average Particle Size of 4th Layer Emulsion | Fe Amount Mole/m$^2$ | Surface Active Agent of 7th Layer | LSG (Long-term Raw Storability) | Notes |
|---|---|---|---|---|---|---|---|---|
| 110 | B1/B2/B3 | R1/R2/R3 | G14/G15/G16 | 0.24 $\mu$m | 8 × 10E−6 | Cpd-12 | 0.07 | The Invention |
| 130 | B1/B2/B3 | R1/R2/R3 | G14/G15/G16 | 0.24 $\mu$m | 8 × 10E−6 | F-1 | 0.04 | The Invention |
| 113 | B1/B2/B3 | R1/R2/R3 | G14/G15/G16 | 0.15 $\mu$m | 8 × 10E−6 | Cpd-12 | 0.09 | The Invention |
| 131 | B1/B2/B3 | R1/R2/R3 | G14/G15/G16 | 0.15 $\mu$m | 8 × 10E−6 | F-1 | 0.05 | The Invention |
| 119 | B1/B2/B3 | R1/R2/R3 | G14/G15/G16 | 0.21 $\mu$m | 1 × 10E−6 | Cpd-12 | 0.03 | The Invention |
| 132 | B1/B2/B3 | R1/R2/R3 | G14/G15/G16 | 0.21 $\mu$m | 1 × 10E−6 | F-1 | 0.01 | The Invention |

TABLE 13-continued

| Sample No. | Emulsion of 2nd Layer | Emulsion of 4th Layer | Emulsion of 6th Layer | Average Particle Size of 4th Layer Emulsion | Fe Amount Mole/m² | Surface Active Agent of 7th Layer | LSG (Long-term Raw Storability) | Notes |
|---|---|---|---|---|---|---|---|---|
| 123 | B1/B2/B3 | R1/R2/R3 | G18/G19/G28 | 0.21 μm | 8 × 10E−6 | Cpd-12 | 0.04 | The Invention |
| 133 | B1/B2/B3 | R1/R2/R3 | G18/G19/G28 | 0.21 μm | 8 × 10E−6 | F-1 | 0.03 | The Invention |
| 127 | B1/B2/B3 | R1/R2/R3 | G26/G27/G28 | 0.21 μm | 8 × 10E−6 | Cpd-12 | 0.03 | The Invention |
| 134 | B1/B2/B3 | R1/R2/R3 | G26/G27/G28 | 0.21 μm | 8 × 10E−6 | F-1 | 0.01 | The Invention |
| 129 | B1/B2/B3 | R1/R2/R3 | G26/G27/G28 | 0.17 μm | 8 × 10E−6 | Cpd-12 | 0.04 | The Invention |
| 135 | B1/B2/B3 | R1/R2/R3 | G26/G27/G28 | 0.17 μm | 8 × 10E−6 | F-1 | 0.02 | The Invention |
| 136 | B1/B2/B3 | R1/R2/R3 | G26/G27/G28 | 0.17 μm | 8 × 10E−6 | F-2 | 0.02 | The Invention |

As it is apparent from Table 13, it was confirmed that the storability for long-term storage was also improved when the fluorine-based surface active agent shown in general formula (FS) and preferable in the invention is used. Moreover, it was confirmed that each of the evaluation items evaluated in Example 1 (graininess (RMS), processing stability (AS), and raw storability (SG)) was also more excellent when the fluorine-based surface active agent expressed by general formula (FS) was used.

Example 3

The samples produced in Example 1 and Example 2 were subjected to a development process in a further simplified ECP-2 Process, in which the prebath and the subsequent water washing bath were omitted from the simplified ECP-2 Process used in Example 1, the pH of the developer was increased, and the processing time was shortened from 180 seconds to 135 seconds.

As a result, the similar results as in Example 1 and Example 2 were obtained, and it was confirmed that the effect of the invention was exhibited in a simplified developing process.

Example 4

Samples 201 to 236 were produced in the same manner as in the production of the samples in Example 1 and Example 2 except that the compound in the anti-halation layer was changed from the mixture of IV-1 and II-25 to a mixture of II-25 and the compound 37, and the tests and the evaluations were carried out in the same manner.

As a result, the similar results as in Example 1 and Example 2 were obtained, and it was confirmed that the effect of the invention was exhibited in this embodiment.

According to the invention, such a silver halide color photographic photosensitive material can be provided that has high image quality, is excellent in storage stability, is excellent in finishing uniformity and processing stability upon processing in laboratories, and exhibits less fluctuation in magenta density, and in particular, a silver halide color photographic photosensitive material that can be suitably used as a cinematographic color positive photosensitive material can be provided.

What is claimed is:

1. A silver halide color photographic photosensitive material comprising:

a transmitting support;

at least three photosensitive hydrophilic colloid layers disposed on the transmitting support, each photosensitive hydrophilic colloid layer including at least one of a yellow color forming coupler, a magenta color forming coupler and a cyan color forming coupler, and silver halide emulsion particles, which have a color sensitivity different from silver halide emulsion particles in the other photosensitive hydrophilic colloid layers, wherein at least one of the color sensitivities comprises green-sensitivity; and the silver halide color photographic photosensitive material has an Fe content of no more than $2\times10^{-5}$ moles/m²;

each silver halide emulsion particle including a halogen composition, which comprises at least one of silver chlorobromide, silver chloroiodide, silver chloroiodide bromide and silver chloride having a silver chloride content ratio of 95% by mole or more, an average sphere-equivalent particle diameter of the green-sensitive silver halide emulsion particles being no more than 0.25 μm and at least one of the green-sensitive silver halide emulsion particles being doped with Ir.

2. The silver halide color photographic photosensitive material according to claim 1, further comprising at least one compound, in the silver halide color photographic photosensitive material, which is represented by the following general formula (FS):

General formula (FS)

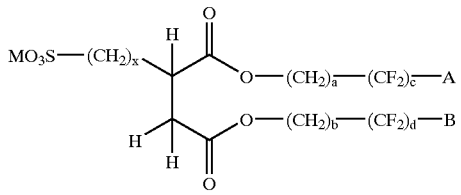

wherein, A and B each independently represents one of a fluorine atom and a hydrogen atom; a and b each independently represents an integer of 1 to 6; c and d each independently represents an integer of 4 to 8; x represents one of 0 and 1, and M represents a cation.

3. The silver halide color photographic photosensitive material according to claim 1, wherein each silver halide emulsion particle including a halogen composition comprises one of silver chlorobromide, silver chloroiodide, silver chloroiodobromide and silver chloride having a silver chloride content ratio of 98% by more or more.

4. The silver halide color photographic photosensitive material according to claim 1, wherein at least one of the green-sensitive silver halide emulsion particles contains an iridium compound, which comprises a hexa-coordinated iridium complex containing Ir as a central metal and at least one selected from Cl, Br and I as a ligand.

5. The silver halide color photographic photosensitive material according to claim 4, wherein the iridium compound comprises a hexa-coordinated iridium complex containing Ir as a central metal and at least one selected from $H_2O$, OH, O, OCN, thiazole and a substituted thiazole as a ligand.

6. The silver halide color photographic photosensitive material according to claim 4, wherein the iridium compound contains at least one hexa-coordinated iridium complex selected from the group consisting of $[IrCl_6]^{2-}$, $[IrCl_6]^{3-}$, $[IrBr_6]^{2-}$, $[IrBr_6]^{3}$ and $[IrI_6]^{3-}$, and at least one kind of hexa-coordinated iridium complex selected from the group consisting of $[Ir(H_2O)Cl_5]^{2-}$, $[Ir(H_2O)_2Cl_4]^{-}$, $[Ir(H_2O)Br_5]^{2-}$, $[Ir(H_2O)_2Br_4]-$, $[Ir(OH)Cl_5]^{3-}$, $[Ir(OH)_2Cl_4]^{3-}$, $[Ir(OH)Br_5]^{3-}$, $[Ir(OH)_2Br_4]^{3-}$, $[Ir(O)Cl_5]^{4-}$, $[Ir(O)_2Cl_4]^{5-}$, $[Ir(O)Br_5]^{4-}$, $[Ir(O)_2Br_4]^{5-}$, $[Ir(OCN)Cl_5]^{3-}$, $[Ir(OCN)Br_5]^{3-}$, $[Ir(thiazole)Cl_5]^{2-}$, $[Ir(thiazole)_2Cl_4]^{-}$, $[Ir(thiazole)Br_5]^{2-}$, $[Ir(thiazole)_2Br_4]^{-}$, $[Ir(5\text{-methylthiazole})Cl_5]^{2-}$, $[Ir(5\text{-methylthiazole})_2Cl_4]^{-}$, $[Ir(5\text{-methylthiazole})Br_5]^{2-}$ and $[Ir(5\text{-methylthiazole})_2Br_4]^{-}$.

7. The silver halide color photographic photosensitive material according to claim 4, wherein an amount of the iridium compound is in a range of from $1\times10^{-10}$ to $1\times10^{-3}$ mole per mole of silver contained in the green-sensitive silver halide emulsion particles.

8. The silver halide color photographic photosensitive material according to claim 1, wherein at least one type of the green-sensitive silver halide emulsion particles is doped with at least one of a transition metallic ion selected from the group consisting of iron, ruthenium, osmium, lead, cadmium and zinc.

9. The silver halide color photographic photosensitive material according to claim 1, wherein the silver halide color photographic photosensitive material has an amount of Fe of $8\times10^{-6}$ mol/m$^2$ or less.

10. The silver halide color photographic photosensitive material according to claim 1, wherein the silver halide color photographic photosensitive material has an amount of Fe in a range of from $1\times10^{-8}$ to $3\times10^{-6}$ mol/m$^2$.

11. The silver halide color photographic photosensitive material according to claim 1, wherein the green-sensitive silver halide emulsion particles have an average sphere-equivalent particle diameter of 0.20 $\mu$m or less.

12. The silver halide color photographic photosensitive material according to claim 1, wherein the green-sensitive silver halide emulsion particles have an average sphere-equivalent particle diameter in a range of from 0.05 to 0.18 $\mu$m.

13. The silver halide color photographic photosensitive material according to claim 1, wherein the silver halide emulsion particles have a variation coefficient (s/d) of particle diameter of 0.3 or less.

14. The silver halide color photographic photosensitive material according to claim 1, wherein the photosensitive hydrophilic colloid layers comprise a 1-aryl-5-mercaptotetrazole compound in an amount of from $1.0\times10^{-5}$ to $5.0\times10^{-2}$ mole per mole of the silver halide.

15. The silver halide color photographic photosensitive material according to claim 1, the silver halide color photographic photosensitive material further comprising a dye represented by the following general formula (I):

$$D—(X)_y \qquad (I)$$

wherein D represents a residual group of a compound having a chromophoric group; X represents one of a dissociative hydrogen atom and a group having a dissociative hydrogen atom that is connected to D one of directly and through a divalent linking group; and y represents an integer of from 1 to 7.

16. The silver halide color photographic photosensitive material according to claim 1, wherein the silver halide color photographic photosensitive material comprises a dye represented by the following general formula (A):

General formula (A)

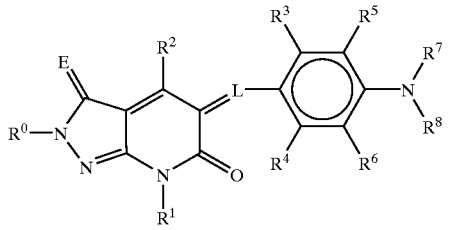

wherein L represents a nitrogen atom or a group formed by linking 1, 3, 5 or 7 methine group(s), which may be substituted, through a conjugated double bond; E represents O, S or N—$R^9$; $R^0$ and $R^9$ each independently represents one of a hydrogen atom, an alkyl group, an alkenyl group, an alkynyl group, an aryl group, a heterocyclic group, an amino group, a hydrazino group and a diazenyl group, which groups may be further substituted with another substituent; $R^1$ represents one of a hydrogen atom, an alkyl group, an aryl group, an alkenyl group, an alkynyl group and a heterocyclic group, which groups may be further substituted with another substituent; $R^2$ represents one of a hydrogen atom, a halogen atom, a cyano group, a nitro group, a hydroxyl group, a carboxyl group, an alkyl group, an aryl group, an alkenyl group, a heterocyclic group, an alkoxy group, an aryloxy group, an alkoxycarbonyl group, an aryloxycarbonyl group, an amino group, an acyloxy group, a carbamoyl group, a sulfamoyl group, an alkylthio group, an arylthio group, an alkylsulfonyl group, an arylsulfonyl group and an alkynyl group, wherein the alkyl group, the aryl group, the alkenyl group, the heterocyclic group, the alkoxy group, the aryloxy group, the alkoxycarbonyl group, the aryloxycarbonyl group, the amino group, the acyloxy group, the carbamoyl group, the sulfamoyl group, the alkylthio group, the arylthio group, the alkylsulfonyl group, the arylsulfonyl group and the alkynyl group may be further substituted with another substituent, provided that $R^0$ and $R^9$ may be connected to form a ring; $R^3$ and $R^4$ each independently represents one of a hydrogen atom, a halogen atom, an alkoxy group, an alkyl group, an alkenyl group, an aryloxy group and an aryl group; $R^5$ and $R^6$ each independently represents one of a hydrogen atom and a substituent; and $R^7$ and $R^8$ each independently represents one of an alkyl group, an aryl group, a vinyl group, an acyl group, an alkyl group and an arylsulfonyl group, provided that $R^3$ and $R^5$, $R^4$ and $R^6$, $R^7$ and $R^8$, $R^5$ and $R^7$, and $R^6$ and $R^8$ each may be connected to form a ring.

17. The silver halide color photographic photosensitive material according to claim 15, wherein the dye represented by the general formula (I) is contained in a solid fine particle dispersion together with a dispersion assistant.

18. The silver halide color photographic photosensitive material according to claim 16, wherein the dye represented by the general formula (A) is contained in a solid fine particle dispersion together with a dispersion assistant.

19. The silver halide color photographic photosensitive material according to claim 17, wherein the dispersion assistant comprises at least one of polyalkylene oxide compounds represented by the following general formulae (V-a) and (V-b):

General formula (V-a)

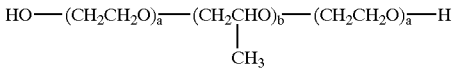

General formula (V-b)

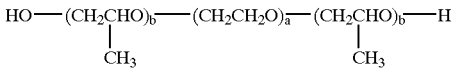

wherein a and b each independently represents a value of from 5 to 500.

20. The silver halide color photographic photosensitive material according to claim 19, wherein the polyalkylene oxide represented by the general formulae (V-a) and (V-b) comprises a weight ratio of a polyethylene oxide part of from 0.3 to 0.9, and the polyethylene oxide part comprises an average molecular weight of from 1,000 to 30,000 and an HLB (hydrophilicity-lipophilicity balance) value of from 7 to 30.

21. The silver halide color photographic photosensitive material according to claim 1, which is a cinematographic color positive photosensitive material.

22. The silver halide color photographic photosensitive material according to claim 1, wherein two or more kinds of photosensitive silver halide emulsions, which are different in at least one property selected from the group consisting of particle diameter, particle diameter distribution, halogen composition, shape of particles and sensitivity, are used as a mixture in the same silver halide emulsion layer.

23. The silver halide color photographic photosensitive material according to claim 1, wherein three or more kinds of photosensitive silver halide emulsions, which are different in at least one property selected from the group consisting of particle diameter, particle diameter distribution, halogen composition, shape of particles and sensitivity, are used as a mixture in the same silver halide emulsion layer.

24. The silver halide color photographic photosensitive material according to claim 1, wherein a blue-sensitive emulsion layer, a red-sensitive emulsion layer and a green-sensitive emulsion layer are disposed in this order from a side near the support.

* * * * *